US008407944B2

(12) United States Patent
Baloga et al.

(10) Patent No.: US 8,407,944 B2
(45) Date of Patent: Apr. 2, 2013

(54) MULTI-USE CONFERENCING SPACE, TABLE ARRANGEMENT AND DISPLAY CONFIGURATION

(75) Inventors: Mark A. Baloga, East Grand Rapids, MI (US); Frank G. Graziano, East Grand Rapids, MI (US); Terence D. West, Caledonia, MI (US); George V. Weller, Shelbyville, MI (US)

(73) Assignee: Steelcase Inc., Grand Rapids, MI (US)

( * ) Notice: Subject to any disclaimer, the term of this patent is extended or adjusted under 35 U.S.C. 154(b) by 1750 days.

(21) Appl. No.: 11/005,595

(22) Filed: Dec. 6, 2004

(65) Prior Publication Data

US 2006/0117669 A1 Jun. 8, 2006

(51) Int. Cl.
*E04H 1/06* (2006.01)

(52) U.S. Cl. ..... 52/36.1; 52/234

(58) Field of Classification Search ..... 52/29, 36.1, 52/36.4, 169.2, 174, 234, 238.1, 239; 434/72, 434/80; 108/59, 64, 102, 137, 143
See application file for complete search history.

(56) References Cited

U.S. PATENT DOCUMENTS

| | | | | |
|---|---|---|---|---|
| 892,954 | A | 7/1908 | Hanson | |
| 1,189,799 | A | 7/1916 | Erickson | |
| 2,489,933 | A | 11/1949 | Schwarz, Jr. | |
| 2,712,972 | A | 7/1955 | Manson et al. | |
| 3,053,598 | A | 9/1962 | Cheslow | |
| 3,342,147 | A | 9/1967 | Shettles | |
| 3,636,892 | A | 1/1972 | Linton | |
| 3,637,268 | A | 1/1972 | Walter | |
| 3,741,852 | A | 6/1973 | Keener | |
| 4,382,642 | A | 5/1983 | Burdick | |
| 4,409,906 | A * | 10/1983 | Alneng | 108/64 |
| 4,562,482 | A | 12/1985 | Brown | |
| 4,619,427 | A | 10/1986 | Leymann | |
| 4,659,048 | A | 4/1987 | Fahrion | |
| 4,725,106 | A | 2/1988 | Shields et al. | |
| 4,732,088 | A | 3/1988 | Koechlin et al. | |

(Continued)

FOREIGN PATENT DOCUMENTS

| | | |
|---|---|---|
| DE | 31 00 660 A1 | 7/1982 |
| DE | 85 33 571.1 | 3/1986 |

(Continued)

OTHER PUBLICATIONS

Office Space: Designing Your Next Office, 2004 Newsweek, 2004 MSNBC.com, http://msnbc.msn.com/id/3068812, Apr. 19, 2003, 2 pages.

(Continued)

*Primary Examiner* — Joshua J Michener
*Assistant Examiner* — Matthew J Smith
(74) *Attorney, Agent, or Firm* — Quarles & Brady LLP

(57) ABSTRACT

A conferencing assembly, the assembly comprising a support, at least one table top member forming a substantially flat top surface, the at least one top member supported by the support with the flat surface substantially horizontal, the at least one top member including at least first and second substantially straight edge sections where the second edge section forms an angle with respect to the first edge section of less than substantially sixty degrees and at least first and second display screens positioned adjacent and substantially parallel to the first and second edge sections, respectively, each of the first and second display screens facing across at least a portion of the top surface of the top member.

34 Claims, 28 Drawing Sheets

U.S. PATENT DOCUMENTS

| | | | | |
|---|---|---|---|---|
| 4,758,887 | A | 7/1988 | Engel et al. | |
| 4,817,903 | A | 4/1989 | Braehler et al. | |
| 4,836,478 | A | 6/1989 | Sweere | |
| 4,922,835 | A | 5/1990 | Van Vliet et al. | |
| 4,974,173 | A | 11/1990 | Stefik et al. | |
| 4,974,913 | A | 12/1990 | Vogt et al. | |
| D322,857 | S | 12/1991 | Bacus | |
| 5,239,373 | A | 8/1993 | Tang et al. | |
| 5,321,579 | A | 6/1994 | Brown et al. | |
| 5,392,400 | A | 2/1995 | Berkowitz et al. | |
| D359,405 | S | 6/1995 | Ball | |
| 5,438,937 | A | 8/1995 | Ball et al. | |
| 5,442,788 | A | 8/1995 | Bier | |
| 5,465,370 | A | 11/1995 | Ito et al. | |
| 5,557,725 | A | 9/1996 | Ansberry et al. | |
| 5,595,126 | A | 1/1997 | Yeh | |
| 5,687,499 | A | 11/1997 | Brnjac | |
| D388,639 | S | 1/1998 | Dormon et al. | |
| D390,381 | S | 2/1998 | Dormon et al. | |
| D392,361 | S | 3/1998 | Cooper | |
| 5,724,778 | A | 3/1998 | Cornell et al. | |
| D393,382 | S | 4/1998 | Rutter et al. | |
| 5,735,220 | A | 4/1998 | Wang | |
| 5,738,316 | A | 4/1998 | Sweere et al. | |
| 5,765,315 | A | 6/1998 | Nagamitsu et al. | |
| 5,918,841 | A | 7/1999 | Sweere et al. | |
| D413,212 | S | 8/1999 | Dame et al. | |
| 5,943,966 | A | 8/1999 | Machado et al. | |
| 5,967,058 | A * | 10/1999 | Ambrose et al. | 108/64 |
| 6,012,398 | A | 1/2000 | Boyce | |
| 6,057,835 | A | 5/2000 | Sato et al. | |
| 6,060,993 | A | 5/2000 | Cohen | |
| 6,158,358 | A | 12/2000 | Prendergast | |
| 6,161,487 | A | 12/2000 | Chang | |
| 6,170,200 | B1 * | 1/2001 | Cornell et al. | 52/36.1 |
| 6,170,926 | B1 | 1/2001 | Roberts et al. | |
| 6,182,580 | B1 | 2/2001 | Barrett et al. | |
| 6,182,581 | B1 | 2/2001 | Boyce | |
| 6,199,101 | B1 | 3/2001 | Pfaff | |
| 6,201,859 | B1 | 3/2001 | Memhard et al. | |
| 6,203,053 | B1 | 3/2001 | Sohrt et al. | |
| 6,266,691 | B1 | 7/2001 | Watanabe et al. | |
| 6,286,794 | B1 | 9/2001 | Harbin | |
| 6,298,794 | B1 | 10/2001 | Brown et al. | |
| 6,359,711 | B1 | 3/2002 | Cole et al. | |
| D456,155 | S | 4/2002 | DeVriendt | |
| 6,363,866 | B1 | 4/2002 | Schwartz | |
| 6,374,547 | B1 | 4/2002 | Baloga et al. | |
| 6,382,109 | B1 | 5/2002 | Novikoff | |
| 6,394,402 | B2 | 5/2002 | Coonan et al. | |
| 6,427,389 | B1 | 8/2002 | Branc et al. | |
| 6,443,073 | B1 | 9/2002 | Tsang et al. | |
| 6,453,826 | B1 | 9/2002 | Fookes et al. | |
| 6,497,184 | B1 | 12/2002 | Whitesitt | |
| 6,554,433 | B1 | 4/2003 | Holler | |
| 6,574,674 | B1 | 6/2003 | May et al. | |
| 6,588,346 | B1 | 7/2003 | Bockheim et al. | |
| 6,598,542 | B2 | 7/2003 | Goldbert et al. | |
| 6,609,691 | B2 | 8/2003 | Oddsen, Jr. | |
| 6,614,451 | B1 | 9/2003 | Hudson et al. | |
| 6,662,210 | B1 | 12/2003 | Carleton et al. | |
| 6,662,734 | B2 | 12/2003 | Chang | |
| 6,681,529 | B1 | 1/2004 | Baloga et al. | |
| 6,695,270 | B1 | 2/2004 | Smed | |
| 6,751,914 | B2 | 6/2004 | Zeh et al. | |
| 2002/0011197 | A1 | 1/2002 | Akyuz | |
| 2002/0083137 | A1 | 6/2002 | Rogers et al. | |
| 2002/0132216 | A1 | 9/2002 | Dohrmann | |
| 2002/0186236 | A1 | 12/2002 | Brown et al. | |
| 2002/0194792 | A1 | 12/2002 | Feldpausch et al. | |
| 2003/0011467 | A1 | 1/2003 | Suomela | |
| 2003/0098819 | A1 | 5/2003 | Sukthankar et al. | |

FOREIGN PATENT DOCUMENTS

| | | |
|---|---|---|
| DE | 196 52 108 A1 | 8/1998 |
| DE | 299 10 262 | 9/1999 |
| EP | 0 264 589 | 8/1987 |
| EP | 0 230 236 | 9/1987 |
| EP | 0 992 921 | 12/2000 |
| EP | 0 801 342 B1 | 8/2003 |
| GB | 2 365 662 | 2/2002 |
| JP | 11-332674 | 12/1999 |
| JP | 2000236329 A2 | 8/2000 |
| WO | WO 00/17737 | 3/2000 |
| WO | WO 01/31397 A1 | 3/2001 |
| WO | WO 02/12992 | 2/2002 |

OTHER PUBLICATIONS

David Coursey, Microsoft's Vision of Tomorrow Sparks Wonder, Fear, eWEEK.com, 2004 Ziff Davis Media Inc. http://www.eweek.com/print_article/0,1761,a=13128,00.asp, Jul. 12, 2004, 3 pages.

Microsoft Opens Productivity Research Center, ISA—The Instrumentation, Systems, and Automation Society, http://www.isa.org/InTechTemplage.cfm?Section. =InTech&template=/ContentManagement/ContentDisplay.cfm &ContentID=18830, Sep. 26, 2002, 1 page.

Enhanced Microsoft Exhibit Offers Sneak Peek at Office of the Future, 2004 Microsoft Corporation, http://www.microsoft.com/presspass/features/2004/mar04/03-22CIW.asp, Mar. 22, 2004, 6 pages.

* cited by examiner

MULTI-USE CONFERENCING SPACE, TABLE ARRANGEMENT AND DISPLAY CONFIGURATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to improved space layouts, table configurations and display configurations and more specifically to space, table and display assemblies that are configurable in many different ways to support conferencing requirements of differently sized groups of people.

It is common knowledge that when people share a common goal and work together toward that goal, the goal is typically achieved faster and more efficiently than if those same people worked separately toward the same goal. It is also common knowledge that, in most cases, people within large groups have different sets of strengths and that common goals can be achieved most efficiently and effectively by identifying tasks required to achieve the goals and assigning tasks to specific people within the larger group that have specific strengths particularly suited for achieve those tasks. Moreover, it is also generally accepted that there are different stages involved in achieving any common goal and that the extent of collaborative activities and communications at each stage are different.

For instance, during a first stage of achieving a common goal, at least one and in many cases several people within a large group formulate their own vision of a goal to achieve by the larger group. Second, after one or more people formulate their own vision of a goal, the vision or visions are shared with people in the larger group. People in the larger group critically discuss the individual vision or visions so that all merits and problems are brought to light. The people in the group settle on one common goal that all group members can agree to work toward. After a common goal is accepted by group members, the group identifies and agrees upon separate tasks to be completed in order to achieve the common goal and to identify subsets or teams (e.g., two, three, four, etc.) of people from the larger group best suited to achieve the tasks.

Third, after tasks have been assigned to smaller teams, the smaller teams apply their particular skills to the assigned tasks with an eye toward completing those tasks. Here, the larger process may be repeated again with each team member separately taking on different subsets of the team tasks.

Fourth, while the teams are working in parallel on their assigned tasks, the larger group may periodically get together to review progress by the teams, to modify the common goal or the directions in which the different teams are headed, to change the team members, etc.

Fifth, once all of the teams have completed their assigned tasks, the entire group gets together again to achieve the common goal by communicating how the tasks have been completed and the end results.

Office designers have known for a long time that the efficiency and effectiveness with which people perform specific types of activities or tasks is closely related to the environments in which the people perform those activities. For example, in the past, it has generally been accepted that collaborative activities between large groups of people such as sharing personal visions and discussing and identifying a common group goal are best performed in a large dedicated and confidential conference space or room away from private personal spaces (e.g., private offices or partition spaces). Where common spaces are dedicated to conferencing, people can come together in a relatively neutral location that is not specifically associated with any one group member or subset of group members. Where a space is generally confidential, people within the space are more likely to share unconventional ideas and concepts which often result in new common goals and ways of achieving those goals.

In addition, where large groups collaborate on ideas and information, typical resources (i.e. environmental enhancements) used to facilitate collaboration include a large table, surrounding chairs and some type of visual aid. The table is provided so that conference attendees have a convenient location to place reference materials such as paper documents, laptops and/or notepads for taking notes. In general it has been recognized that visual queues are very important in communication. For instance, where a first person is explaining a concept to a second person, by observing the second persons facial expressions (e.g., a grimace, a surprised look, etc.) and body movements (i.e., nodding of the head, shaking of the head, etc.) during explanation, the first person can usually gauge if the second person is understanding the concept, agrees or disagrees with the concept, wants to interject a comment or another related idea, etc. Similarly, where a third person is listening to the explanation, if the third person can see the second persons facial expressions and body movements, the third person also can gauge the second persons reaction to the presentation and, if necessary, interject helpful comments or, if the second person is showing signs of disagreement with the first person, may feel more comfortable questioning the first persons information or point of view. For this reason, many conference tables are configured so that people there around have at least some direct line of sight to other people at the table (i.e., the table top may be round, oval, etc.) and hence can visually gauge how ideas are being accepted, if ideas are being understood and if other people want to interject related ideas and comments.

Visual aids may include, for instance, a large pad of paper mounted to an easel, a large whiteboard, a large television, a large flat panel electronic display screen, a screen and projector, etc. Where visual aids are used, the visual aid is usually located within the conference space at a commanding or focal location within the space so that when a conference attendee uses the aid, others at the conference have a view of the information being presented. For instance, in known configurations where an electronic display is employed, the display is space away from and to one side of the conference table and is mounted to a wall that at least in part defines the conference space. Here, to help all conference attendees at a table to view the display screen, the screen is typically mounted at a height well above (e.g., the lower screen edge is at least a foot) the table top height.

As another example, it has generally been accepted that smaller group activities such as working on tasks assigned to smaller teams of people are best performed in smaller confidential spaces or rooms that include tables, chairs and, in many cases, visual aids (e.g., a pad of paper, a white board, an electronic display screen, etc.). Tables in these spaces are usually smaller than the tables provided in the larger conference spaces so that team members are more intimately located for idea sharing and collaboration. Again, confidential space fosters sharing of unconventional ideas and concepts and often results in innovative ways to complete tasks effectively and efficiently.

As one other example, it has generally been accepted that individuals need to work separately at some times in order to help achieve group goals and that the best environment for performing individual work is a private office or partition space where a person has access to a personal computer or the like. For instance, when identifying a personal vision for a group or when working on details required to complete larger tasks or achieve common goals, individuals often work best in private dedicated personal spaces.

To best accommodate all types of activities required to achieve group goals, most offices are currently configured to include at least three different types of space including large conference spaces, relatively smaller conference spaces and personal private type spaces (e.g., offices) where each of the spaces includes a table or desk suitable for the activities likely to be performed in the space, a chair or chairs and other resources such as a visual aids, computers, etc. Here, the theory is that groups of people are fluid between the different spaces, coming together in the conference spaces to discuss and define goals and tasks and to perform collaborative tasks and separating into the private spaces to complete detail type activities.

While offices that are physically divided into three different types of space are common and clearly have some advantages related to facilitating collaborative work, it is believed that these types of spaces also have several important shortcomings. First, despite efforts to arrange tables, chairs and visual aids within large conference rooms in ways that foster communication between attendees, often the end result is a configuration that adversely affects communication. For instance, where an electronic display is mounted to a wall at one end of a large conference table, many attendees at the table have to rotate their chairs or, in some cases, have to completely turn their chairs around to view information presented via the aid. In addition, in some cases, attendees may have to move their chairs away from the edge of the conference table in order to view information presented via the display without obstructing other attendee views. Here, where all attendees face generally in one direction toward the display screen, attendees cannot easily make eye contact with, or observe other visual queues from, other attendees and hence cannot determine if concepts are being understood, if other attendees want to interject comments or agree or disagree with information presented. Clearly lack of visual queues reduces communication effectiveness appreciably.

As another instance, where attendees move to a focal or commanding location within a conference space such as adjacent a display screen mounted on a conference space wall to present information, the dynamic within the space changes. To this end, when one attendee moves to a commanding location within a space, the dynamic changes from one of collaboration between peers to presentation by a single attendee that temporarily assumes the mantle of group leader. It is believed that when one group member assumes a commanding location within a space to present information, other conference attendees tend to become less critical of the information, ideas and concept presented and hence interchange of ideas is stifled.

As still one other instance, even where a person presenting information via a wall mounted display or the like remains seated at a conference table during the presentation, at least some of the people at the table still have to physically rotate their chairs toward the display screen or divert their field of view away from the presenter and toward the screen to view presented information. When chairs are rotated away from a presenter or fields of view are diverted from the presenter, the presenter loses the ability to sense visual queues.

Second, while movement between large group, small team and individual activities and spaces that facilitate those activities is, in theory, supposed to be fluid, in reality, such movement is usually interrupted and disjointed. In this regard, while people in large groups often become energized when common goals and tasks for achieving those goals are identified and when tasks are initially assigned to team members, after leaving a conference, attendees often lose focus, start to question the common goals or tasks assigned to achieve the goals and/or turn their attention to other activities unrelated to the common goals and tasks. In short momentum is lost when the large group breaks up to pursue assigned tasks.

Third, while electronic display screens are advantageous for sharing information among groups and teams of people, currently such displays are relatively expensive and are usually dedicated to single conference spaces. For this reason, while large electronic displays may be provided in large conference spaces for use by large groups where the cost associated therewith is justifiable, in many cases such displays are not provided in smaller conference spaces. Instead, in smaller spaces, less expensive visual aids such as whiteboards or large paper pads are often provided to facilitate collaboration.

Where large displays (e.g., televisions or the like) have been provided on wheeled carts to enable movement between two or more different conference spaces, despite being moveable, in many cases these types of displays are positioned at one location in one space and are not moved among spaces due to their size, linkage requirements to computers, etc., to drive the displays and so on.

Fourth, many people find it difficult to share their ideas and concepts in large groups and, in particular, in groups where other group members will likely have different and divergent ideas and where some group members may have relatively strong personalities. In fact, there are at least some studies that suggests that the best collaborative activities take place in pairs (i.e., in groups of two) as most people can develop a sense of trust with one person more quickly than with larger groups of people. Therefore, when goals, tasks and personal skills are discussed in large group conferences, often many people that have different and valuable views, suggestions and comments do not express themselves and goals and tasks are set without the benefit thereof and, in many cases, without complete acceptance by all group members. While iterative large group and small team conferences may minimize the effects of this problem, in many cases the lack of fluidity between large and small groups and associated spaces causes conference attendees to forgo such solutions and instead the group ploughs ahead without the benefit of all ideas being expressed and without complete buy in to group goals.

Fifth, providing many different spaces that are each dedicated to one type of use (e.g., large conferencing, small team conferencing or individual private use) is relatively expensive and often results in spaces that are relatively underutilized. For instance, in many cases, while a company may periodically need a large conference space to share information, in many cases such large conference spaces will go unused during more than 90% of normal business hours.

Sixth, requiring people to separate and come together multiple times and to break the flow of activities between different spaces breaks trains of thought and generally slows momentum toward achieving goals. Where goals are slowly achieved businesses often fail.

One solution to at least some of the problems discussed above has been to provide a plurality of relatively small table assemblies in a large conference space where the table assemblies can be brought together to form a large conference table or can be separated to facilitate smaller team sized conferencing break out sessions. In these cases the tables may be mounted on casters or the like to facilitate easy rearrangement of the assemblies for whatever purpose they are required. In addition, in these cases often some type of linking mechanism is provided to lock adjacent table tops together to form a large table arrangement when desired and some type of brake mechanism is provided on the casters so that the separate table tops do not move about with respect to each other. The brake mechanism is also used to lock the separate table assemblies in positions after the table tops are separated to facilitate break out sessions. Here, a single space can be used generally to either facilitate a large conference about a single table arrangement including the smaller tables or to facilitate two or more smaller conferences by physically separating the table assemblies.

In addition, multiple tables can be used to maintain fluidity of a series of large and small conferences within a single space so that greater progress toward defining goals and completing tasks can be achieved in a shorter amount of time. For instance, with small tables together to form a large conference table top arrangement, a large conference can be conducted. Thereafter, the tables can be separated and smaller breakout sessions can be conducted followed by bringing the tables back together to conduct yet another large conference session to further share small group information.

Unfortunately, while multi-table assemblies deal with some of the problems discussed above, such assemblies do not address other problems. For instance, multiple table assemblies do not address the issues related to location of large display screens or other visual aids that require conference attendees to physically turn away from other attendees at a conference in order to view presented information or the fact that attendees that use the visual aids are located in commanding positions that reduce criticism and comments from other attendees.

As another instance, multiple table assemblies do not address issues related to providing electronic displays for each of a plurality of smaller conference table configurations when breakout sessions occur. Indeed, where only a single electronic display is provided in a large conference space, when breakout sessions occur, the single display can only be used by members of one of the breakout sessions at a time.

As still one other instance, while separate table assemblies can be moved to different locations within a large conference space to facilitate breakout sessions, such physical distance between tables without visual barriers of any type (e.g., vertical walls of partition systems of some type) often is insufficient to give people the feeling of being in a space that is confidential or at least semi-confidential with respect to the other areas of the larger space. As in the case of sharing ideas in large groups, many people have difficulty sharing ideas in spaces where confidentiality is suspect.

In addition, even where separate table assemblies are provided to facilitate both large conferences and small breakout sessions, it is believed that several factors discourage using the tables separately to facilitate multiple breakout sessions. First, the lack of relatively expensive electronic display screens for use with each separate table assembly discourage breakout sessions using the separate tables. Second, problems associated with suspect confidentiality have discouraged separation of the table assemblies to facilitate break out sessions. Third, it is believed that any work required to rearrange tables about a conference room including disconnecting linking mechanisms between tables, unlocking caster brake mechanisms, etc., operates as a strong impediment to rearranging those tables. The impediment is exacerbated where additional tasks (e.g., realigning tables, relocking brake mechanisms and reconnecting linking mechanisms, etc.) have to be completed to reconfigure the tables in the original large table arrangement. The impediment is still further exacerbated where the locking and unlocking and brake mechanisms are not completely intuitive to users as many users will not routinely use such features or where the activities require users to crawl under table tops to perform the locking and linking activities.

In cases where the tasks associated with reconfiguring table assemblies is are not understood or are considered to burdensome, after a large conference around a multiple table assembly arrangement, when small break out sessions are to occur, instead of breaking up the table arrangement, conference attendees simply leave the conferencing space and conduct smaller team meetings in private offices or other smaller conference spaces (i.e., in other rooms dedicated to conferencing). Thus, despite added costs associated with providing a versatile table configuration, the table configuration is not used for its intended purpose.

One other solution to some of the problems discussed above is to provide a lap top to each conference attendee and to present information to the attendees via lap top display screens. Here, attendees needn't turn away from a conference table to view information being presented and each attendee has an unobstructed view of presented information. In addition, when the attendees separate to facilitate smaller breakout sessions, each attendee has her own laptop display screen for collaborating with team members.

One problem with sharing conference information via laptops is that attendees focus on the information on their laptops instead of making visual contact with the other attendees. In addition, while information is being presented by one attendee, often other attendees will want to use their laptops to locate other information that they want to share with the other attendees. Where presentation information is provided via laptops, non-presenting attendees cannot use their laptops for other purposes.

Thus, it would be advantageous to have a new conference configuration wherein all conference attendees have a clear and generally unobstructed view of information being presented via visual aids and particularly via display screens. In addition, it would be advantageous to have a conferencing configuration where table sections can easily be arranged in different orientations to accommodate large or small groups of attendees. Moreover, it would be advantageous to have a conference configuration wherein display screens could be used in multiple positions within the conference space and, in at least some cases, outside the conference space, to share information where the supporting structure that facilitates movement of the displays enables extremely simple and intuitive movement.

BRIEF SUMMARY OF THE INVENTION

It has been recognized that at least two displays can be placed at generally opposite edges of a conference table top and used by conference attendees about the top to share information in ways that are particularly advantageous. To this end, with displays at generally opposite table top edges and with the same information presented on each display, conference attendees need not turn away from the conference table in general to observe information presented via at least one of the displays. Instead, the attendees need only look across a part of the table to observe the presented information.

It has also been recognized that with edge positioned display screens, attendees can view other attendees directly to identify visual queues from the other attendees and need only divert their field of view minimally to see presented information on one of the edge positioned screens. Moreover, an information presenter can remain seated at a conference table while presenting information and hence a feeling of peer to peer communication and collaboration can be maintained regardless of which attendee is presenting. Furthermore, a presenting attendee can refer to any of the edge positioned display screens to when communicating with other attendees which allows the presenter to generally face any attendee that the presenter is addressing while still generally facing at least one of the screens.

In addition, it has been recognized that a table assembly can be mounted at least in part to a rail that facilitates table splitting into two or more sections to facilitate breakout sessions. Here, by mounting the table sections to a rail where the sections slide apart along the rail, a particularly intuitive split table configuration can be formed that is easy and simple to use. Here, in at least some cases, a separate display screen can be positioned adjacent at least one edge of each table section so that when the sections are separated, a separate one of the displays is useable with a separate one of the sections to facilitate breakout session information sharing.

Consistent with the above, at least some embodiments of the invention include a conferencing assembly, the assembly comprising a support and at least one table top member forming a substantially flat top surface, the at least one top member supported by the support with the flat surface substantially horizontal, the at least one top member forming first and second corners, a first edge extending between the first and second corners and a second edge extending between the first and second corners, the first edge including at least one substantially straight section proximate the first corner and at least one curved section that bows convexly outward generally away from the second edge, the second edge including at least one curved section that bows convexly outward generally away from the first edge. Here, the second edge may also includes at least one substantially straight section. In some cases the substantially straight section of the second edge is proximate the second corner.

In some cases the at least one top member includes at least first and second top members that form the first and second edges. In some cases the first and second top members form the first and second edges, respectively. In some cases the first and second edges are external edges and wherein the first top member forms an internal edge opposite the external edge of the first top member that extends between the first and second corners and the second top member forms an internal edge opposite the external edge of the second top member that extends between the first and second corners. In addition, in some cases the internal edges of the first and second top members are substantially straight and wherein the internal edge of the first top member is parallel to the internal edge of the second top member. Moreover, in some cases the support facilitates movement of at least one of the first and second top members with respect to the other of the first and second top member. Here, the support may include at least one rail and the at least one of the first and second top members that is supported to move with respect to the other of the first and second top members may be mounted to the rail for sliding movement there along. Moreover, in some embodiments each of the first and second top members is mounted to the at least one rail for sliding movement there along. Furthermore, each of the first and second top members may be mounted to the rail for movement along a trajectory that is substantially parallel to the internal edges of the first and second top members.

In some cases the first and second top members are positionable along the rail in at least two juxtapositions including a combined orientation wherein the internal edges of the first and second top members are adjacent along substantially their entire length dimensions and a spaced orientation wherein at least a section of the internal edge of the first top member is spaced from at least a section of the internal edge of the second top member. In addition, in some cases each of the first and second top members slides along the rail along a trajectory that is parallel to the internal edge of the top member. In some cases the straight section of the first edge is closer to the second corner when the first and second top members are in the spaced orientation than when the first and second top members are in the combined orientation.

In some cases the straight section of the first edge is closer to the second corner when the first and second top members are in the combined orientation than when the first and second top members are in the spaced orientation. Here, in some cases the assembly further includes at least one display screen wherein the screen is positioned along the at least one substantially straight section of the first edge with the screen generally facing in the direction of the second edge. In addition, in some cases the display screen includes a lower edge and wherein the lower edge is proximate the straight section of the first edge. In some cases the display screen is at least eighteen inches high by twenty-four inches wide. In addition, in some cases the display screen is mounted to the straight section of the first edge.

In other cases the support is a first support and wherein the assembly further includes a second support that independently supports the display screen adjacent the first edge. Here the second support may include wheels for transporting the display screen. In some cases the second support includes a rail and an arm assembly, the arm assembly mounting the screen to the rail for movement there along. In some cases the second edge includes at least one substantially straight section proximate the second edge and the display screen is a first display screen and wherein the assembly further includes at least a second display screen, the second display screen positioned along the straight section of the second edge with the second screen generally facing in the direction of the first edge.

In a particularly advantageous configuration the first and second screens face in opposite directions. Here the first and second display screens may oppose each other.

In some cases the assembly further includes at least first and second display screens positioned along the straight sections of the first and second edges, respectively. In some cases the first and second display screens generally face the second and first edges, respectively.

At least some embodiments of the invention also include a conferencing assembly comprising a support rail having a length dimension, a first table top member forming a substantially flat top surface and including an internal edge that extends between first and second corners and an external edge that extends between the first and second corners, the first table top supported by the rail on a first side of the rail and with the internal edge proximate the rail for sliding movement along a trajectory parallel to the length dimension and a second table top member forming a substantially flat top surface and including an internal edge that extends between first and second corners and an external edge that extends between the first and second corners, the second table top supported by the rail on a second side of the rail with internal edge of the second top member proximate the rail.

Here, the second top member may be supported by the rail for sliding movement along a trajectory parallel to the length dimension of the rail. In some cases the assembly further includes at least a first display screen positioned adjacent the external edge of the first table top. In addition, in some cases the assembly further includes at least a second display screen positioned adjacent the external edge of the second table top.

Moreover, at least some embodiments include a conferencing assembly comprising a support, at least one table top member forming a substantially flat top surface, the at least one top member supported by the support with the flat surface substantially horizontal, the at least one top member including at least first and second substantially straight edge sections where the second edge section forms an angle with respect to the first edge section of less than substantially sixty degrees and at least first and second display screens positioned adjacent and substantially parallel to the first and second edge sections, respectively, each of the first and second display screens facing across at least a portion of the top surface of the top member.

Moreover, some embodiments include a conferencing assembly comprising a support, at least one table top member forming a substantially flat top surface, the at least one top member supported by the support with the flat surface substantially horizontal, the at least one top member including at least first and second generally oppositely facing edge sections and at least first and second display screens including first and second front surfaces positioned proximate the first and second edge sections, respectively, each of the first and second display screens facing across at least a portion of the top surface of the top member, the first display screen facing in a first direction and the second display screen facing in a second direction wherein the second direction is generally opposite the first direction.

In some cases each of the first and second screens includes a lower edge and wherein the lower edges of the first and second screens are adjacent the first and second edge sections. In some cases the lower edges of the first and second screens are immediately adjacent the first and second edge sections. In some cases the at least one top member includes at least first and second top members, the first top member forms the first edge and the second top member forms the second edge and wherein the support supports at least the first top member for movement with respect to the second top member. In some cases the support includes a rail and wherein each of the first and second top members are mounted to the rail for sliding motion along a rail length dimension.

At least some embodiments include a conferencing assembly comprising a support, at least one table top member forming a substantially flat top surface, the at least one top member supported by the support with the flat surface substantially horizontal, the at least one top member including at least first and second generally oppositely facing edge sections, at least first and second rail members positioned above and substantially parallel to the table top surface, the at least first and second rail members including distal ends that extend outward past the first and second edge sections of the table top, respectively, at least first and second display screens mounted for movement along the first and second rail members, respectively, each of the display screens supportable by one of the rail members in a first use position wherein the first and second display screens are at first locations along the first and second rail members and face in substantially opposite directions across the table top, respectively, and at least a second position wherein the first and second display screens are located at second locations along the first and second rail members, respectively.

Furthermore, some embodiments include a display assembly for use in at least first and second different spaces, the assembly comprising at least one wall that at least in part divides first and second spaces, the wall forming an opening, a flat panel display including a front viewing surface and a mount at least in part located within the opening, the mount supporting the flat panel display for movement between at least a first position wherein the front viewing surface is viewable within the first space and a second position wherein the display is viewable within the second space.

In some cases the mount includes at least one rail and wherein the display is supported by the at least one rail for sliding motion between the first and second spaces. In some cases the display is supported by the at least one rail for sliding motion between the first and second positions. In some cases the display is supported by a pivot assembly for rotational motion about a pivot axis wherein the pivot assembly is supported by the rail. In some cases the pivot axis is vertical. In some cases the rail is a first rail and the mount further includes a second rail spaced below and substantially parallel to the first rail and wherein the display is supported by the first and second rails for sliding motion between the first and second spaces. In some cases the rail extends from the first space to the second space through the opening. In some cases the mount includes a pivot assembly mounted within the opening and wherein the display is supported by the pivot assembly for rotational motion between the first and second positions. In some cases at least a portion of the display is located within the opening when the display is in the first position and at least a portion of the display is located within the opening when the display is in the second position. In some cases the at least one wall includes oppositely facing first and second wall surfaces and wherein the front viewing surface is substantially parallel to the first and second wall surfaces when the display is in the first and second positions, respectively. In some cases the pivot assembly includes a door assembly including a door surface and wherein the display is mounted to the door surface.

Some embodiments include a conferencing configuration facilitating variable use of space, the configuration comprising a space wall structure including at least a first space wall that forms an opening between first and second spaces and that includes a first space wall surface adjacent the opening, a flat display panel including a front viewing surface and an oppositely facing rear surface and a mount supported by the first space wall surface, the mount supporting the flat panel display for movement between at least a first position wherein the rear surface is proximate the first primary wall surface and the front viewing surface is visible within the first space and a second position wherein the front surface faces and is viewable in the second space.

In addition, at least some embodiments include a conferencing configuration facilitating variable use of space, the configuration comprising a space wall structure defining a primary space, the space wall structure including at least a first space wall that at least in part forms an opening, a first alcove wall structure forming a first alcove space within the at least one opening, at least one rail supported above the primary space, the at least one rail including first and second ends, the first end proximate the first alcove space and a first flat panel display including a front viewing surface, the display linked to the rail for movement between a first position within the primary space with the front viewing surface visible within the primary space and a second position wherein the display is proximate and viewable within the first alcove space.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

Figure 1:
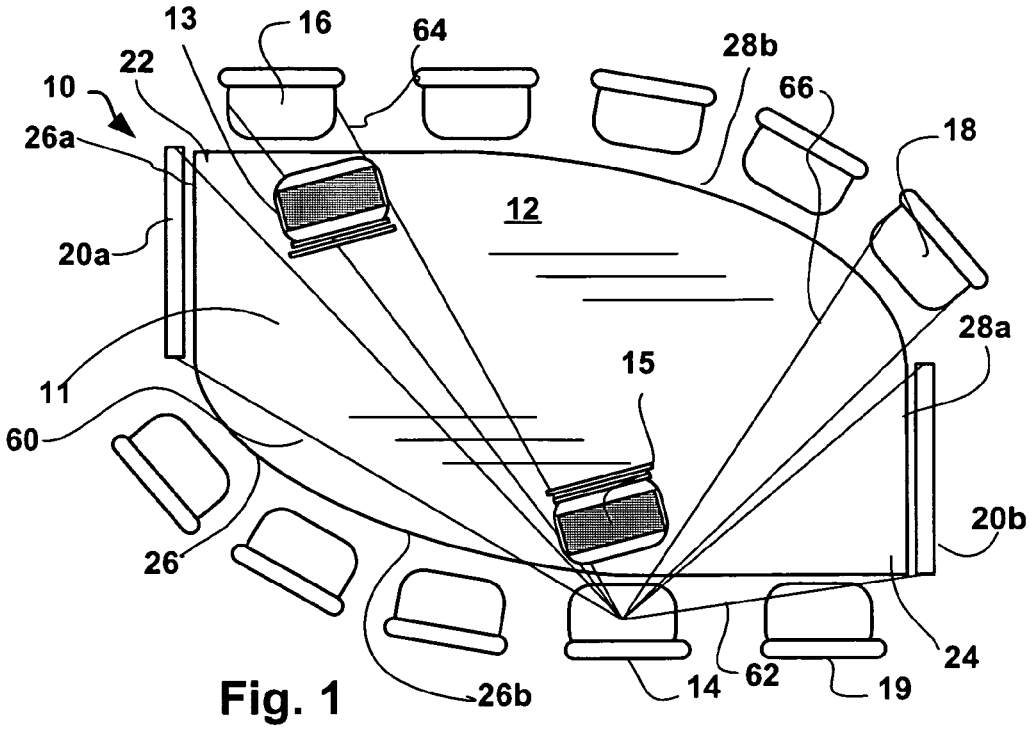
FIG. 1 is a is a top plan view showing one conference configuration according to at least some aspects of the present invention.

One or more specific embodiments of the present invention will be described below. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring now to the drawings wherein like reference numerals correspond to similar elements throughout the several views and, more specifically, referring FIGS. 1 through 4, a first embodiment of the present invention will be described in the context of an exemplary conferencing configuration 10 including a conference table assembly 11, a plurality of chairs, four of which are identified by numerals 14, 16, 18 and 19 and two flat panel video display assemblies identified by numerals 20*a* and 20*b*.

Figure 2:
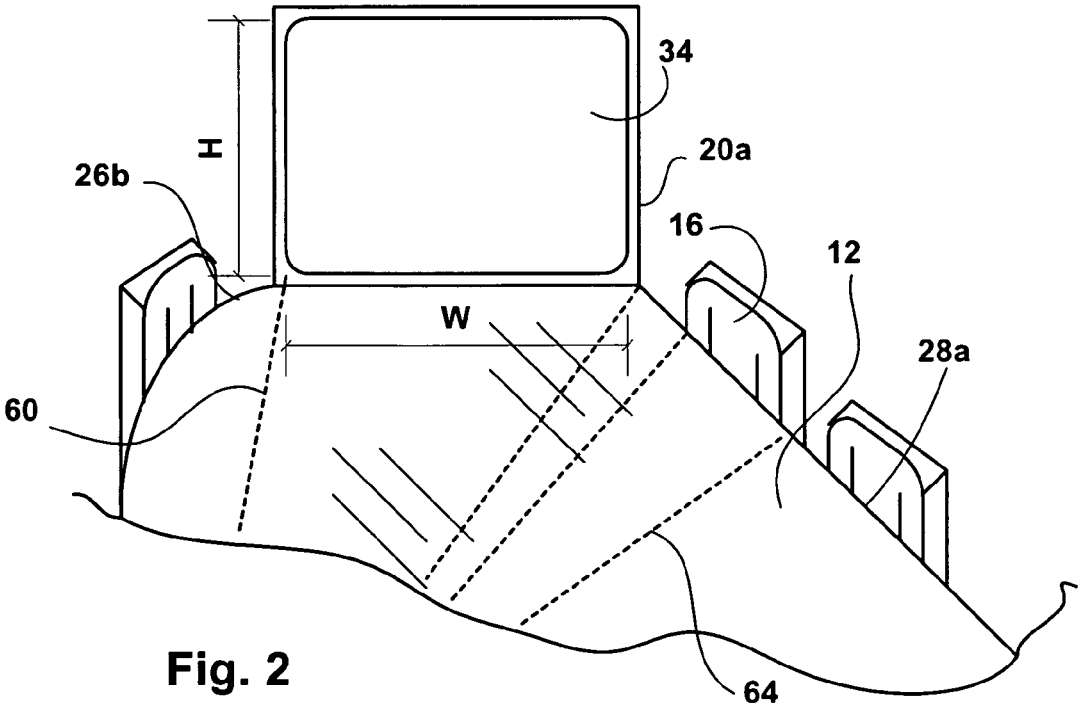
FIG. 2 is a view of one end of the configuration illustrated in FIG. 1.
Figure 4:
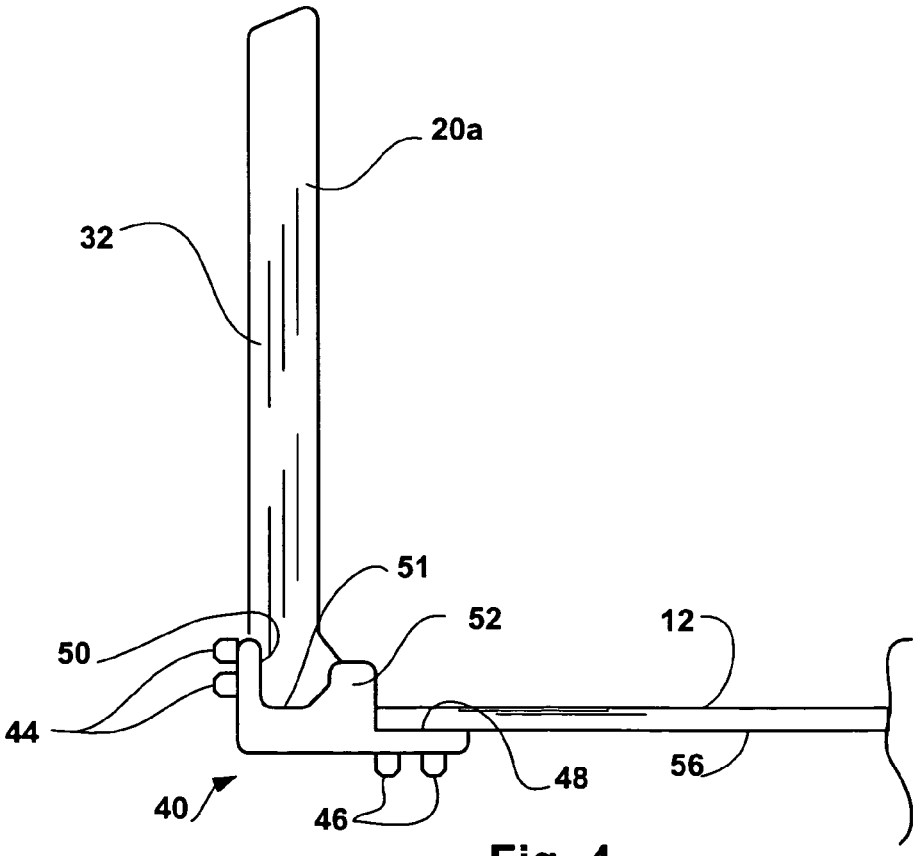
FIG. 4 is a side plan view of one end of the table and one of the displays illustrated in FIG. 1.

In this first exemplary embodiment display assemblies 20*a* and 20*b* are identical and therefore, in the interest of simplifying this explanation, only certain aspects of display assembly 20*a* will be described here in any detail. Referring to FIGS. 2 and 4, display assemble 20*a* includes a flat panel housing structure 32 and a display screen 34 mounted within the housing structure 32. Display assembly 20*a* may be hooked up to any type of driving system including one or more computers, a television or cable receiver, video conferencing equipment, etc. Hereinafter, unless indicated otherwise, it will be assumed that conference attendees use laptop computers 13, 15, etc., to control information presented via displays 20*a* and 20*b*.

As shown in FIG. 2, display screen 34 has a width dimension W and a height dimension H. Although various widths and heights are contemplated, in at least some embodiments of the present invention screen 34 will have a width W of at least two feet and a height H of at least two feet. In particularly advantageous embodiments, screen 34 has a width W of at least three feet and a height H of at least three feet. Hereinafter display assembly 20*a* and 20*b* are referred to either as assemblies 20*a* and 20*b* or simply as displays 20*a* and 20*b*.

As best illustrated in FIG. 1, table assembly 11 includes a table top member 12 that has a generally oblong leaf shape that forms first and second corners 22 and 24 at opposite ends and includes first and second edges 26 and 28 that extend between the first and second corners 22 and 24, respectively. First edge 26 includes a substantially straight section 26*a* proximate first corner 22 and a curved section 26*b* that extends from the straight section 26*a* to second corner 24, the curved section 26*a* bowing convexly outward generally away from second edge 28. Similarly, second edge 28 includes a substantially straight section 28*a* proximate second corner 24 and a curved section 28*b* that extends from the straight section 28*a* to the first corner 22 and that bows convexly outward generally away from first edge 26. In the illustrated embodiment the length dimensions of straight edge sections 26*a* and 28*a* are identical and are substantially equal to the width dimension W (see again FIG. 2) of display screen 34.

Although not illustrated, in addition to top member 12, table assembly 11 also includes some type of supporting structure therebelow to support top member 12 at a normal table top height suitable for use by conference attendees seated about the assembly 22 in chairs 14, 16, 18, etc. For instance, where the chairs are a normal sitting height, top member 12 may be between twenty-eight and thirty-one inches high. As another instance, where the chairs are of a stool height, top member 12 may be between thirty-five and forty-four inches high, depending on the stool height. The supporting structure below top member 12 may include several legs, pedestals, castered pedestals, etc.

Referring still to FIGS. 1 through 4, according to the first embodiment of the present invention, displays 20*a* and 20*b* are positioned adjacent straight edge sections 26*a* and 28*a* so that the display screens 34 face in substantially opposite directions but are offset from each other. Importantly, displays 20*a* and 20*b* are positioned directly next to edge sections 26*a* and 28*a*, respectively, and such that the lower edges of the display screens 34 reside at or just above (e.g., within 8 inches of) the top surface of table top member 12 (see specifically FIGS. 2, 3 and 4).

Referring to FIG. 4, in at least some embodiments of the present invention, a display support assembly 40 is provided that includes a bracket 42 and a plurality of bolts 44 and 46. Bracket 42 includes a horizontal member 48 and channel forming structure including two ribs or extensions 50 and 52 that extend to the same side of member 48 and substantially perpendicular thereto. Ribs 50 and 52 are shaped and dimensioned to form a channel 51 therebetween that fittingly receives a bottom end of display 20*a*. Horizontal member 48 forms a plurality of apertures that pass therethrough. Similarly, rib 50 forms a plurality of apertures (not illustrated) that pass therethrough.

To mount bracket 40 to table top 12, screws 46 are placed through the apertures formed by horizontal member 48 and are received in an undersurface 56 of table top member 12 such that rib 52 is adjacent straight edge section 26*a* and so that channel 51 formed by ribs 50 and 52 opens upwardly. To mount display 20*a* to bracket 40, display 20*a* is positioned such that the lower end thereof is received in the channel formed by ribs 50 and 52. Thereafter, bolts or screws 44 are placed through the apertures formed by rib 50 and extend into the rear surface of the bottom portion of display 20*a* to rigidly hold display 20*a* with respect to bracket 42.

Referring still to FIGS. 1 through 4, after displays 20*a* and 20*b* have been mounted proximate straight edge sections 26*a* and 28*a*, chairs 14, 16, 18, etc., are placed around the curved edge sections 26*b* and 28*b*. During conferencing activity, with attendees positioned at each one of the chairs about table top member 12, it is contemplated that when any one of the attendees is presenting information, the information being presented can be presented on both displays 20*a* and 20*b* at opposite ends of table 12. Here, because the information is displayed in a relatively large format and it is presented at the edge of the table (e.g., 26*a* or 26*b*), all the attendees in chairs 14, 16, 18, etc., have a clear and generally unobstructed view of information on at least one and, in may cases, both of displays 20*a* and 20*b*. For example, referring to FIGS. 1 through 3, for an attendee sitting in chair 14, the attendee can direct her sight along the direction indicated by field of view 60 to view information on display 20*a* or, in the alternative, can direct her sight along the field of view indicated by numeral 62 to view information presented via display 20*b*.

In addition, because of the orientation of displays 20*a* and 20*b* with respect to the seats around table 12, as conference attendees turn their chairs in various directions to angle toward other attendees during conversations, regardless of the direction in which the attendees are facing, the attendees still have a relatively good view of information being presented on at least one of displays 20*a* and 20*b*. For example, assume that the attendee in chair 16 is presenting information via displays 20*a* and 20*b* while having a conversation with the attendee in chair 14. Here, while the attendee in chair 14 directs her sight along the field of view indicated by numeral 64 when making eye contact with the presenting attendee in chair 16, the attendee in chair 14 need only slightly change her field of view as indicated by field of view 60 to view information being presented on display 20*a*. Similarly, referring still to FIG. 1, when the attendee in chair 18 is presenting information via displays 20*a* and 20*b* and is having a conversation with the attendee in chair 14, the attendee in chair 14 can direct her field of view along the direction indicated by numeral 66 to make eye contact with the presenting attendee in chair 18 and need only change her field of view slightly as indicated by field of view 62 to observe the information presented via display 20*b*. In a similar fashion, when the attendee in chair 14 is discussing information with the attendee in chair 19 just to the right of chair 14 as illustrated in FIG. 1, the attendee in chair 14 can simply divert her line of sight slightly to view information presented via display 20*b* while the attendee in chair 19 need only divert his attention slightly to view the information presented via display 20*a*.

Here, some comments regarding the advantageous positioning of displays 20*a* and 20*b* relative to top member 12 are provided. First, because people are accustomed to communicating with other people about a table, it has been recognized that obtaining information from displays positioned directly at table edges is relatively natural.

Second where the displays are adjacent and generally rise above table edges, the screens are at about the same height as conference attendees around table top member 12. Thus, when an attendee diverts her attention from another attendee to one of displays 20*a* or 20*b*, while the field of view may change slightly, the horizontal angle of view generally remains unchanged (i.e., the attendee need not redirect view up or down to change from observing another attendee to observing one of the displays 20*a* or 20*b*).

Third, because all conference attendees remain seated while displays 20*a* and 20*b* are used to share information, no one or sub-set of attendees assumes a relatively more commanding position (e.g., at the front of a room) with respect to other attendees and sharing of ideas becomes much more open.

Fourth, the curved table edges 26*b* and 28*b* enable all attendees to have a good view of both displays 20*a* and 20*b* while still allowing the table top surface to be sufficiently large for spreading out other conference information.

Fifth, the curved edges 26*b* and 28*b* are inviting for attendees and encourage attendees to gather therearound.

Sixth, attendees can view each other attendee as well as either of displays 20*a* and 20*b* without physically turning away from the space generally above top member 12.

While the advantageous lines of sight have been described above for an attendee in chair 14 as illustrated in FIG. 1, it should be appreciated that each of the attendees in each of the chairs about table top member 12 has similar advantageous lines of sight when presenting information, when viewing information presented by other attendees and when observing or making eye contact with other attendees.

Figure 3:
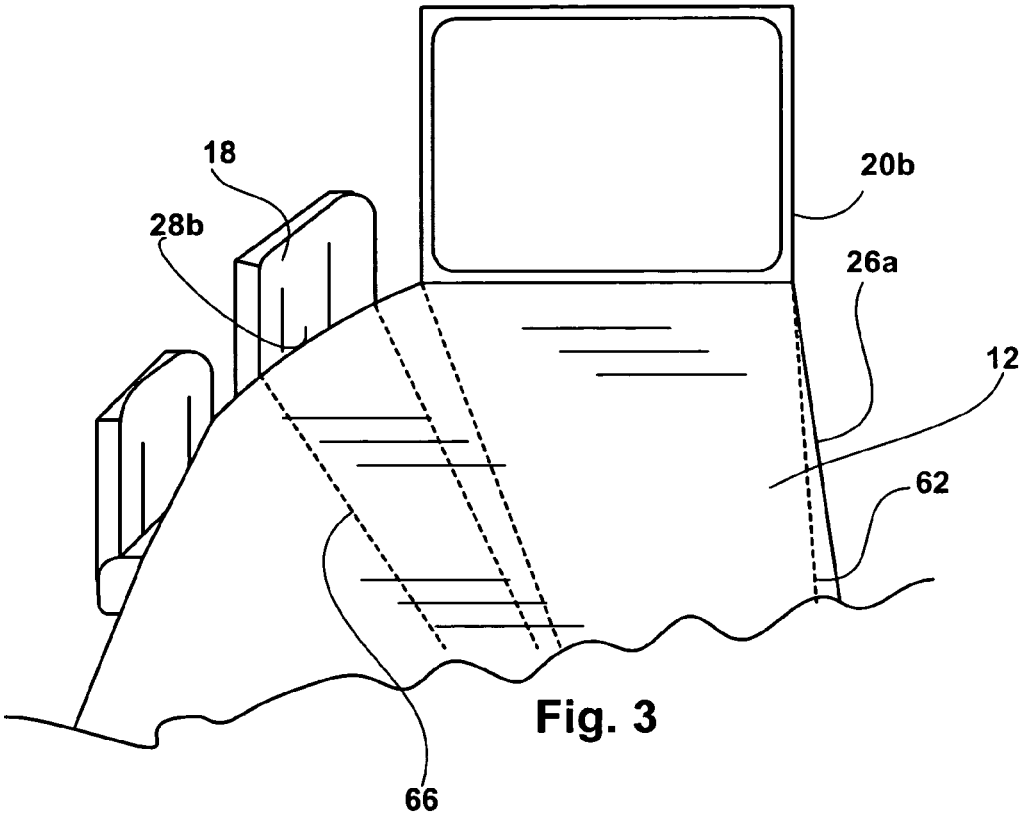
FIG. 3 is a view of a second end of the configuration illustrated in FIG. 1.
Figure 5:
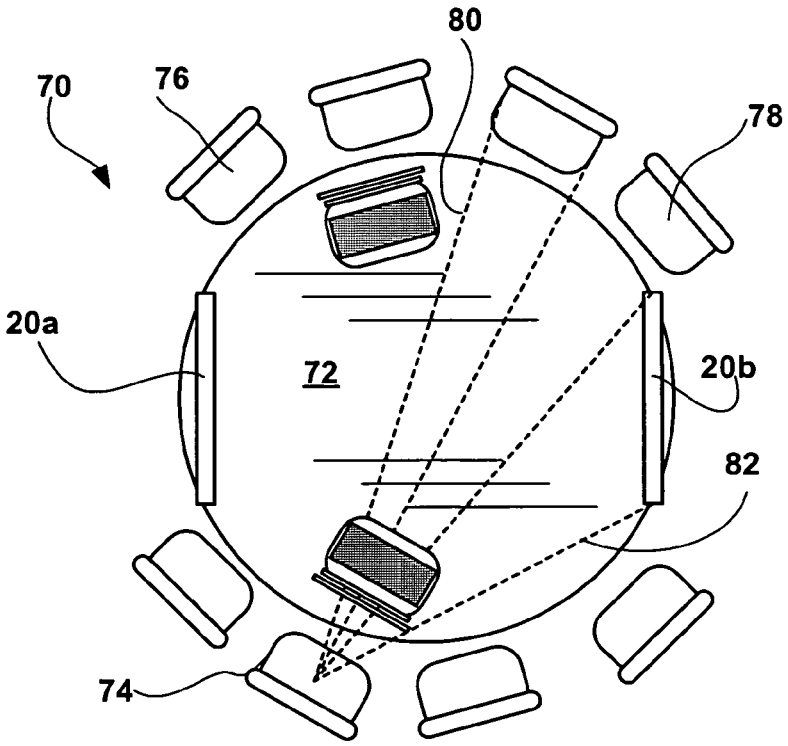
FIG. 5 is a similar to FIG. 1, albeit illustrating another conference configuration.

In addition to the advantageous table shape described with respect to FIGS. 1 through 3 above, the edge oriented screen concept is also advantageous in the context of other table top shapes. For example, referring to FIG. 5, another conferencing configuration 70 is illustrated which includes a round table top member 72, first and second displays 20*a* and 20*b* and a plurality of chairs including, among others, chairs identified by numerals 74, 76 and 78. Here, instead of mounting displays 20*a* and 20*b* adjacent the edges of round top 72, displays 20*a* and 20*b* rest on the top of table top 72 near the edges and oppose each other facing in opposite directions. Once again, conference attendees generally have clear and unobstructed lines of sight of each of displays 20*a* and 20*b*. For instance, an attendee in chair 74 can view information displayed on each of displays 20*a* and 20*b* when looking in different directions and, generally, without turning away from table top member 72. In addition, each attendee has generally clear and unobstructed lines of sight of each of the other attendees about table top member 72. Moreover, each of the attendees can make eye contact with other attendees and relatively quickly and unobstructively change their field of view to view information presented on one of the displays 20*a* or 20*b* due to the placement of the displays with respect to the attendees. For instance, the attendee in chair 74 can make eye contact with the attendee in chair 78 by directing her view along field of view 80 and, can then redirect her view slightly as indicated by field of view 82 to view information presented via display 20*b*.

Figure 6:
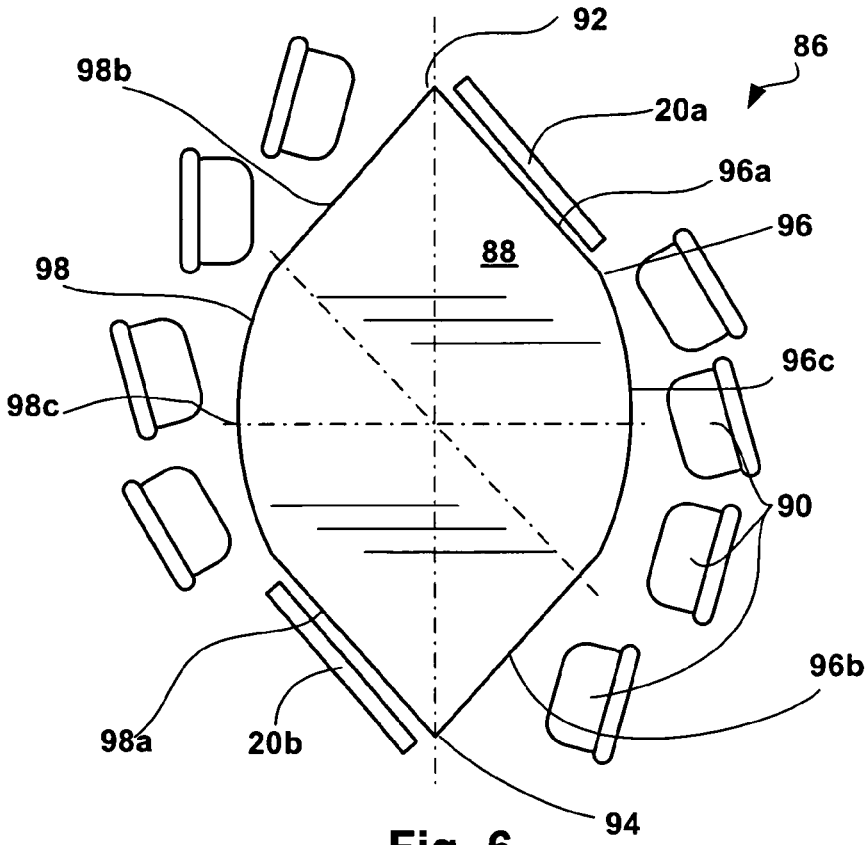
FIG. 6 is a similar to FIG. 1, albeit illustrating another conference configuration.

Another exemplary conferencing configuration 86 is illustrated in FIG. 6 that includes a symmetrical leaf shaped table top 88, first and second displays 20*a* and 20*b* and a plurality of chair, three collectively identified by numeral 90. Table top 88 includes first and second oppositely directed corners 92 and 94 and edges 96 and 98 that traverse the distance between corners 92 and 94. First edge 96 includes a first generally straight section 96*a* proximate first corner 92 and a second generally straight section 96*b* proximate second corner 94 and a curved section 96*c* between the first and second straight section 96*a* and 96*b*, respectively. Curved section 96*c* bows convexly outward and generally away from second edge 98. Similarly, second edge 98 includes a first generally straight section 98*a* proximate second corner 94, a second generally straight section 98*b* proximate first corner 92 and a curved section 98*c* that extends between the first and second straight sections 98*a* and 98*b*, respectively, and that bows generally convexly outwardly away from first edge 96.

As illustrated, displays 20*a* and 20*b* are positioned adjacent straight edge sections 96*a* and 98*a* so that they generally face in opposite directions but are slightly offset from each other. Here, as in the two conference configuration examples described above, displays 20*a* and 20*b* are positioned at a height such that the lower edges of the display screens are at or slightly above (e.g., within 8 inches) the table top height.

While only three exemplary table shapes have been described above, it should be appreciated that the present invention contemplates many other table top shapes in configurations where at least two display screen are positioned at or slightly above the table top height and adjacent or proximate the edges of the table tops. For instance, other shapes may include a square, a rectangle, an oval, etc.

Figure 7:
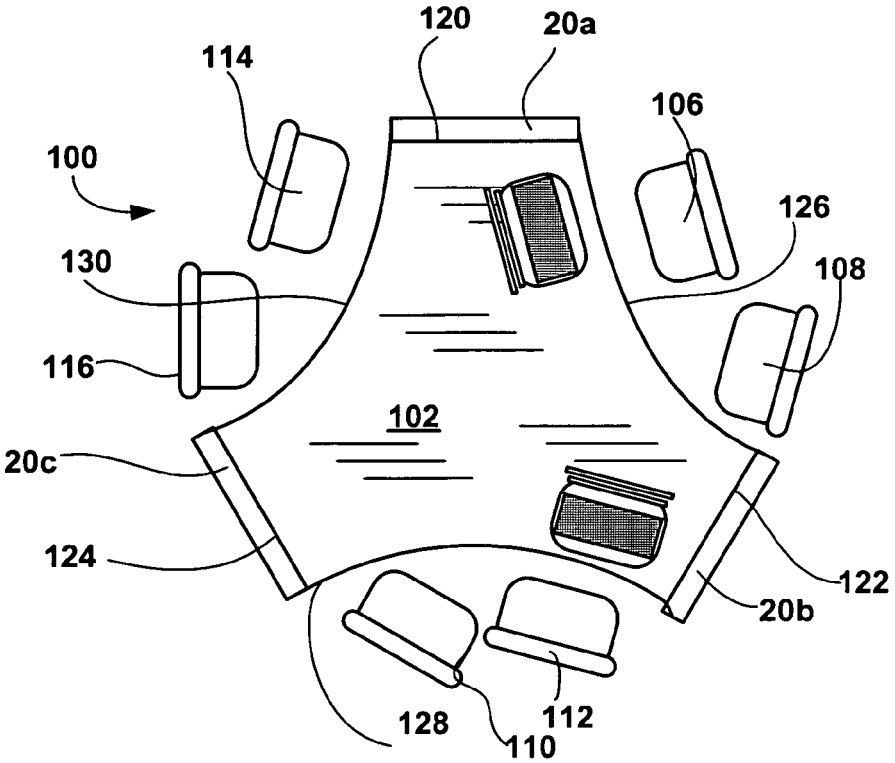
FIG. 7 is a similar to FIG. 1, albeit illustrating a conference configuration including three display screens.

In addition to contemplating conferencing configurations including two displays positioned adjacent generally opposite table top edges, other configurations are contemplated that include three, four, or more display screens positioned adjacent table edges. To this end, one other exemplary conferencing configuration 100 is illustrated in FIG. 7 that includes a table top member 102, first, second and third flat panel display screens 20*a*, 20*b* and 20*c* and a plurality of chairs 106, 108, 110, 112, 114 and 116. Here, table top member 102 includes three generally straight edges 120, 122 and 124 that form 120° angles with respect to each other and also includes three curved edges 126, 128 and 130, a separate curved edge between each two adjacent straight edge sections. Each curved edge is concave inward bowing generally toward the other two curved edges as illustrated.

Displays 20*a*, 20*b* and 20*c* are positioned adjacent straight edge sections 120, 122 and 124, respectively, such that the display screens included therewith face toward top 102, are perpendicular to top 102 and have lower edges that generally reside slightly above or adjacent top 102. In the illustrated configurations, two chairs are positioned adjacent each curved edge 126, 128 and 130. For example, chairs 106 and 108 are adjacent curved edge 126.

Referring still to FIG. 7, assume a conference attendee in chair 106 is presenting information via displays 20*a*, 20*b* and 20*c* while talking directly to an attendee in chair 110. Here, the presenting attendee in chair 106 can make direct eye contact with the attendee in chair 110 and, to view one of the displays, can redirect her line of sight easily and quickly toward display 20*c*. Similarly, as the attendee in chair 110 converses with the attendee in chair 106 and makes eye contact, the attendee in chair 110 can quickly and easily modify his line of sight to view displayed information on display 20*a*. While the attendees in chairs 106 and 110 converse about displayed information, the attendee in chair 112 can either observe information on display 20*a* while generally listening to the attendee in chair 106 or can observe information on display 20*c* while generally facing the attendee in chair 110. Similarly, the attendee in chair 108 can observe displayed information on either of displays 20*a* or 20*c* or, if desired, on display 20*b*, while the attendees in chairs 114 and 116 can observe displayed information on display 20*a* when the attendee in chair 106 is talking or on display 20*c* when the attendee in chair 110 is talking.

Figure 8:
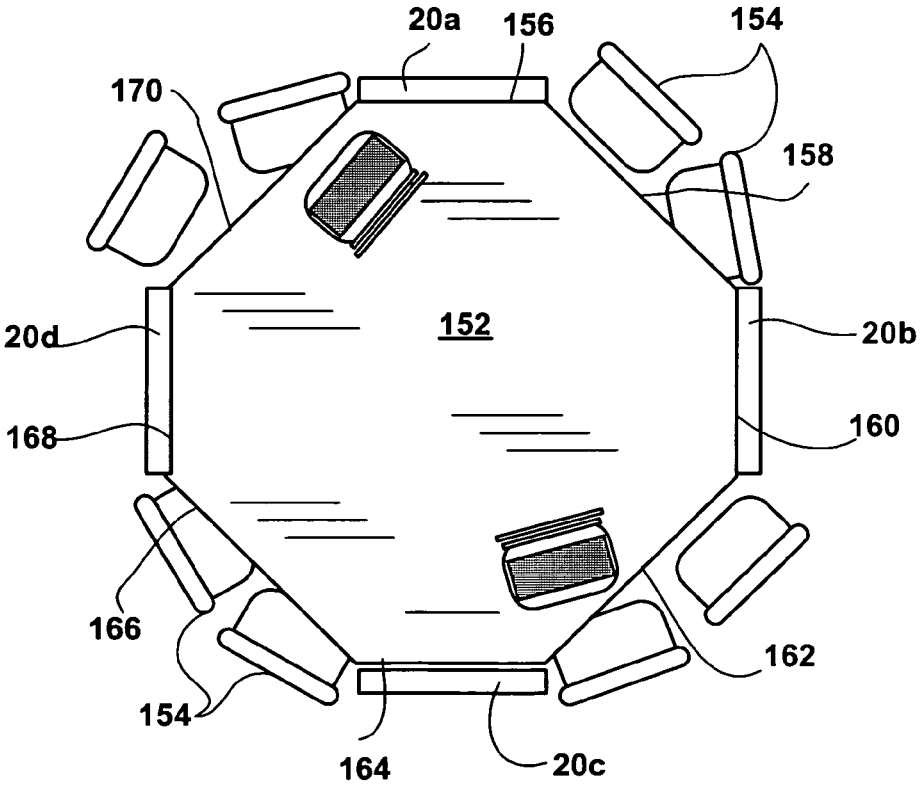
FIG. 8 is a similar to FIG. 1, albeit illustrating a conference configuration including four display screens.

Referring now to FIG. 8, an exemplary conferencing configuration 150 is illustrated that includes a table top member 152, four displays 20*a*, 20*b*, 20*c* and 20*d* and a plurality of chairs, four chair collectively identified by numeral 154. In this embodiment, top 152 is generally octagonal including eight substantially straight side edge sections 156, 158, 160, 162, 164, 166, 168 and 170. Four of the side edges 156, 160, 164 and 168 have identical length dimensions where the length dimensions are substantially similar to the width dimensions W (see again FIG. 2) of one of the screens 34 of one of the displays (e.g., 20*a*). The other four side edges 158, 162, 166 and 170 have identical length dimensions that are longer than the screen width dimension W. As illustrated in FIG. 8, a separate one of the displays 20*a*, 20*b*, 20*c* and 20*d* is positioned adjacent each of edges 156, 160, 164 and 168 with the display screens facing opposite edges of table top member 152. Here again, as in the previously described conferencing configurations, conference attendees in chairs 154 have generally clear and unobstructed views of other attendees as well as of information presented via at least one and, in many cases, two or more of the displays 20*a*, 20*b*, 20*c* and 20*d*.

While edge mounted brackets like the one described with respect to FIG. 4 may be used in at least some embodiments for supporting displays adjacent table edges, other supporting assemblies are contemplated. For instance, while not illustrated, it is contemplated that a simple display stand may be provided that resides adjacent a table top edge to support a display screen thereabove. In addition, in at least some embodiments, it is contemplated that support assemblies may be provided to facilitate movement of display screens with respect to table edges so that, while displays may be easily positioned adjacent table edges as described above at times, at other times, the displays can be moved away from the table edges to be used in a different fashion or to be stored. For example, referring now to FIG. 9, in at least some embodiments, it is contemplated that a cart 180 may be provided for moving displays like display 20*a* within a conferencing room or the like and, more specifically, toward and away from a table edge 182 so that the display can be used as described above to facilitate information sharing around a conference table top or can be moved to another location for another purpose.

Cart 180 includes, among other things, a base 184, wheels or casters collectively identified by numeral 186 and a supporting flat planar member 188. Base 184 is generally boxed shaped including four bottom corners. A separate wheel or caster 186 is mounted proximate each of the bottom corners of base 184 to support base 184 thereabove for movement along a floor below. Planar member 188 is mounted to the top of base 184 and forms a generally flat and horizontal surface 190. Planar member 188 includes, among other edges, a flat edge 192. The combined height of base member 184, wheels 186 and top member 188 is similar to the height of a table top surface 200 with which the cart assembly is to be used. Display 20*a* is placed on top surface 190 and can be moved toward and away from table edge 182 as indicated by arrow 202.

Figure 10:
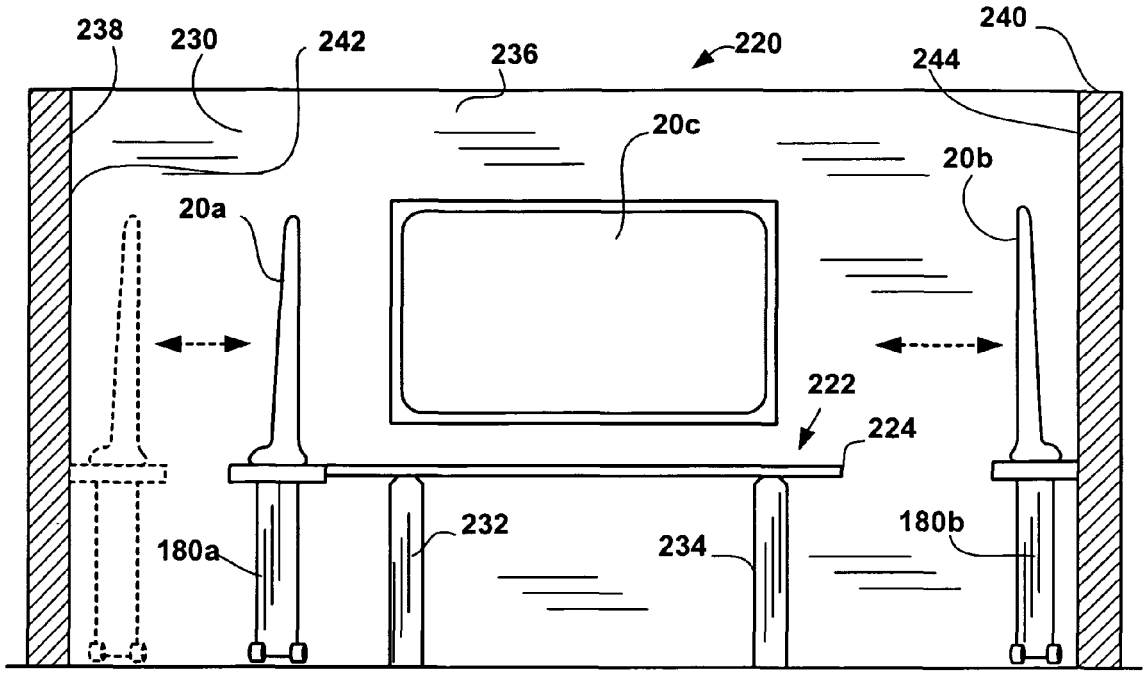
FIG. 10 is a side elevational view illustrating one additional conference configuration according to at least some aspects of the present invention.

Referring now to FIG. 10, a conferencing configuration 220 including a table assembly 222, two flat panel displays 20*a* and 20*b* and two moveable carts 180*a* and 180*b* located within a conference space 230 is illustrated. Conference space 230 includes a back wall 236 and first and second generally parallel lateral walls 238 and 240 that are spaced apart by back wall 236. Each of the lateral walls 238 and 240 forms a lateral wall surface 242 and 244, respectively. In the illustrated configuration, table 222 is positioned mid-way between lateral wall surfaces 242 and 244 and includes two leg or pedestal structures 232 and 234 and a top member 224. Pedestals 232 and 234 support top member 224 thereabove at a table top height suitable for use with chairs (not illustrated). Top member 224 includes first and second oppositely facing straight edges 226 and 228 that face lateral wall surfaces 244 and 242, respectively. In a configuration consistent with the examples above and as illustrated in FIG. 10, carts 180*a* and 180*b* can be used to move displays 20*a* and 20*b* to positions adjacent edges 228 and 226 for particularly advantageous sharing of information. At other times, carts 180*a* and 180*b* can be used to move displays 20*a* and 20*b* away from edges 228 and 226 and generally against lateral wall surfaces 242 and 244, respectively, so that table 222 can be used in a different fashion or so that displays 20*a* and/or 20*b* can be used in a different fashion (e.g., to facilitate smaller break-out or side-bar sessions proximate lateral walls 238 and 240.

Referring now to FIGS. 11 through 14, another exemplary conferencing configuration 250 is illustrated that includes a screen supporting assembly that facilitates screen movement within a conferencing space. To this end, configuration 250 includes a table assembly 252, first and second displays 20*a* and 20*b*, a plurality of chairs, two collectively identified by numeral 254, a rail assembly 256 and first and second supporting arm assemblies 258*a* and 258*b*.

Rail assembly 256 includes first and second posts 260 and 262 and a rail 270. Each of posts 260 and 262 is substantially similar and therefore, in the interest of simplifying this explanation, only post 260 will be described here in any detail. Post 260 is an elongated rigid member including opposite top and bottom ends 266 and 264, respectively. Post 260 has a length dimension such that, when rail 270 is attached to the top thereof and perpendicular thereto, a person of ordinary height can easily walk below rail 256 without concern for head clearance. Posts 260 and 262 are mounted to a floor structure 265 on opposite sides of a conference space 271 therebetween and such that the posts 260 and 262 are substantially vertically oriented with top ends 266 at similar heights.

Figure 12:
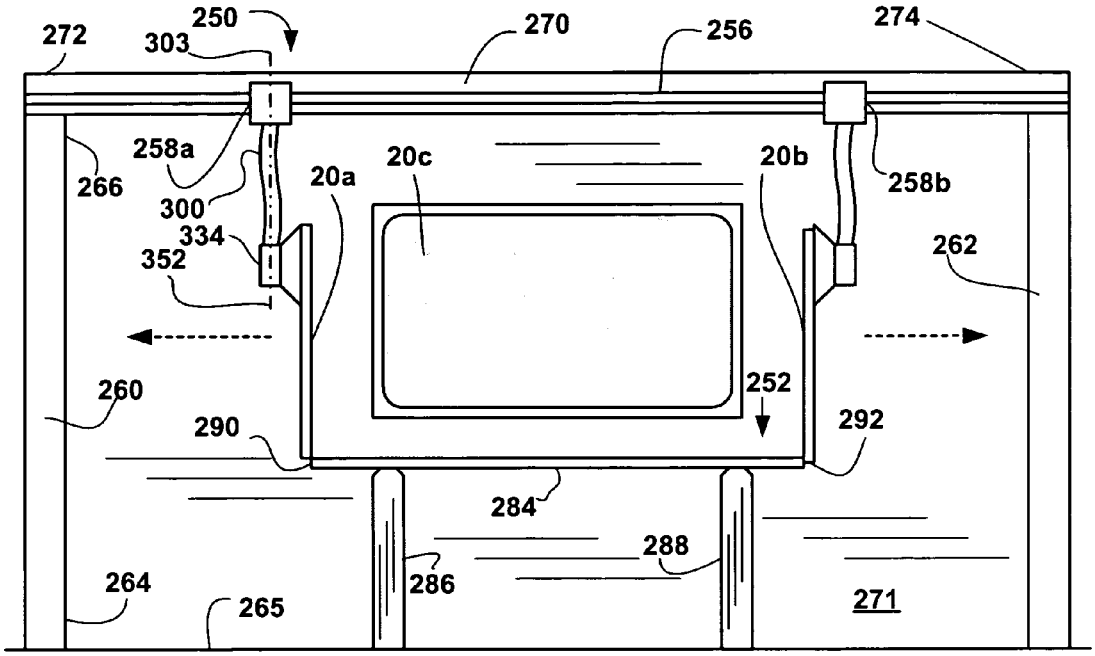
FIG. 12 is a side elevational view of the configuration of FIG. 11.
Figure 13:
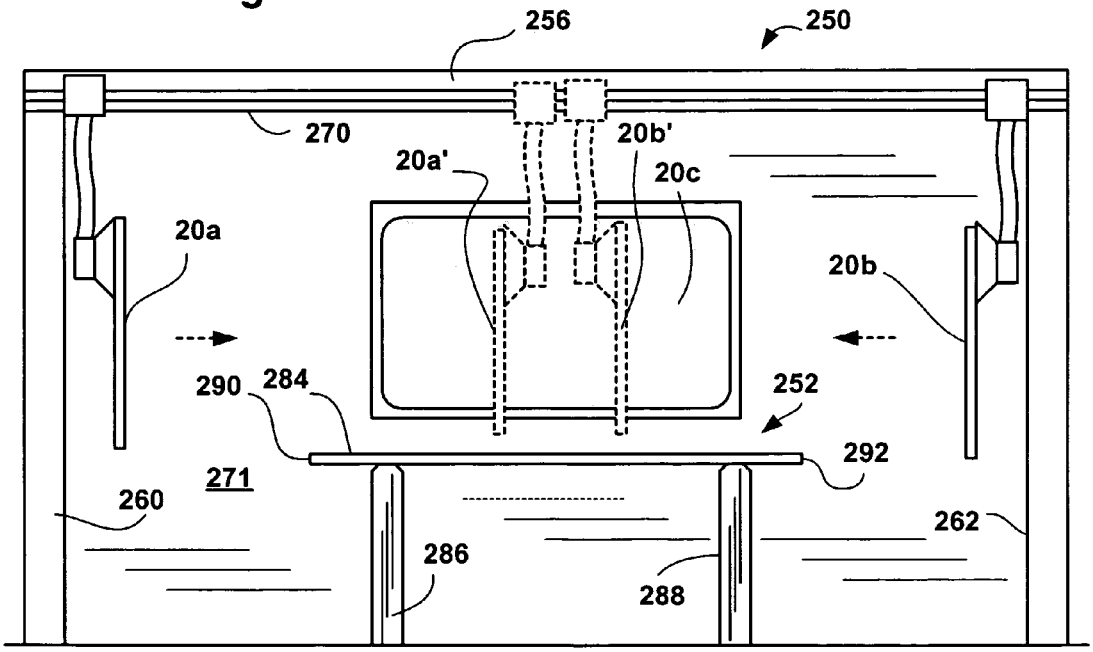
FIG. 13 is a side elevational view similar to FIG. 12, albeit where displays are in different positions.
Figure 14:
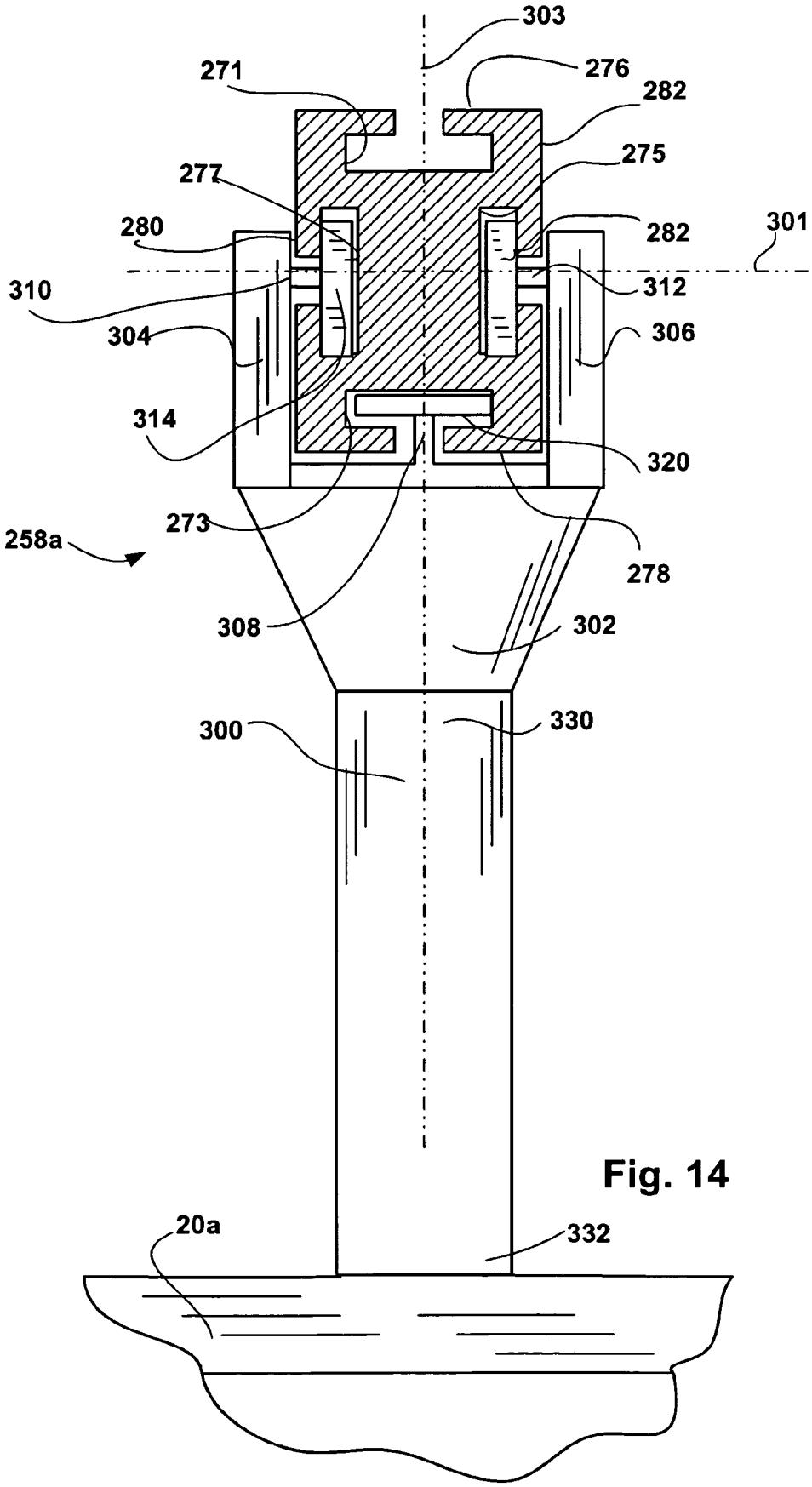
FIG. 14 is a partial cross-sectional view taken along the line 14-14 in FIG. 11.

Referring still to FIGS. 11 through 14, rail 270 is an elongated rigid member including first and second ends 272 and 274 that are mounted to the top ends (e.g., 266 in FIG. 12) of posts 260 and 262 and traverses the distance therebetween. Any type of mechanical mounting structure known may be used to mount rail member 270 to posts 260 and 262. Referring specifically to FIG. 14, rail 270 has a generally rectilinear cross-section including parallel top and bottom side surfaces 276 and 278 and parallel lateral side surfaces 280 and 282. Rail 270 forms separate T-slots 271, 273, 275 and 277 in each of side surfaces 276, 278, 280 and 282, respectively, and generally along the entire length of the rail.

Referring again to FIGS. 11 through 13, table assembly 252 includes an oval shaped top member 284 and first and second pedestal or leg structures 286 and 288. Pedestals 286 and 288 rest on floor structure 265 and support top member 284 thereabove at a table top height suitable for use with chairs 254. Top member 284 includes first and second oppositely facing ends 290 and 292, respectively. In the illustrated configuration, table assembly 252 is positioned centrally between posts 260 and 262.

Referring to FIG. 12, each of support arm assemblies 258*a* and 258*b* is identical and therefore, in the interest of simplifying this explanation, only assembly 258*a* will be described here in any detail. Referring also to FIG. 14, assembly 258*a* includes a glide assembly 298 and an extension arm 300. Glide assembly 298 includes a base member 302 and first and second rigid lateral members 304 and 306 that extend upward from the base member 302. Lateral members 304 and 306 are separated by a space dimension slightly greater than the width of rail member 270 between surfaces 280 and 282. An axel 310 extends from member 304 toward member 306 and a roller wheel 314 is mounted thereto for rotation about a horizontal axis 301. Similarly, an axel 312 extends from member 306 toward member 304 and a roller wheel 316 is mounted thereto for rotation about horizontal axis 301. Wheels 314 and 316 are dimensioned to be receivable with clearance within T-slots 277 and 275. A third axel 308 extends upward from base member 302 between members 304 and 306 and a third roller wheel 320 is mounted thereto for rotation about a vertical axis 303 that is perpendicular to axis 301. Wheel 320 is dimensioned to be received in T-slot 273 with clearance.

Arm 300 is an elongated rigid member that includes a top end 330 and a bottom end 332. In at least some embodiments, top end 330 is rigidly mounted to base member 302 and bottom end 332 is rigidly mounted to a bracket 334 (see again FIG. 12) that is in turn mounted to a rear surface of display 20*a*.

Referring once again to FIGS. 12 and 14, support arm assembly 258*a* is mounted to rail member 270 by positioning roller wheels 314, 316 and 320 in T-slots 277, 275 and 273, respectively. Here, rollers 314 and 316 rest on upward facing surfaces of lateral T-slots 277 and 275 to hold the arm assembly 258*a* and display 20*a* attached thereto in a suspended fashion. Third roller wheel 320 contacts one of the lateral surfaces of bottom T-slot 273 to reduce lateral sway of arm assembly 258*a* and display 20*a* attached thereto.

Figure 11:
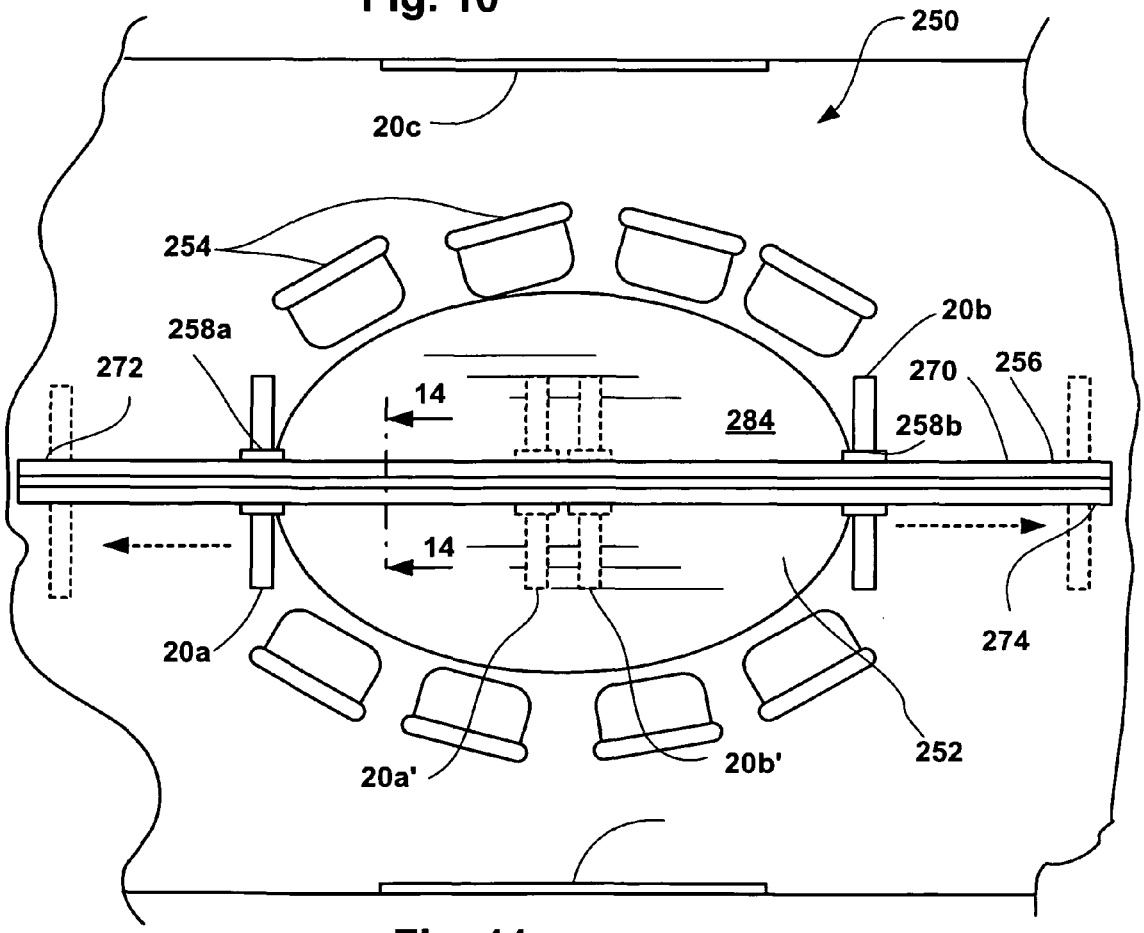
FIG. 11 is a top plan view of another conference configuration according to at least some aspects of the present invention.

With the arm assembly 258*a* supporting display 20*a* as described above, it should be appreciated that arm assembly 258*a* and the attached display can be moved along the length of rail member 270 and, more specifically, can be moved between a first in-use position adjacent a table edge as illustrated in FIGS. 11 and 12 and a second storage or in-use position as illustrated in FIG. 13 where the display 20*a* is adjacent beam 260. Similarly, arm 258*b* and attached display 20*b* can be moved between first and second in-use positions as indicated in FIGS. 12 and 13, respectively.

Where displays 20*a* and 20*b* are mounted to an overhead rail 270, in at least some cases the lower ends of the displays 20*a* and 20*b* may reside just above the table top member 284 so that the displays 20*a* and 20*b* can be moved to supported locations above the table top member 284 while in other cases the lower ends of displays 20*a* and 20*b* may be slightly below top member 284.

According to another aspect of the present invention, it has been recognized that, while it is advantageous to have two or more displays positioned at the edges of a table top that face in generally opposite directions to facilitate information sharing, in at least some embodiments, it is also advantageous to have additional background displays that are viewable by conference attendees for posting background information or information that is important but not the immediate focus of the conference attendees. To this end, in at least some cases, it is contemplated that background display assemblies or screens may be placed "off axis" from displays positioned at table edges. For instance, referring again to FIG. 11, where displays 20*a* and 20*b* have been positioned at opposite ends of table assembly 252, additional larger displays 20*c* and 20*d* may be mounted or supported at locations spaced from the table edge, generally between displays 20*a* and 20*b* and parallel to rail member 270. Here, when appropriate, information presented on display 20*c* can be viewed by conference attendees on a side of table assembly 252 opposite display 20*c* while information presented via display 20*d* maybe viewed by attendees on a side of assembly 252 opposite display 20*d*.

While the off-axis displays have been described here with respect to the embodiment including posts 260 and 262 and rail 270 as illustrated in FIGS. 11 through 13, it should be appreciated that the off-axis displays maybe used in any of the inventive embodiments described throughout this specification including embodiments where brackets mount edge displays directly to table edges, embodiments where carts are used to move displays or to support displays with respect to table edges, etc. In this regard, off-axis displays are shown in various other illustrated and described configurations (e.g., see display 20*c* in FIG. 10, displays 20*c* and 20*d* in FIG. 21, displays 20*c* and 20*d* in FIG. 20, etc.)

According to one additional aspect to the present invention, where displays and, in particular, flat panel displays, are mounted or supported for movement within a conference space, it has been recognized that the display or displays can be used to facilitate break-out sessions within the larger conference space by acting as display screens dedicated to smaller spaces within the larger space and, in at least some cases, also acting or operating as physical barriers within the larger space to, in effect, cordon off smaller spaces used by smaller groups of attendees. For example, in at least some cases, it is contemplated that, referring once again to FIG. 14, extension member 300 may be rotationally mounted to base member 302 and/or, display 20*a* may be rotationally mounted to extension member 300 to facilitate rotation of display 20*a* about a substantially vertical support axis 350. Although not illustrated, any type of mechanical structure may be provided between base member 302 and arm 300 and/or between arm 300 and the bracket 334 mounted to the rear of display 20*a* to facilitate relative rotation.

Here, as illustrated in FIGS. 11 and 13, display 20*a* can be rotated about support axis 350 (see FIG. 14) so that, instead of facing post 262, display 20*a* faces post 260. Thereafter, display 20*a* can be moved into the location shown in phantom and indicated by label 20*a*', generally above table top 284. Similarly, display 20*b* can be rotated so that display 20*b* faces post 262 instead of post 260 and then display 20*b* can be moved along rail member 270 until display 20*b* is in the position indicated by label 20*b*' generally above the mid-section of table top member 284. With the displays positioned as indicated above, as best seen in FIG. 11, conference attendees to the left of display 20*a*' as illustrated can use display 20*a*' to facilitate a break-out session at the left end of table assembly 252. Similarly, attendees to the right of display 20*b*' as illustrated can use display 20*b*' to facilitate a break-out session at the right end of table assembly 252 as illustrated. In this case, displays 20*a*' and 20*b*' operate as a physical barrier between the break-out sessions that take place at opposite ends of table assembly 252.

Although not illustrated, as another alternative, referring once again to FIG. 11, display 20*a*' may be rotated 90° so that display 20*a*' faces off axis display 20*c* and generally faces the top half of table assembly 252. Similarly, display 20*b*' can be rotated 90° so that display 20*b*' generally faces off axis display 20*d* and the bottom half of table assembly 252 and can be slid along rail 270 until an edge of display 20*b*' is adjacent a proximate edge of display 20*a*'. In this case, the displays operate as a barrier between the top and bottom halves of table assembly 252 and can be separately used by attendees adjacent the top and bottom halves of table assembly 252 to facilitate break-out sessions.

Instead of providing linear beam or rail members as illustrated in FIGS. 11 through 13, in at least some inventive embodiments, it is contemplated that non-linear rail member may be employed that allow movement of displays to advantageous positions within a conference space thereby facilitating relatively large conference sessions and smaller break-out sessions. For instance, referring now to FIGS. 15 through 17, yet another inventive conferencing configuration 360 is illustrated that includes a table assembly 362, three circular rail members 364, 366 and 368, six display assemblies 370, 372, 374, 376, 378 and 380 and six chairs 382, 384, 386, 388, 390 and 392. Although not illustrated, table assembly 362 includes pedestals or leg structures below a top member 394 for supporting the top member 394 a generally horizontal orientation and posts akin to the posts illustrated in FIGS. 11 through 13 are provided to support rail members 364, 366 and 368 overhead (e.g., at a height similar to the height illustrated in FIGS. 11 through 13).

Table top member 394 has a generally triangular shape with the corners rounded off substantially. Circular rail members 364, 366 and 368 are supported above table top 394 with one of the rail members having an outer rail section that is generally above each of the rounded table top 394 corners. The chairs (e.g., 382, 384, etc.) are positioned along straight edge sections of table top 394.

Figure 17:
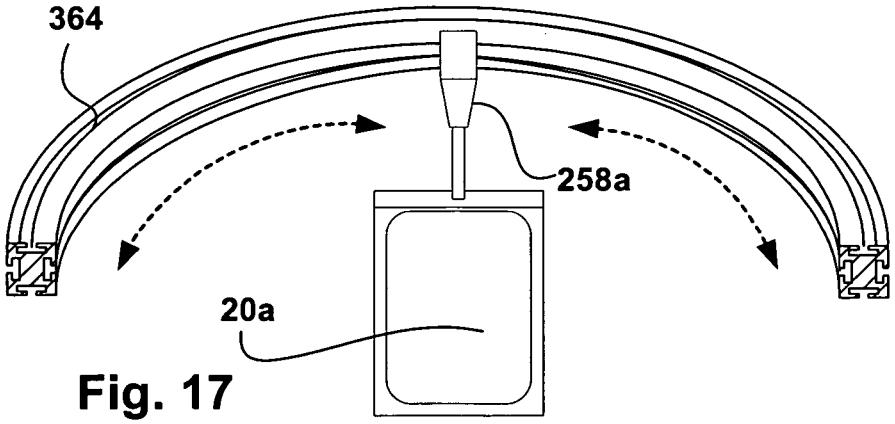
FIG. 17 is a cross-sectional view taken along the line 17-17 in FIG. 15, albeit showing a single flat panel display mounted to a rail member.

Referring to FIG. 17, exemplary rail member 364 includes a circular rail section that has a cross-section having features similar to the features described above with respect to FIG. 14. More specifically, rail member 364 forms lateral and top and bottom T-slots along the entire length thereof. Each display assembly (e.g., 370, 372, etc.) includes a display and a mounting arm assembly similar to the assembly illustrated in FIG. 14 except that, in this case, the display 20*a* is mounted so as to be parallel to the rail to which the supporting arm assembly is mounted (i.e., display 20*a* is rotated 90° about support axis 303 as illustrated in FIG. 14). Here, display assemblies 370 and 372 are mounted to rail member 364 so that the displays 370 and 372 face opposite portions of member 364. Similarly, displays 374 and 376 are mounted to rail member 366 so that displays 374 and 376 face opposite portions of rail member 366 and display assemblies 378 and 380 are mounted to rail member 368 so that displays 378 and 380 face opposite portions of rail member 368.

Figure 15:
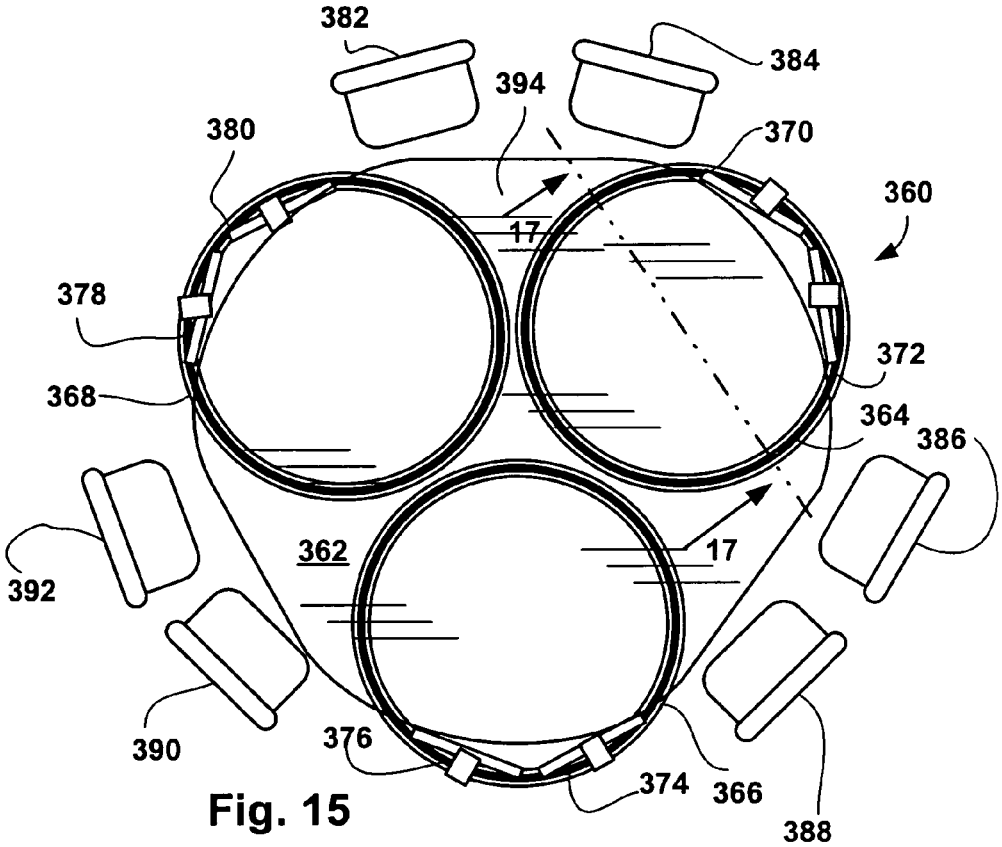
FIG. 15 is a top plan view of another conference configuration according to at least some aspects of the present invention.

With the configuration components assembled as described above, in at least one useful configuration, all of display assemblies 370, 372, 374, 376, 378 and 380 are rotated about associated rail members 364, 366 and 368 such that the displays are adjacent rounded edges of table top member 394 and generally face opposite straight sections of table top member 394 as best illustrated in FIG. 15. In this relative orientation, configuration 360 is particularly useful for sharing of information between all six conference attendees located in chairs 382, 384, 386, 388, 390 and 392. Here, it should be appreciated that attendees in chairs 382 and 384 have easy viewing of the displays associated with assemblies 374 and 376, attendees in chairs 390 and 392 have easy viewing of the displays associated with assemblies 370 and 372 and attendees in chairs 386 and 388 have easy viewing of information presented via the displays associated with assemblies 378 and 380.

Figure 16:
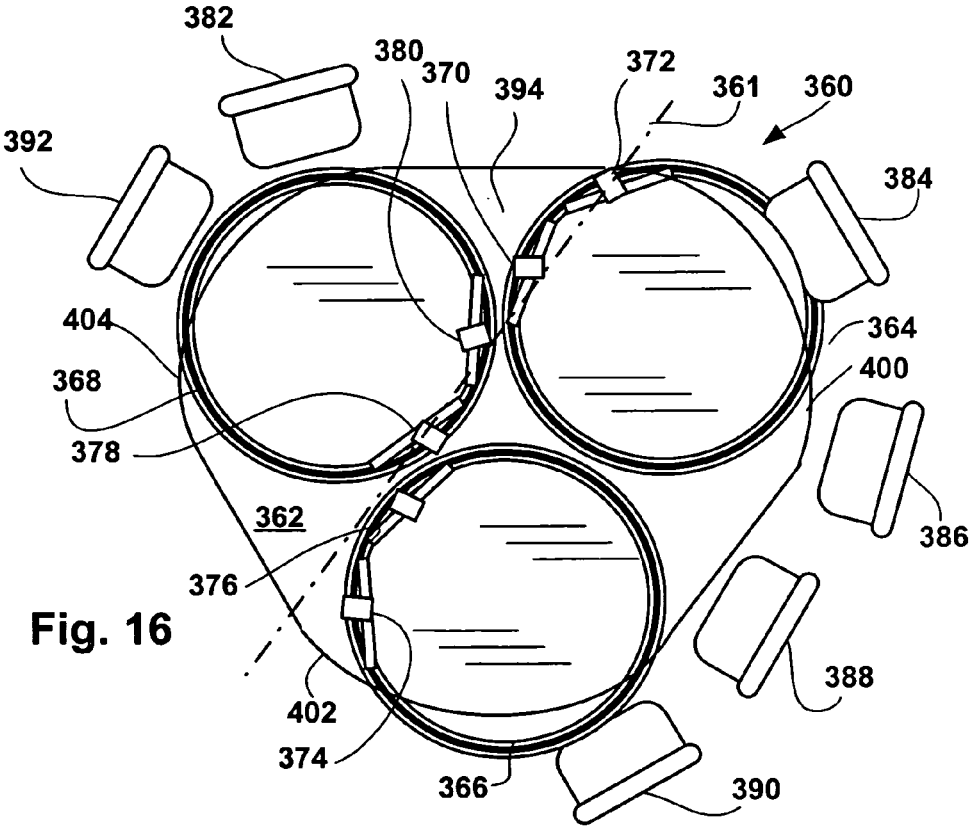
FIG. 16 is similar to FIG. 15, albeit illustrating displays and chairs in different orientations with respect to other configuration components.

Referring to FIG. 16, to facilitate one relatively small break-out session for two conference attendees and a second relatively larger break-out session for four conference attendees, the display assemblies 370, 372, 374, 376, 378 and 380 can be slid along rail members 364, 366 and 368 to positions generally above table top member 394 so that displays associated with assemblies 378 and 380 generally face one rounded edge of top member 394 while displays associated with assemblies 370, 372, 374 and 376 generally face in a direction opposite the direction of the displays associated with assemblies 378 and 380 and generally toward one of the straight edges 398 of table top member 394. Here, chairs 382 and 392 can be moved to positions that facilitate easy viewing of the displays associated with assemblies 378 and 380 while chairs 384, 386, 388 and 390 are moved to locations that facilitate easy viewing of the displays associated with assemblies 370, 372, 374 and 376. It should be appreciated that, when configured as illustrated in FIG. 16, the display assemblies (e.g., 370, 372, etc.) form a barrier between different sections of table top member 394 generally along the line labeled 361.

Although not illustrated in neither of FIG. 15 or 16, the components of configuration 360 may be reoriented to facilitate three relatively small break-out sessions by simply moving display assemblies 370 and 372 about rail member 364 so that they generally face rounded edge 400 and moving assemblies 374 and 376 about rail member 366 so that displays associated therewith generally face rounded edge 402. Here, three separate break-out sessions can be facilitated, each break-out session adjacent a different one of the rounded edges 400, 402 and 404.

Figure 16A:
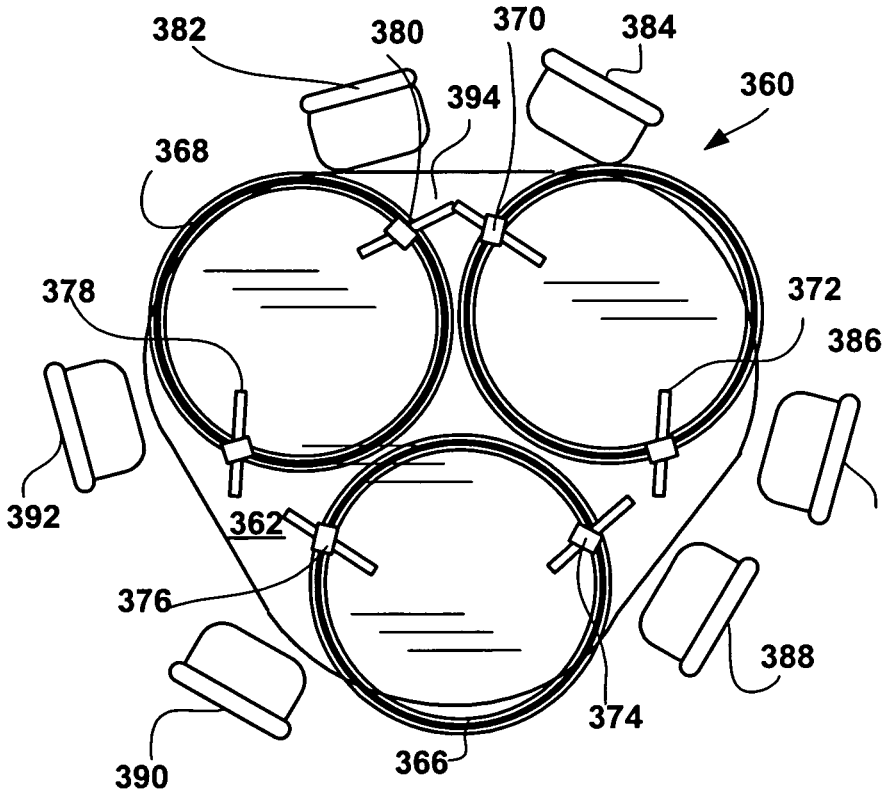
FIG. 16A is similar to FIG. 16, albeit illustrating displays and chairs in another orientation.

In addition, where the displays associated with assemblies 370, 372, 374, 376, 378 and 380 are mounted for rotation about a vertical axis as described above with respect to FIGS. 13 and 14, in at least some cases, each display assembly 370, 372, 374, 376, 378 and 380 may be used separately for individual processing by arranging the displays appropriately on rail members 364, 366 and 368. For instance, in FIG. 16A, assemblies 370, 372, 374, 376, 378 and 380 are arranged in one configuration to enable individual work by the attendees in the chairs (e.g., 382, 384, etc.) as arranged.

Figure 18:
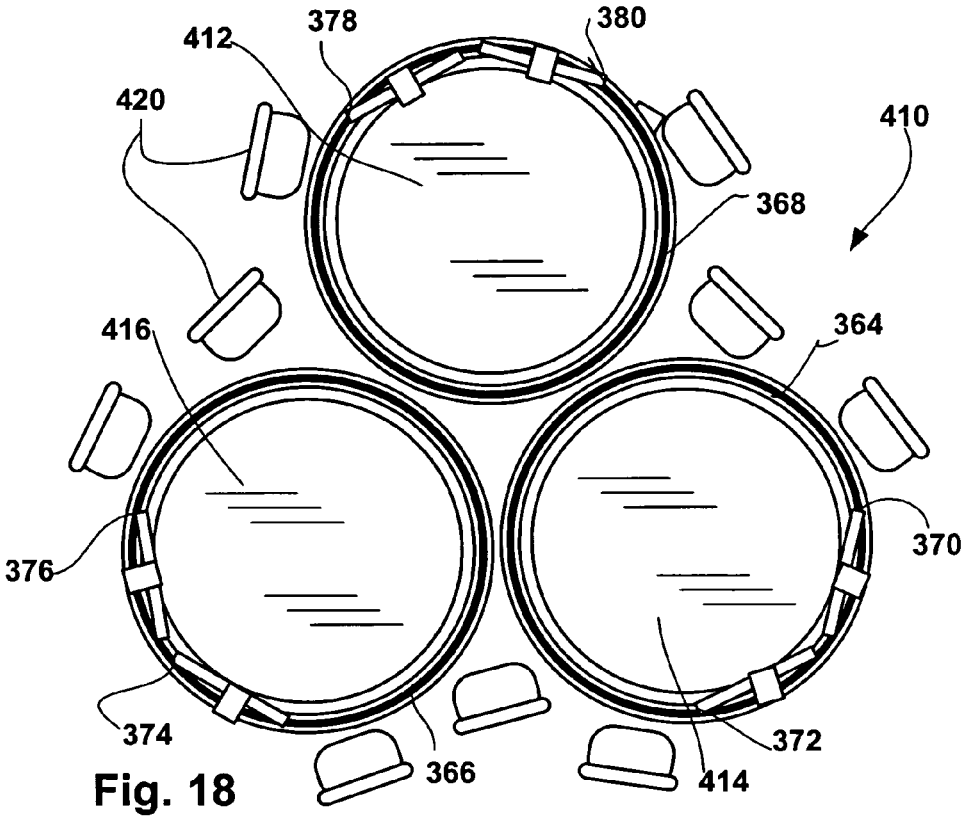
FIG. 18 is a top plan view of yet another conference configuration according to at least some aspects of the present invention.
Figure 19:
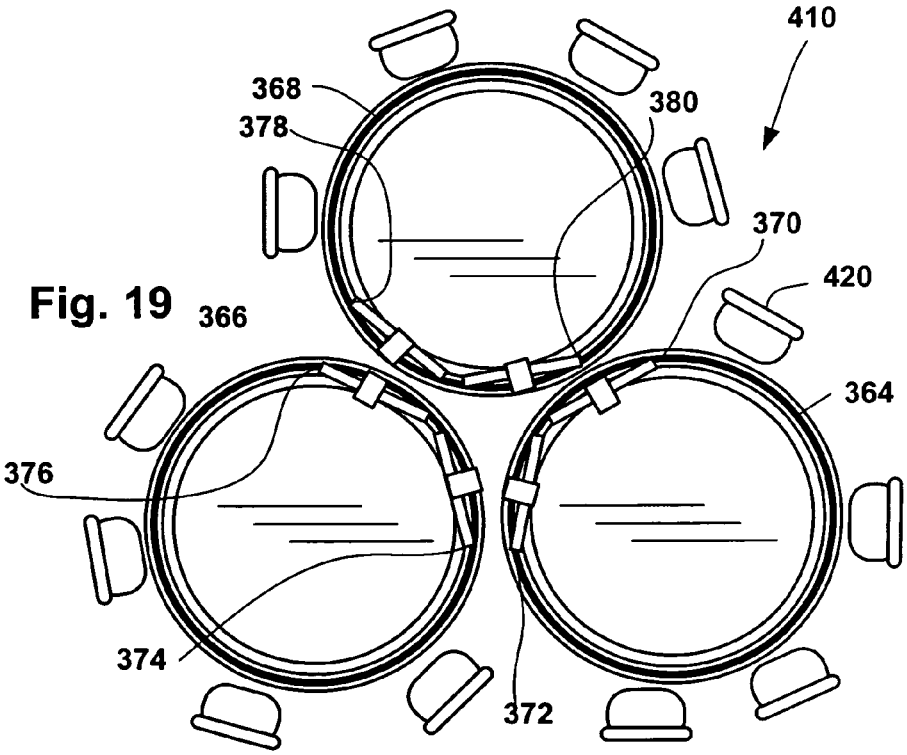
FIG. 19 is similar to FIG. 18, albeit illustrating displays in different positions with respect to rail members.

Referring now to FIGS. 18 and 19, yet another exemplary conference configuration 410 is illustrated that is similar to the conference configuration 360 in FIGS. 15 and 16. The main difference between configuration 410 and configuration 360 is that, instead of including a generally triangular shaped table top member 394, configuration 410 includes three round table top members 412, 414 and 416 that generally have the same shapes as the round shapes defined by rail members 364, 366 and 368. Here, table tops 412, 414 and 416 are arranged such that edges are adjacent each other and so as to form a generally triangular table configuration. Rail members 364, 366 and 368 are mounted above tops 414, 416 and 412 so as to, in general, circumscribe the table top edges when viewed from above.

Display assemblies 370, 372, 374, 376, 378 and 380 are mounted to rail members 364, 366 and 368 for sliding movement therealong in the same manner described above with respect to FIGS. 15 and 16. Chairs, two identified collectively by numeral 420, are provided along the edges of table top members 412, 414 and 416 for conference attendees.

As illustrated in FIG. 18, display assemblies 370, 372, 374, 376, 378 and 380 can be moved along rail members 364, 366 and 368 to positions such that the display assemblies each generally face the two rail members that the display assemblies are not mounted to. For instance, display assemblies 370 and 372 can be moved to positions such that assembly 370 generally faces rail member 366 and assembly 372 generally faces rail member 368. With the display assemblies positioned as described above, a relatively large conference can be facilitated with attendees using each of table top members 412, 414 and 416.

Referring to FIG. 19, to facilitate three small break-out sessions, display assemblies 370, 372, 374, 376, 378 and 380 can be moved along rail members 364, 366 and 368 to positions wherein the displays associated with the display assemblies generally face away from rail members that the display assemblies are not mounted to. When so positioned, the configuration chairs (e.g., 420) can be repositioned about the table top edges so that smaller groups of attendees can use separate and dedicated pairs of the display assemblies to share information. Once again it should be appreciated that when the display assemblies 370, 372, 374, 376, 378 and 380 are positioned to facilitate small break-out sessions, in addition to providing display screens for smaller groups of conference attendees, the displays provide barriers between the smaller groups.

According to one additional aspect of at least some embodiments of the present invention, it is contemplated that displays may be supported for movement away from a conference table edge to another location within a general conference space to facilitate one or more smaller break-out sessions within a larger conference space. To this end, referring now to FIG. 20 in at least one embodiment, an overhead rail member may extend past at least one edge of a conference table top member 424 so that, when a display 20*a* is moved away from an adjacent table top edge 426, the display remains separated from a conferencing space wall or other type of barrier 428 such that additional chairs and the like may be supported between the display 20*a* and the wall 428. For instance, in FIG. 20, two lounge type chairs 430 and 432 with a small round table 434 therebetween are positioned adjacent conferencing space wall 428 and are spaced away from facing table top edge 426. Here, display 20*a* can be moved along the direction indicated by arrow 440 away from edge 426 and toward wall 428 and can be rotated 180° as indicated by arrow 442 such that the display faces wall 428 and generally faces lounge chairs 430 and 432. When display 20*a* is so positioned, two conference attendees can use chairs 430 and 432 and display 20*a* to facilitate a small two person break-out session in a space generally removed from table top 424 and where the display 20*a* allows presentation of ideas and also forms a physical barrier between the break-out session attendees and other persons generally within the larger conference space 560.

Figure 20:
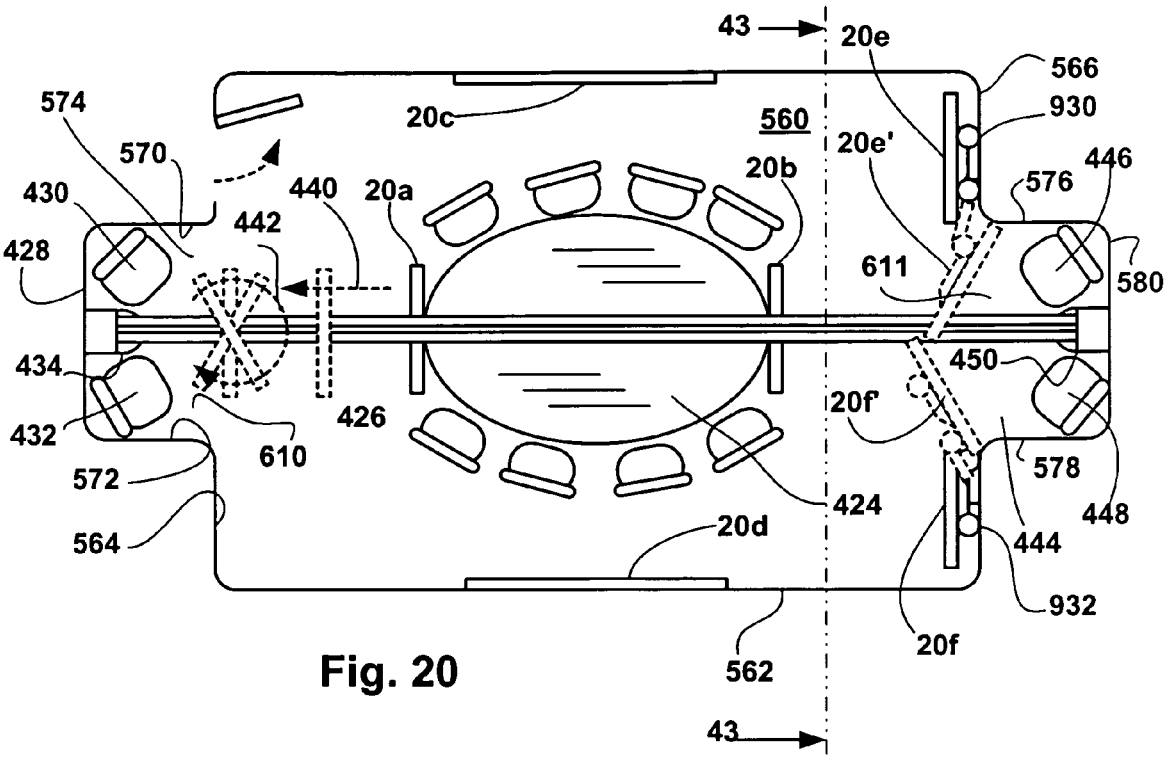
FIG. 20 is a top plan view of yet another inventive conference configuration.
Figure 21:
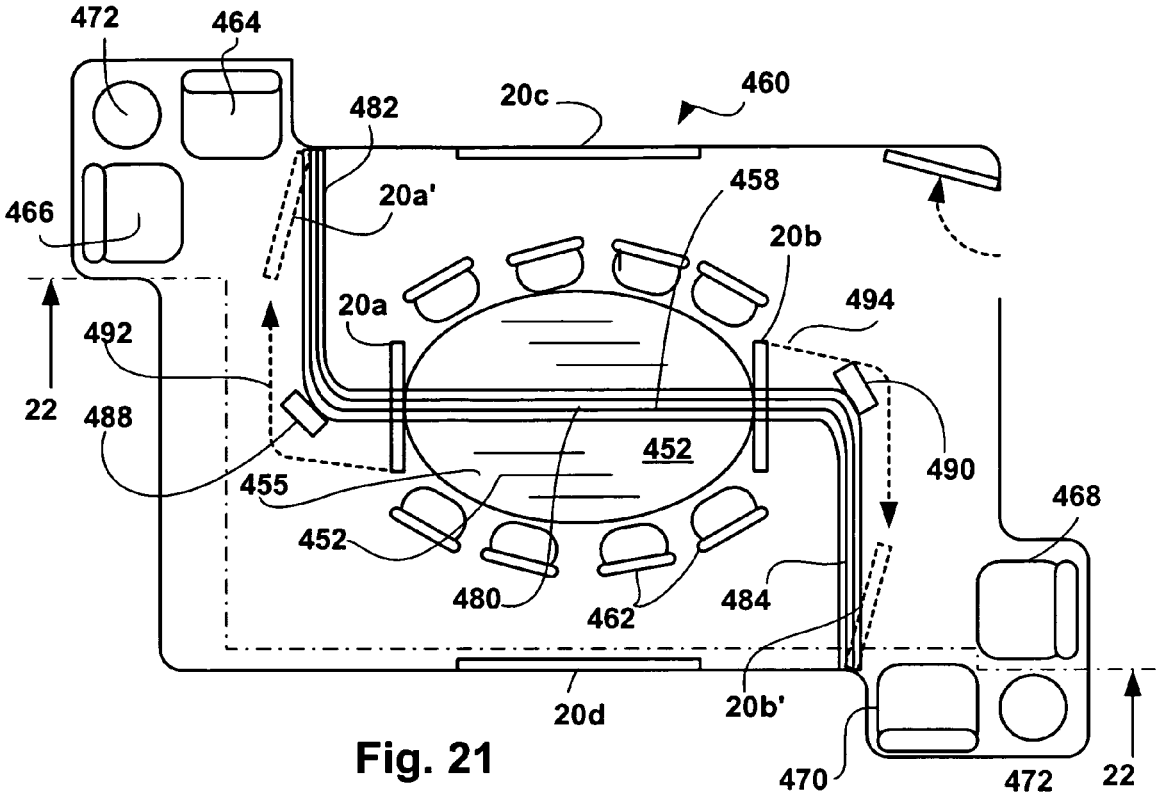
FIG. 21 is a top plan view of another inventive conference configuration.

In FIG. 20, an additional relatively small break-out area or space 444 formed by walls 576, 578 and 580 at the second end of rail member 270 is illustrated. Again, two chairs 446 and 448 as well as a small round table 450 are provided in space 444. Here, to facilitate a small break-out session within space 444, display 20*b* is moved to a location adjacent space 444 and rotate through 180° in a fashion similar to that described above with respect to display 20*a*.

In other embodiments it is contemplated that, instead of using a linear rail like rail member 270 in FIG. 20 to support displays at locations away from table top edges, contoured or non-linear rail members may be employed that allow break-out sessions away from a table top edge and at different orientations with respect to the table top. To this end, referring now to FIGS. 21 and 22, another advantageous conferencing configuration 460 is illustrated that includes, among other things, a table assembly 455, a Z-shaped rail member 458, first and second displays 20*a* and 20*b*, a plurality of conference chairs, two identified collectively by numeral 462, four break-out sessions chairs 464, 466, 468 and 470 and two break-out session tables 472 and 474. Table assembly 455 includes an oval shaped top member 452 having oppositely facing rounded edges 454 and 456. Assembly 455 also includes leg or pedestal structures 457 and 459 that support top member 452 at a table top height suitable for use with chairs 462.

Rail assembly 458 includes a linear central section 480 and two end sections 482 and 484. End sections 482 and 484 extend from opposite ends of central section 480 in opposite directions and form right angles therewith. Referring again to FIG. 14 and also to FIG. 21, each rail section 480, 482 and 484 is similar to rail section 270 forming T-slots in each rail surface. The T-slots of rail section 480 open into the T-slots of section 482 and also open into the T-slits of section 484 so that the glide assembly wheels or rollers can move from one rail section to the next. Here, if necessary, additional clearance within the T-slots may be provided where the rail sections 480, 482 and 484 intersect to ensure smooth operating or, if necessary, curved rail sections akin to the rails illustrated in FIGS. 18 and 19 may be provided between straight sections 480, 482 and 484 to ensure smooth gliding motion.

Figure 22:
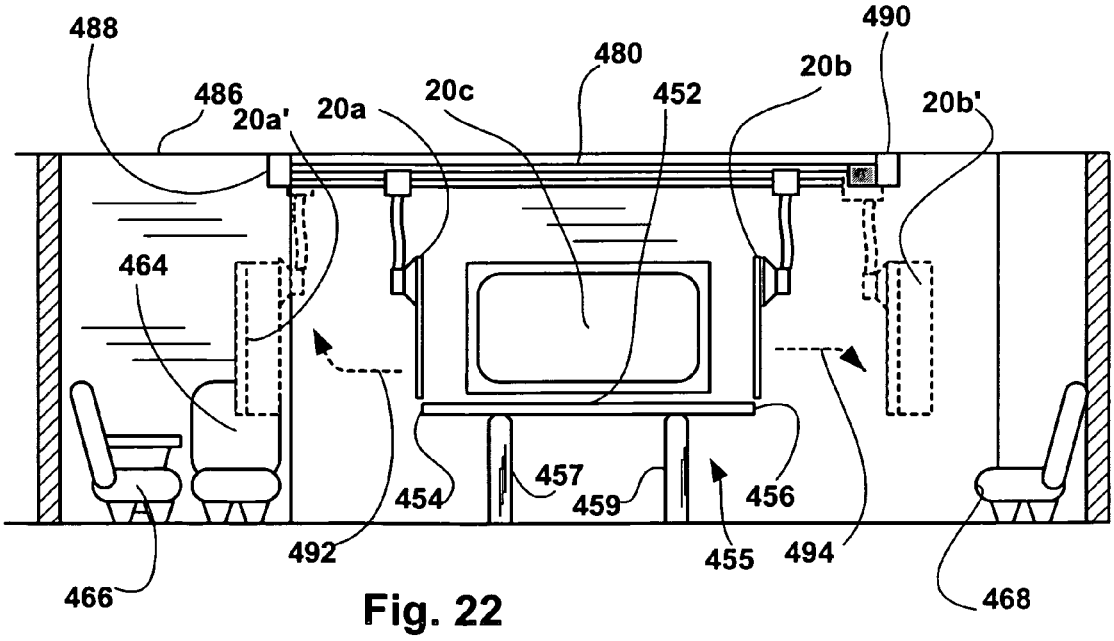
FIG. 22 is a side elevational view of the configuration illustrated in FIG. 21.

As best illustrated in FIG. 22, rail assembly 458 is mounted to a ceiling 486 by posts 488 and 490 that extend down therefrom instead of being mounted to post that extend up from a floor below. Assembly 458 is mounted such that central rail member 480 is aligned along the length of table top member 452 and thereabove and so that end rail members 482 and 484 extend substantially perpendicular to the length dimension of table top member 452.

Lounge type chairs 464 and 466 and table 472 are arranged adjacent a distal end of rail member 482. Similarly, chairs 468 and 470 and table 474 are arranged adjacent a distal end of rail member 484. Displays 20*a* and 20*b* and associated support arms are mounted to rail assembly 458 for sliding motion there along and for rotational motion about a support axis 303 (see aging FIG. 14).

With the configuration components arranged as described above, referring still to in FIGS. 21 and 22, displays 20*a* and 20*b* can be positioned adjacent the opposite table top edges 454 and 456 for use by conference attendees in chairs 462 that are gathered around table top member 452. To facilitate smaller two-person break-out sessions, displays 20*a* and 20*b* can be moved along rail assembly 458 as indicated by arrows 492 and 494, respectively, and can be rotated generally through 180° about their support axis 303 until the displays 20*a* and 20*b* are adjacent the distal ends of rail members 482 and 484, respectively. These positions of the displays are shown in phantom and indicated by labels 20*a*' and 20*b*'. Once again, displays 20*a*' and 20*b*' provide convenient screens for break-out session attendees using chairs 464 and 466 and chairs 468 and 470 to share information and also provide barriers between break-out session attendees and the larger conference space.

Figure 23:
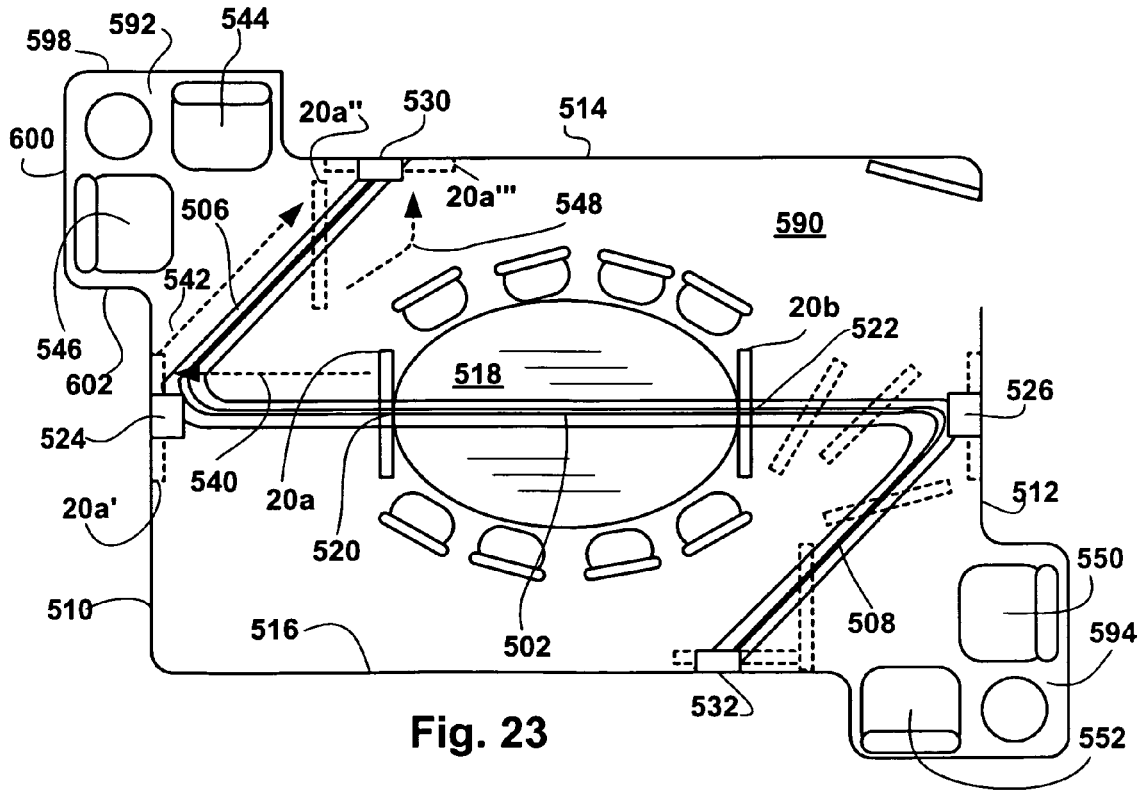
FIG. 23 is a top plan view of one more conference configuration according to at least some aspects of the present invention.

Referring now to FIG. 23, one additional exemplary conferencing configuration 500 that includes a non-linear rail assembly 502 is illustrated. Here, assembly 502 includes a central rail member 504 and first and second end rail members 506 and 508. In this embodiment, configuration 500 is employed in a conference room including walls 510, 512, 514 and 516 that generally form a rectilinear conference space 590 where oppositely facing walls 514 and 516 are generally longer than oppositely facing walls 510 and 512. A table assembly including an oval shaped top member 518 is positioned generally centrally within conference space 590 and so that its length between oppositely facing rounded edges 520 and 522 is substantially parallel to the long walls 514 and 516 that define space 590. Central rail member 504 is mounted by posts 524 and 526 from a ceiling (not illustrated) above conference space 590 so that rail member 504 is above table top member 518, parallel to wall members 514 and 516 and extends from wall member 510 to oppositely facing wall member 512. End rail member 506 and 508 extends from opposite ends of central member 504 generally in opposite directions toward wall members 514 and 516 and form approximately 45° angles with central members 504. The distal end of first end rail member 506 is mounted to the ceiling via a post 530 adjacent wall 514. Similarly, end rail member 508 is mounted to the ceiling via a post 532 that extends down therefrom adjacent wall 516. Once again, member 504, 506 and 508 have cross-sections similar to the cross-section of rail member 270 illustrated in FIG. 14 and the T-slots formed by rail member 504 open into similar T-slots formed by rail members 506 and 508 so that support arm assemblies that support displays 20*a* and 20*b* can glide or move between members 504, 506 and 508 relatively easily.

With the configuration components arranged as described above, referring still to FIG. 23, displays 20*a* and 20*b* can be positioned adjacent opposite table edges 520 and 522 to facilitate a relatively large conference session between attendees gathered around top member 518. When displays 20*a* and 20*b* are not required for use around top member 518, the displays can be moved away from the table edges 520 and 522 and placed in storage positions or for other uses away from table top member 518. For instance, display 20*a* can be moved in the direction indicated by arrow 540 toward wall 510 and placed in a storage or other use position shown in phantom and indicate by label 20*a*' against wall 510. In the alternative, from the position indicated by label 20*a*', display 20*a*' can be moved along the direction indicated by arrow 542 along rail member 506 toward wall 514 and can be rotated through approximately 180° into the position indicated by label 20*a*" so that the display generally faces chairs 544 and 546 arranged to facilitate a small two-person break-out session adjacent rail member 506. Moreover, from the position indicated by label 20*a*", display 20*a*" can be moved and rotated along the direction indicated by arrow 548 into the position indicated by label 20*a*'" against wall 514 either for storage or use adjacent wall 514.

Although not described here in detail, display 20*b* can be moved in a fashion similar to that described above with respect to display 20*a* and indicated by multiple phantom display representations in FIG. 23 so that display 20*b* can be positioned against wall 512, against wall 516 or in any of several different positions with respect to the pair of break-out session chairs 550 and 552.

According to another aspect of at least some embodiments of the present invention, it is contemplated that the walls of a conferencing space may be specially configured to facilitate both a large conference or meeting and relatively smaller break-out conference spaces. In this regard, referring once again to FIG. 20, in at least some embodiments, conference walls 560, 562, 564 and 565 may generally define a relatively large conference space 508 that accommodates a conference table and a plurality (e.g., 8) of chairs to be used adjacent the conference table. In addition, additional walls may form alcoves or smaller spaces that extend into openings in one or more of the walls 560, 562, 564 and 565 that form the larger conferencing space 560. For example, in FIG. 20, walls 570, 572 and 428 form an alcove or break-out space 574 in an opening 610 formed in wall 564 to accommodate chairs 430 and 432 as well as break-out session table 434. Similarly, in FIG. 20, walls 576, 578 and 580 together define a second alcove space 444 that extends into an opening 611 formed in wall 566 for accommodating chairs 446 and 448 and break-out session table 450. These alcove or break-out spaces 574 and 444 generally allow pairs of conference attendees to form a sidebar away from the larger conference space 560 and, because of their enclosed nature, provide a feeling of relative privacy within the larger space.

A second exemplary embodiment wherein wall structure facilitates break-out sessions is illustrated in FIG. 23. In FIG. 23, a relatively large conference space 590 is formed by walls 510, 512, 514 and 516 where alcove spaces 592 and 594 extend into openings in opposite corners of a larger conferencing space 590. Here, for instance, additional walls 596, 598, 600 and 602 form alcove space 592 at a corner between walls 510 and 514 where wall 596 is perpendicular to wall 514, walls 602 is perpendicular to wall 510 and extends thereinto, wall 600 is parallel to wall 510 and wall 598 is parallel to wall 514. Similarly, additional walls (not labeled) are provided at the corner where wall 512 approaches wall 516 to form break-out space 594.

The wall structures that form the alcove spaces 592 and 594 accommodates chair pairs at particularly advantageous angles for two person communication. More specifically, for example, chairs 544 and 546 can be positioned within space 592 such that attendees in the chairs are oriented at a generally 90° angle with respect to each other which has been identified as a particularly advantageous angle for two person communication. Angles other than 90° but still within a range generally about 90° (e.g., 60-120°) for the orientations of chair pairs within spaces 592 and 594 are contemplated.

In at least some embodiments, it is contemplated that the display supporting rail assembly can be designed and positioned with respect to the walls of a conferencing room including break-out session alcoves such that the displays and walls can further operate in a synergistic fashion to give the feeling of additional privacy when break-out sessions occur within the alcoves. To this end, in at least one embodiment, referring again to FIG. 20, where break-out alcove spaces 444 and 574 are at opposite ends of rail member 270, rail member 270 may have a length that extends into the opposite alcove spaces 574 and 444 or at least to the openings 610 and 611 that open into those spaces. In this case, when a display screen 20*a* is moved into a position adjacent space 574 and is rotated to face into space 574, break-out attendees in chairs 430 and 432 have a relatively private space for sharing information where walls 570, 572 and 428 as well as the display 20*a* substantially enclose space 574. Similarly, display 20*b* may cooperate with walls 576, 580 and 578 to substantially enclose space 444 for an additional break-out session.

Referring again to FIG. 23, when a display 20*a*" is positioned adjacent alcove space 592, the display 20*a*" and walls 596, 598, 600 and 602 together substantially cordon off alcove space 592 from the larger conferencing space 590 to facilitate a break-out session.

The advantages associated with providing a wall structure that forms break-out session alcoves as described with respect to FIGS. 20 and 23 can also be obtained in the context of other conferencing configurations where displays are supported by other support structure for movement. To this end, for instance, referring to FIGS. 24 and 25, yet another exemplary conference configuration 620 is illustrated that includes a wall structure 622, a table assembly 621 including a table top member 624 having oppositely facing first and second straight edge sections 626 and 628, respectively, conferencing chairs, two of which are collectively identified by numeral 630, display screens 20*a*, 20*b*, 20*c* and 20*d*, break-out session chairs 632, 634, 636 and 638 and break-out session tables 640 and 642. Here, wall structure 622 includes two long substantially parallel side walls 642 and 646 and two substantially parallel end walls 644 and 648 where walls 642, 644, 646 and 648 generally form a rectilinear relatively large conference space 654. Wall structure 622 also includes additional walls that form alcove or break-out spaces 650 and 652 at opposite corners of larger conference space 654 in a manner akin to that described above with respect to FIG. 23.

Break-out session chairs 632 and 634 and table 640 are arranged within break-out space 650. Similarly, chairs 636 and 638 and table 642 are arranged in break-out space 652. The table including top member 624 is positioned generally centrally within large conferencing space 654 and chairs 630 are placed therearound except for along straight edge sections 626 and 628.

Figure 9:
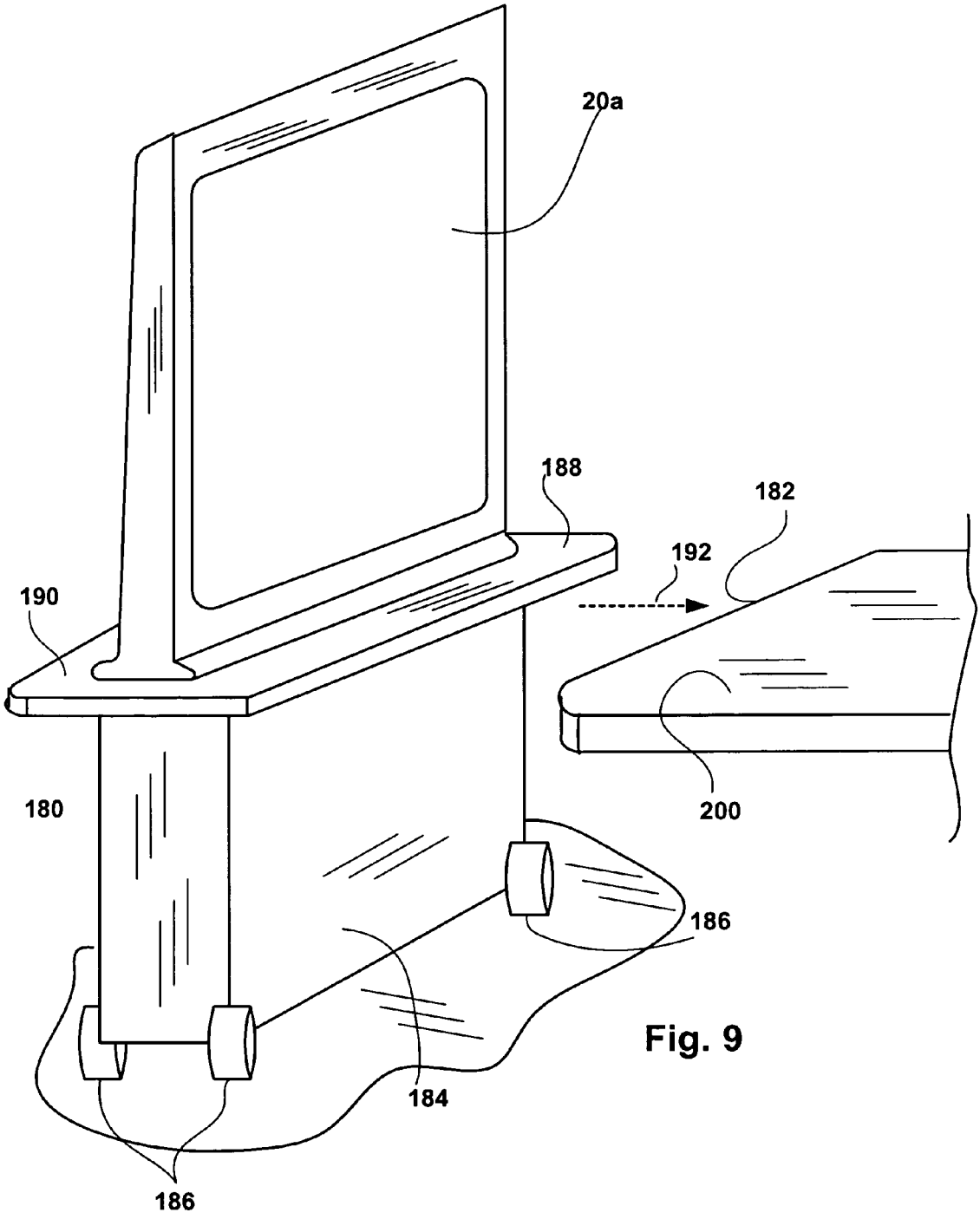
FIG. 9 is a perspective view a flat panel display mounted on a cart that can be moved toward and away from the edge of a table top.
Figure 24:
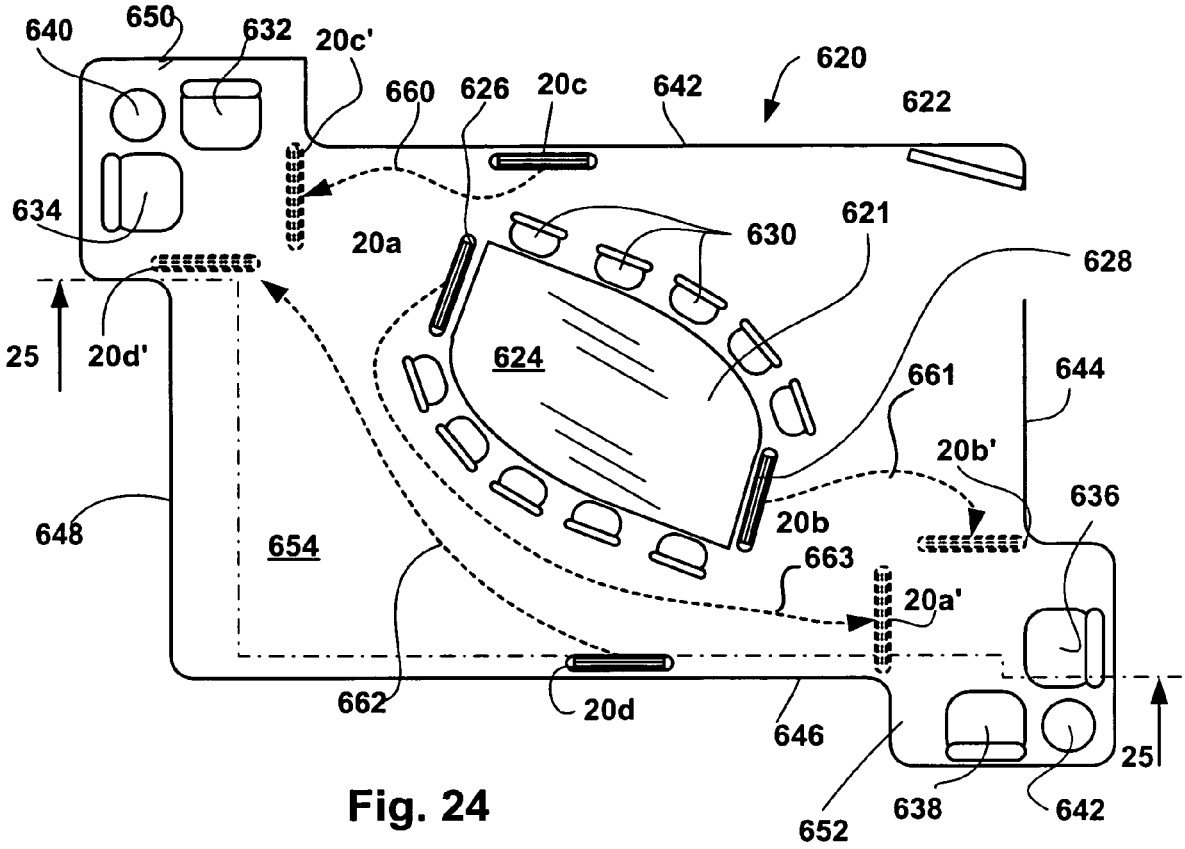
FIG. 24 is a top plan view of another inventive conference configuration according to at least some aspects of the present invention.
Figure 25:
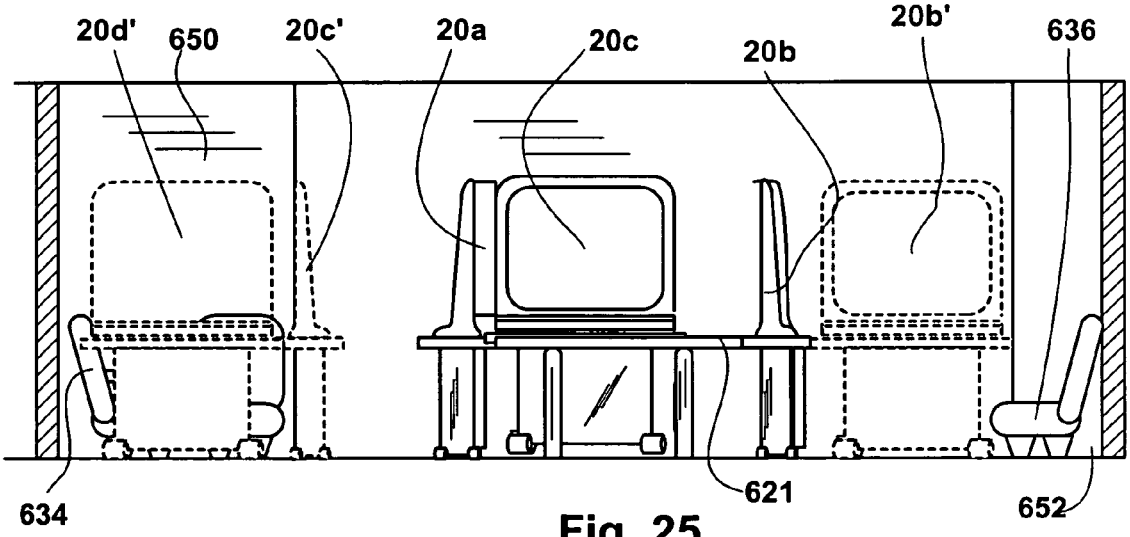
FIG. 25 is a side elevational view of the configuration illustrated in FIG. 24 and taken along the line 25-25.
Figure 26:
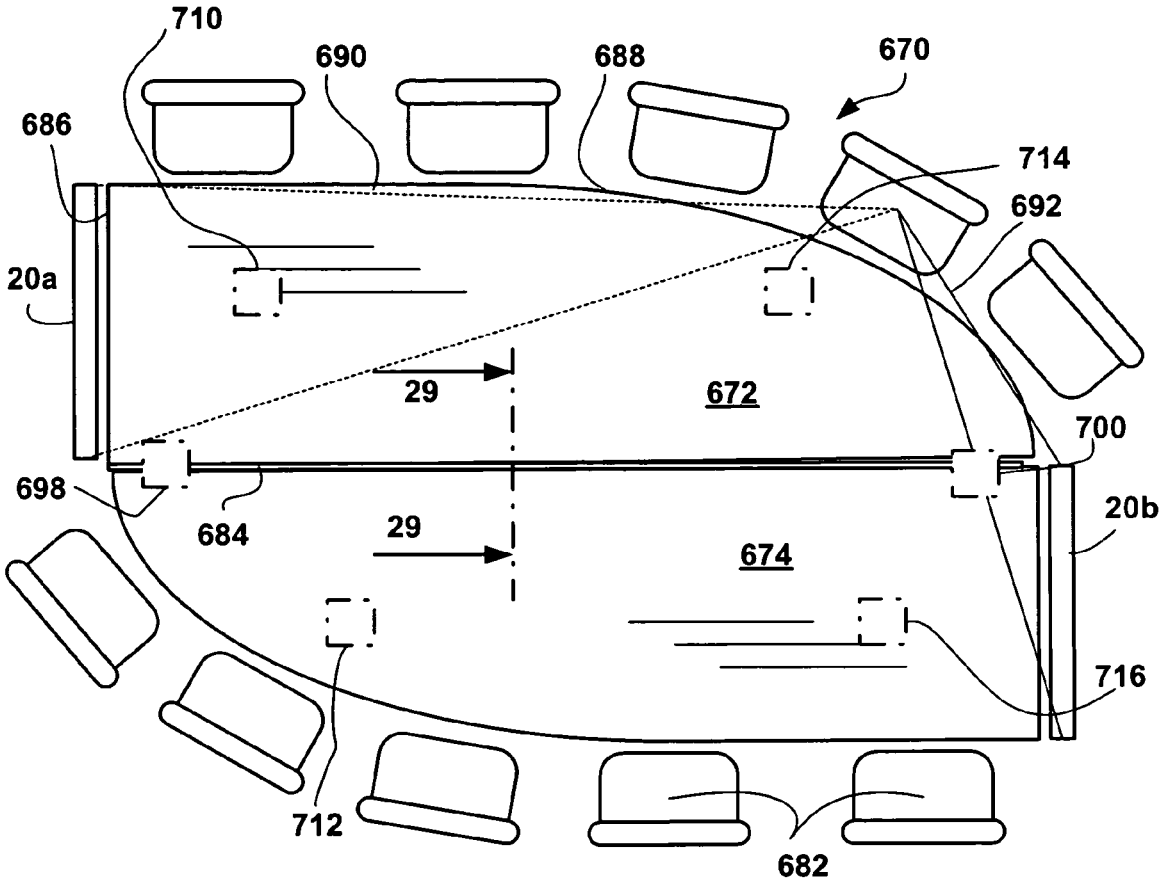
FIG. 26 is a top plan view of another inventive conference configuration including a split and sliding table top.
Figure 27:
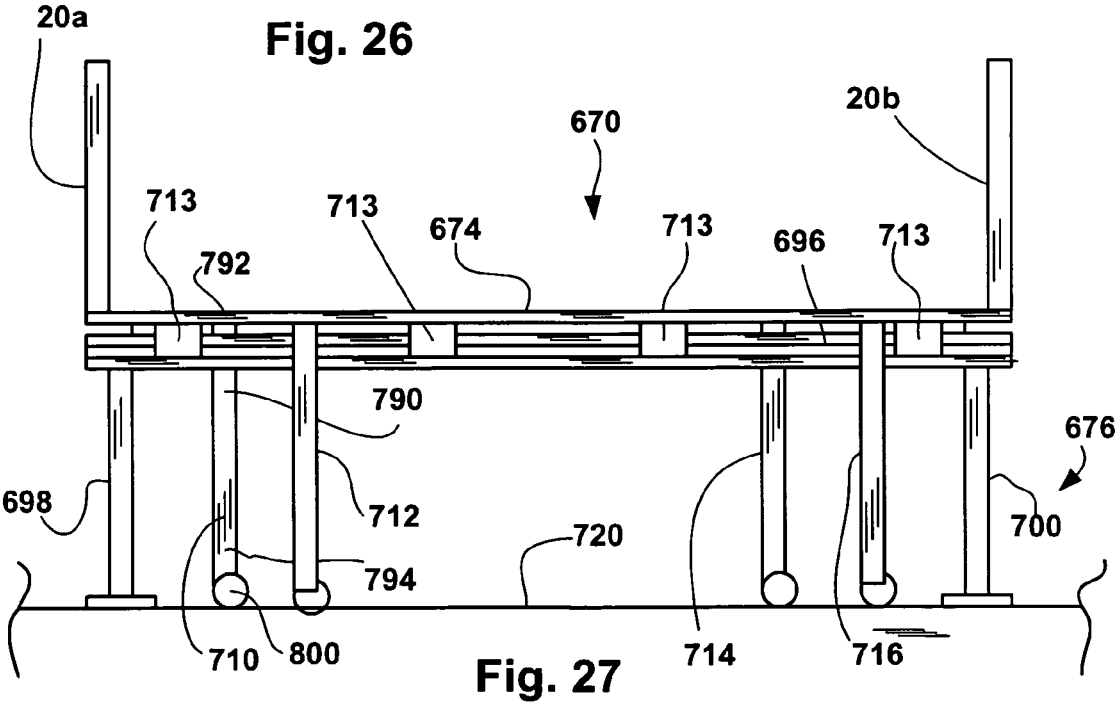
FIG. 27 is a side elevational view of the configuration shown in FIG. 26.
Figure 28:
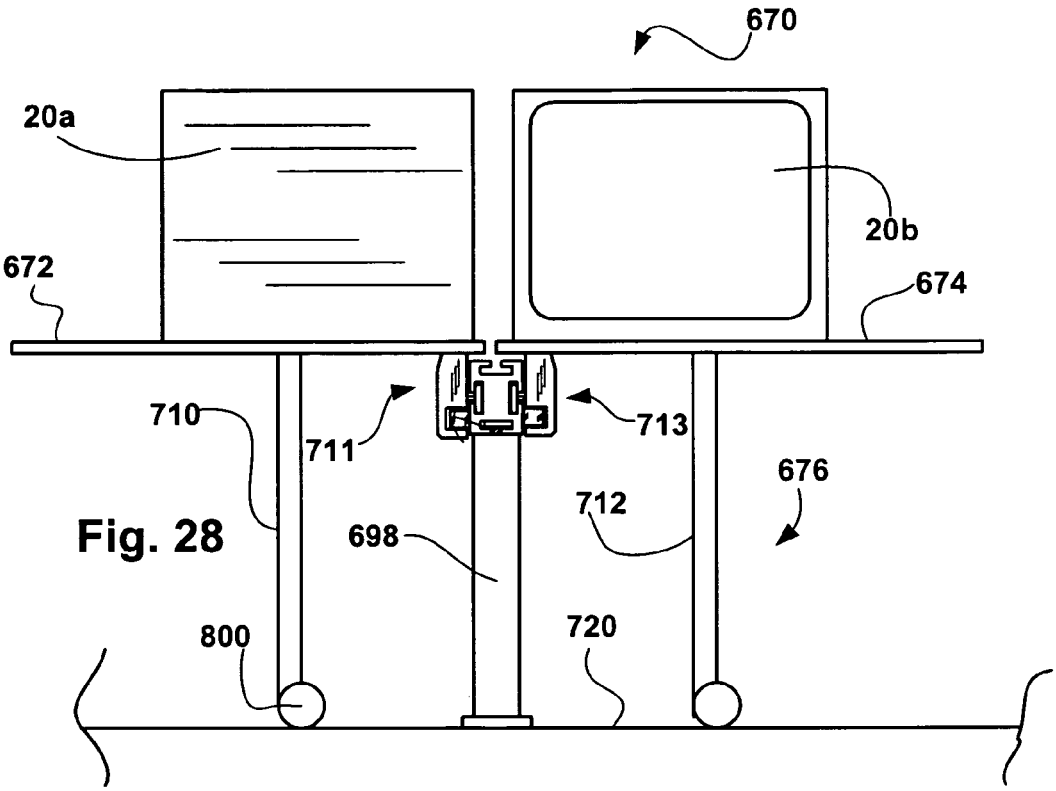
FIG. 28 is an end elevational view of the configuration shown in FIG. 26.
Figure 29:
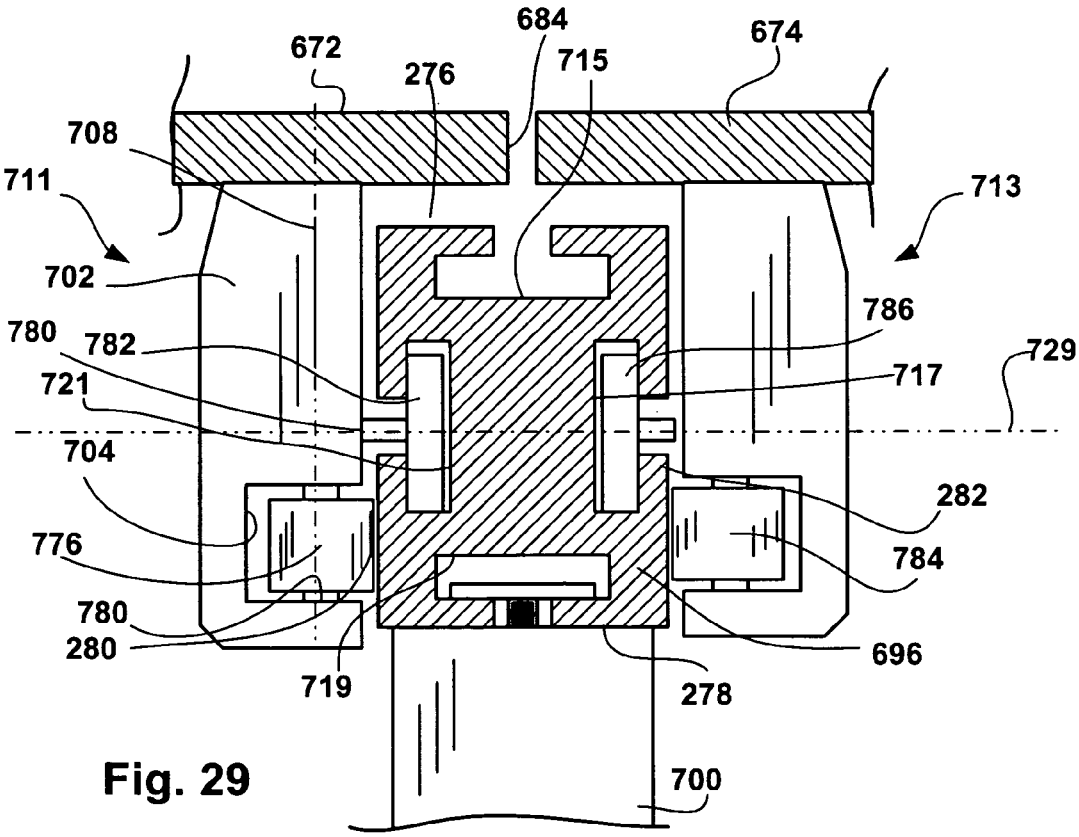
FIG. 29 is a cross-sectional view taken along the line 29-29 in FIG. 26.

In this embodiment, referring still to FIGS. 24 and 25 and also to FIG. 9, displays 20*a*, 20*b*, 20*c* and 20*d* are supported via wheeled carts for movement within space 654. Consistent with at least some of the configurations described above, at least two of the displays 20*a* and 20*b* may be positioned adjacent straight edge sections 626 and 628 to facilitate conferencing at top member 624 as illustrated in FIGS. 24 and 25. Here, as illustrated in FIG. 24, displays 20*c* and 20*d* maybe positioned against walls 642 and 646 for off-axis viewing. With displays 20*a* and 20*b* adjacent edges 626 and 628, respectively, display 20*c* may be moved as indicated by arrow 660 to a location indicated by label 20*c*' to facilitate a two-person break-out session between attendees in chairs 632 and 634. Similarly, when the attendees in chairs 632 and 634 require a second display screen to facilitate their break-out session, display 20*d* can be moved along the direction indicated by arrow 662 to the location indicated by label 20*d*' adjacent space 650 to facilitate the break-out session. Where two displays are positioned adjacent a corner alcove space (e.g., 650), advantageously, one of the displays 20*c*' can be positioned so as to directly face the break-out session attendee in chair 634 while the other display 20*d*' is positioned so as to directly face the attendee in chair 632 as illustrated in FIGS. 24 and 25.

Similarly, displays 20*a* and 20*b* may be moved to locations adjacent space 652 to facilitate a break-out session therein. In the alternative, any of the displays 20*a*-20*d* may be used with any of the two alcove spaces 650 or 652 to facilitate a break-out session and any of the displays may be used with top member 624 to facilitate a larger conference.

According to at least one additional aspect of the present invention, it has been recognized that conferencing tables like the ones described above may be replaced by table assemblies where table top members includes two or more top members that can be arranged together to facilitate relatively large conferences and that can be separated to facilitate break-out sessions within a conferencing space. To this end, in at least some embodiments it is contemplated that the supporting structure for supporting table top members at table top heights may include a rail assembly below the table top members that allows the separate members to slide therealong between at least a first positions where the tops can be used together to facilitate a relatively large conference and a second position wherein the tops are at least relatively more separated and can be used to facilitate the break-out sessions.

Consistent with the comments above, referring now to FIGS. 26 through 32, an exemplary split table conferencing configuration 670 is illustrated that includes first and second top members 672 and 674, respectively, a supporting structure 676, first and second optional displays 678 and 680, respectively and a plurality of conferencing chairs, two of which are collectively indicated by numeral 682 in FIG. 24.

Each of top members 672 and 674 has a substantially similar configuration and shape and therefore, in the interest of simplifying this explanation, only member 672 will be described here in detail. Member 672 is a rigid planar member including a first straight long edge 684, a second straight short edge 686 and a third generally curved edge 688. Straight edges 686 and 684 come together to form a corner and are perpendicular to each other. Curved edge 688 generally includes a straight edge section 690 adjacent edge 686 and that is substantially perpendicular thereto and a curved edge sections 692 that extends from straight edge section 690 to an end of edge 684 opposite edge 686. The curved section 692 is generally curved convex outwardly away from straight edge section 684.

Referring still to FIGS. 26 through 29, support structure 676 includes a rail member 696, stationary leg post members 698 and 700, glide assemblies 711 and 713 and movable leg assemblies 710, 712, 714 and 716. Each of stationary leg members 698 and 700 are rigidly mounted to a floor structure 720 and extend vertically up therefrom. Rail member 696 is mounted to the top ends of leg members 698 and 700 in any suitable fashion so that rail member 698 is substantially horizontal. Rail member 698 is a linearly rail member similar to the rail member described above with respect to FIG. 14 and, to that end, forms separate T-slots in each of four separate rail member surfaces 276, 278, 280 and 282.

Four glide assemblies 711 (not illustrated) are mounted to an undersurface of top member 672 and four assemblies 713 (see FIG. 27) are similarly mounted to an undersurface of top member 674 in an aligned fashion. Because each of the glide assemblies is similarly constructed and operates in a similar fashion, only one of assemblies 711 will be described here in any detail. Exemplary assembly 711 includes a bracket 702 mounted to the undersurface of top member 672 adjacent edge 684 that extends generally perpendicularly from the undersurface. About midway along the length of bracket 702 an axel 780 extends parallel to top member 672 and generally in the direction of edge 684. A roller wheel 782 dimensioned to be received with clearance within T-slot 721 is mounted to axel 780 for rotation about a horizontal axis 729. Near the distal end of bracket 702, bracket 702 forms a recess 704 in which another roller wheel 776 is mounted for rotation about a vertical axis 708. Wheel 776 is dimensioned and mounted within recess 704 such that a surface thereof extends out of recess 704 and past an adjacent surface of bracket 702.

To mount top member 672 to rail member 696, roller 782 is placed within T-slot 721 and roller 776 is received on external rail surface 280 adjacent slot 721 such that rollers 776 and 782 generally support top 672 in a cantilevered fashion. Similarly, upon mounting of top member 674 to rail 696, rollers 784 and 786 support top member 674 in a cantilevered fashion. In addition to being supported by rail 696 and assemblies sets 711 and 713, top members 672 and 674 are also supported by leg structures 710, 712, etc., and therefore there is little binding between the rollers and the rail. Other glide assembly types and configurations are contemplated.

Each of leg assemblies 710, 712, 714 and 716 has a similar construction and operation and therefore, in the interest of simplifying this explanation, only assembly 710 will be described here in detail. Assembly 710 includes a rigid leg member 790 having an upper end 792 and a lower end 794. Upper end 792 is rigidly attached to an undersurface of top member 672 proximate the corner of member 672 formed by edges 686 and 690. A caster or roller 800 is mounted to the lower end of member 790. Leg assembly 714 is mounted to a lower surface of member 672 proximate curved edge section 692. Leg assemblies 712 and 716 are mounted to the lower surface of member 674 at locations akin to the locations described above with respect to leg assemblies 710 and 714.

In this embodiment, it will be assumed that displays 20*a* and 20*b* are mounted to the short straight edges (e.g., 686 in FIG. 26) of top members 672 and 674 via brackets similar to the brackets described above with respect to FIG. 4 so that displays 20*a* and 20*b* move along with top members 672 and 674, respectively.

Referring once again to FIGS. 26 through 29, in at least one orientation, top members 672 and 674 can be moved over rail member 696 so that the long straight edges (e.g., 684) are aligned. In this orientation, top members 672 and 674 can be used together to facilitate a relatively large conference where attendee chairs 682 are arranged along the curved edges 688 of the members 672 and 674.

Figure 30:
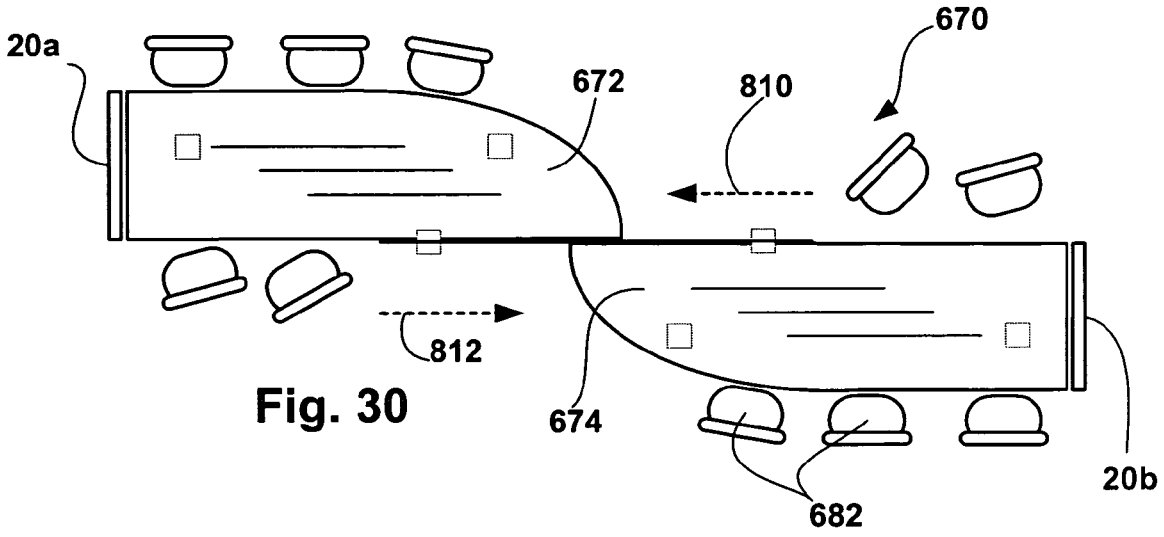
FIG. 30 is a top plan view of the configuration in FIG. 26, albeit with table top sections in a separated orientation.

When conference attendees desire to break-out into two small groups to facilitate additional discussions, referring to FIG. 30, table top members 672 and 674 can be slid along rail 696 in opposite directions indicated by arrows 810 and 812 thereby increasing the distance between displays 20*a* and 20*b*. During sliding motion of top members 672 and 674, the top members are supported by roller wheels 776, 772, 784 and 786 (see again FIG. 29) and casters 800 at the bottoms of leg assemblies 710, 712, 714 and 716 for easy movement. After top members 672 and 674 have been separated as illustrated in FIG. 30, chairs 682 can be rearranged at opposite ends of the split table assembly to facilitate two breakout sessions adjacent displays 20*a* and 20*b*. Here, the distance between displays 20*a* and 20*b* as well as the orientation of chairs 682 with respect to the different displays 20*a* and 20*b* helps to focus breakout session attendees on information presented via one of the displays and away from the information presented via the other display.

Figure 31:
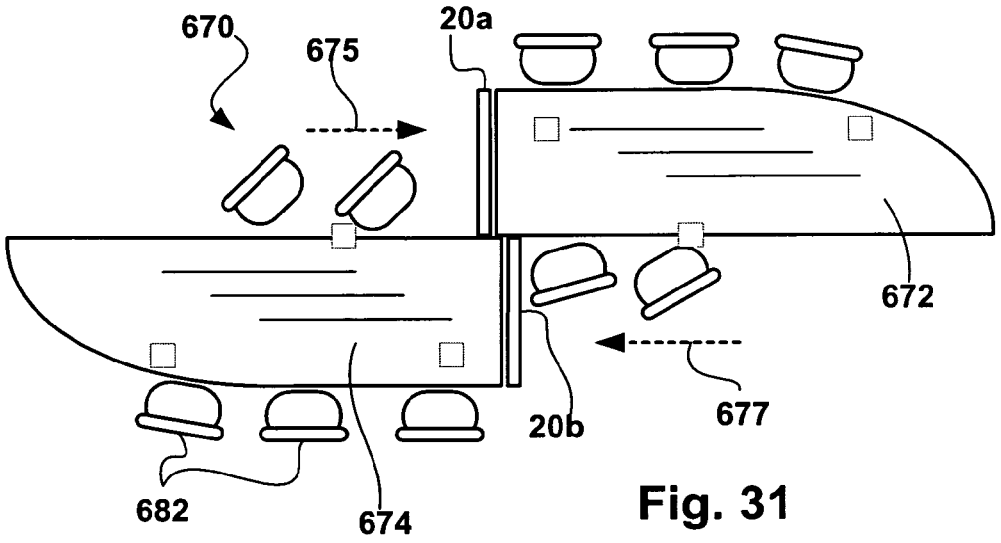
FIG. 31 is similar to FIG. 30, albeit with the table tops in a different separated orientation.

Referring now to FIG. 31, instead of separating the table top members 672 and 674 so that displays 20*a* and 20*b* are further apart, in at least some embodiments it is contemplated that members 672 and 674 may be slid in the opposite directions indicated by arrows 675 and 677 so that displays 20*a* and 20*b* end up proximate each other to facilitate separate breakout sessions. In this case, in addition to providing dedicated displays for the two separate breakout sessions, the displays also provide a physical barrier between the two breakout sessions giving session attendees a greater sense of privacy.

Figure 32:
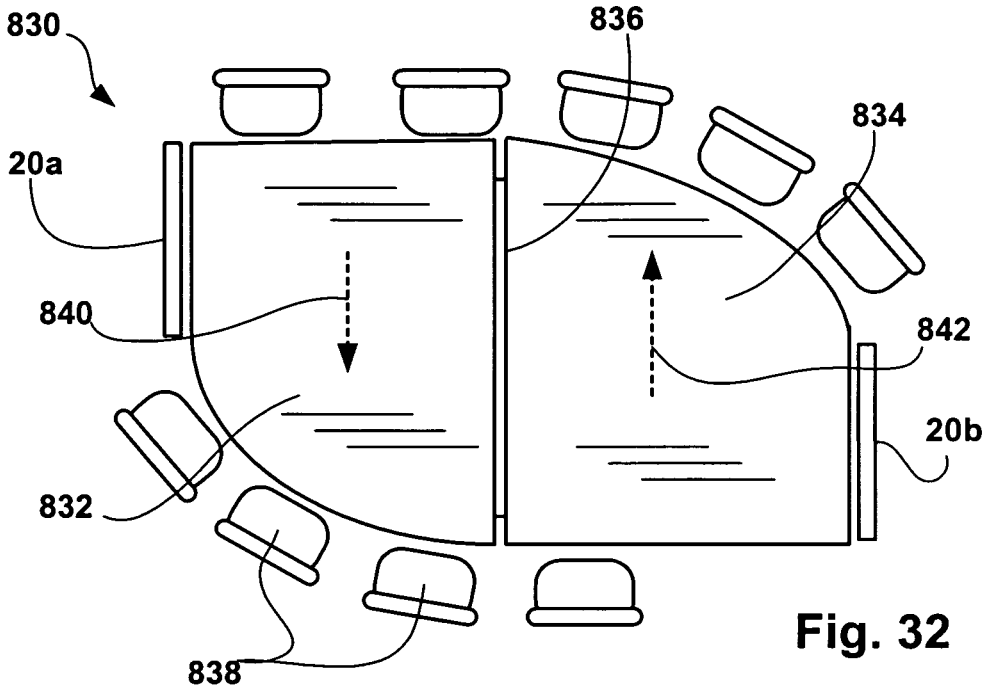
FIG. 32 is a top plan view of another split table top conference configuration.
Figure 33:
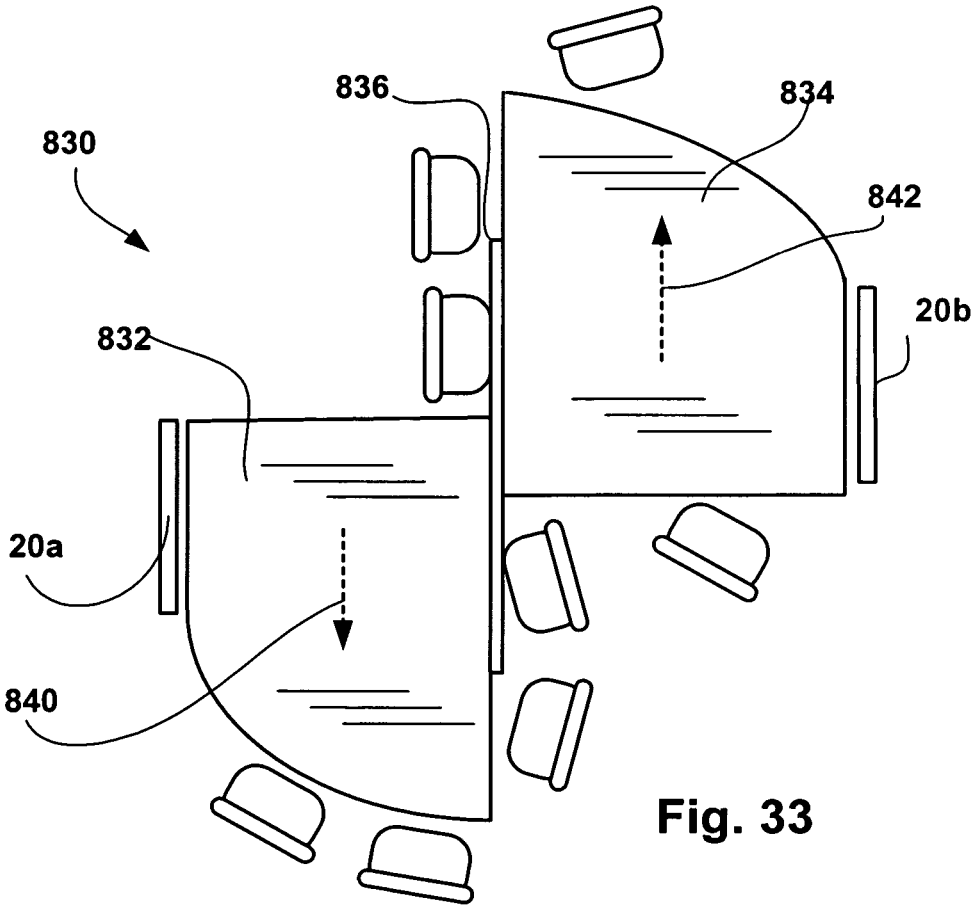
FIG. 33 is a top plan view of the configuration of FIG. 32, albeit with the table sections in a split orientation.

Referring now to FIGS. 32 and 33, an additional split table conferencing configuration 830 is illustrated that includes first and second table top members 832 and 834, respectively, a support structure 836, first and second optional displays 20*a* and 20*b*, respectively, and a plurality of chairs, two collectively identified by numeral 838. Here, configuration 830 is similar to the configuration described above with respect to FIGS. 26 through 31 with a few exceptions. First, top members 832 and 834 have shapes that are different than the shapes of members 672 and 674 described above. In addition, while members 672 and 674 were arranged to slide along rail 696 in a direction substantially perpendicular to displays 20*a* and 20*b*, in FIGS. 32 and 33, top members 832 and 834 slide along a rail that forms part of support structure 836 in directions substantially parallel to displays 20*a* and 20*b* in opposite directions indicated by arrows 840 and 842. Here, top members 832 and 834 may either be positioned adjacent each other as indicated in FIG. 32 to facilitate a relatively large conference or can be split as indicated in FIG. 33 to facilitate relatively smaller breakout sessions where, while the table top members 832 and 834 are separated, the displays 20*a* and 20*b* are nevertheless relatively close so that members in the two separate breakout sessions have a better view of the displays used by the other breakout session attendees.

Figure 34:
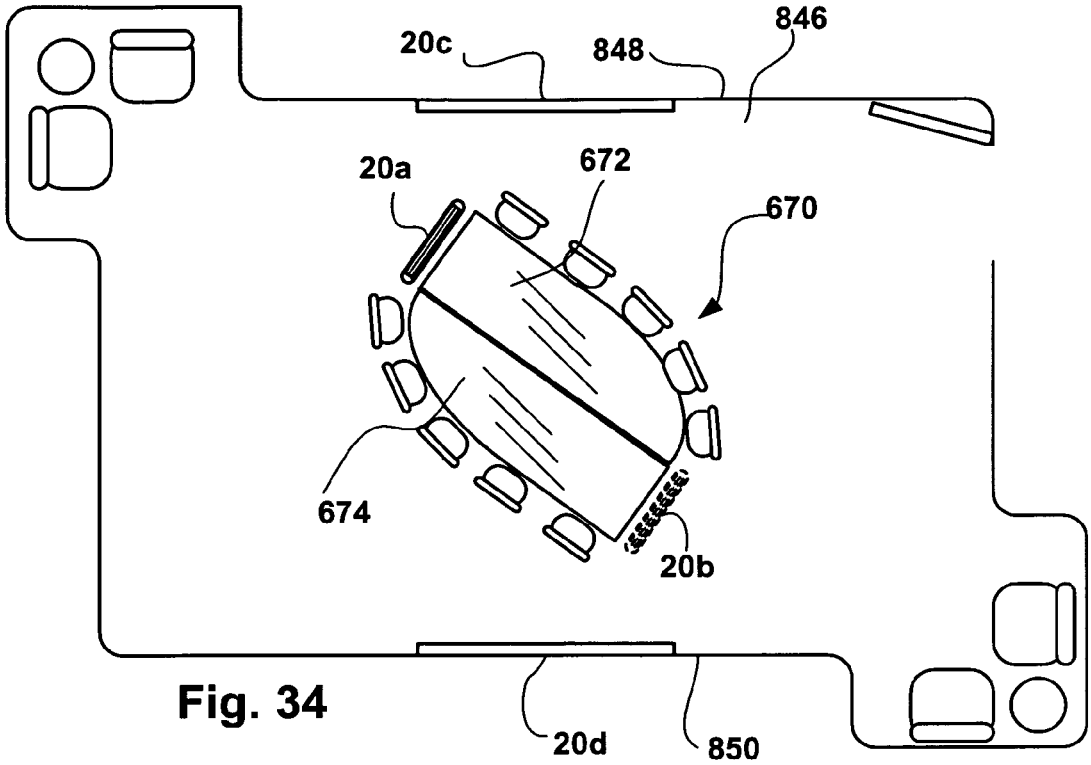
FIG. 34 is a top plan view of a conference configuration wherein a split table is positioned within a conference room so that the table and wall structure of the conference room cooperate to provide a additional synergy.

In at least some embodiments, it is contemplated that split tables may be positioned within the context of a conferencing space having wall structure and additional displays where the wall structure, display positions and table juxtaposition are selected so that additional synergies results. To this end, for instance, referring now to FIGS. 34 and 35, a split table assembly 670 similar to the one described above in respect to FIGS. 26 through 31 may be located within a conference space 846 including oppositely facing parallel side walls 848 and 850 where generally off axis displays 20*c* and 20*d* are mounted to walls 848 and 850, respectively. In the configuration shown in FIGS. 34 an 35, displays 20*a* and 20*b* are supported by castered carts (see again 180 in FIG. 9) instead of being mounted to the edges of table top members 672 and 674 so that the displays 20*a* and 20*b* can be moved separately from the top members.

Figure 35:
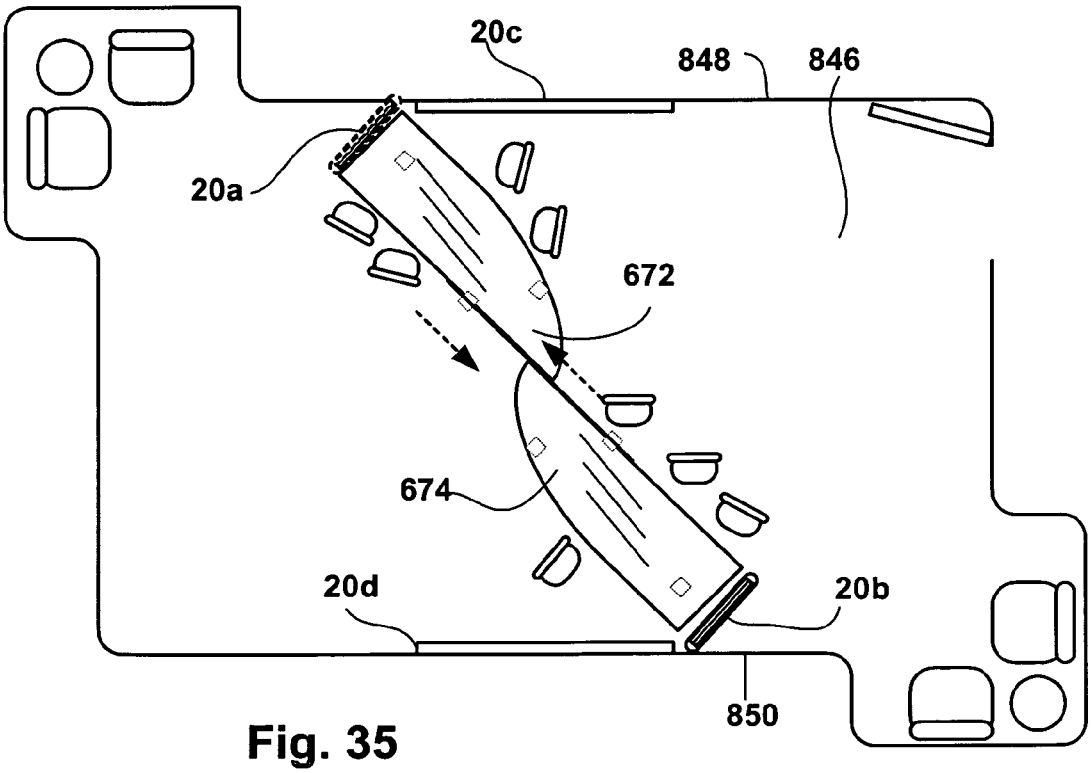
FIG. 35 is similar to FIG. 34, albeit where table top members are in a split configuration.

Here, table assembly 670 is oriented and dimensioned such that, as illustrated in FIG. 35, when the top members 672 and 674 are split, opposite corners thereof are adjacent edges of the off axis displays 20*c* and 20*d*. When so positioned, breakout session attendees adjacent display 20*a* can use both display 20*a* and off axis display 20*c* to share information. Similarly, breakout session attendees adjacent to display 20*b* can use both display 20*b* and display 20*d* to facilitate a second breakout session.

While the split table configurations described above have been described in the context of tables where table top members or sections are symmetrical or identically shaped, at least some embodiments of the present invention are contemplated where the split top members or sections are not identically shaped. For example, referring to FIGS. 36 and 37, another exemplary conference configuration 850 is illustrated that includes a table assembly having first and second split top members 852 and 854, first, second and third display screens 20*a*, and 20*b*, and 20*c*, respectively, and a plurality of conferencing chairs, two of which are collectively identified by numeral 856. Here, when top members 852 and 854 are positioned together to facilitate a relatively large conference, the combined outside edge of members 252 and 254 generally defines a triangle with rounded corners where straight edge sections 858, 860 and 862 exist between each two adjacent rounded corners. Member 852 includes first and second straight edge sections 858 and 860 and a curved section 859 there between. Member 854 includes straight edge section 862 and rounded edge sections 861 and 863 to each end thereof. Members 852 and 854 also each include long straight edge 864 and 866, respectively, where the long straight edges are adjacent each other.

The first, second and third display screens 20*a*, 20*b* and 20*c* are arranged adjacent straight edge sections 854, 860 and 862, respectively. Here, it will be assumed that the displays (e.g., 20*a*) are mounted to the straight edge sections via a brackets akin to the bracket illustrated and described above with respect to FIG. 4.

Figure 36:
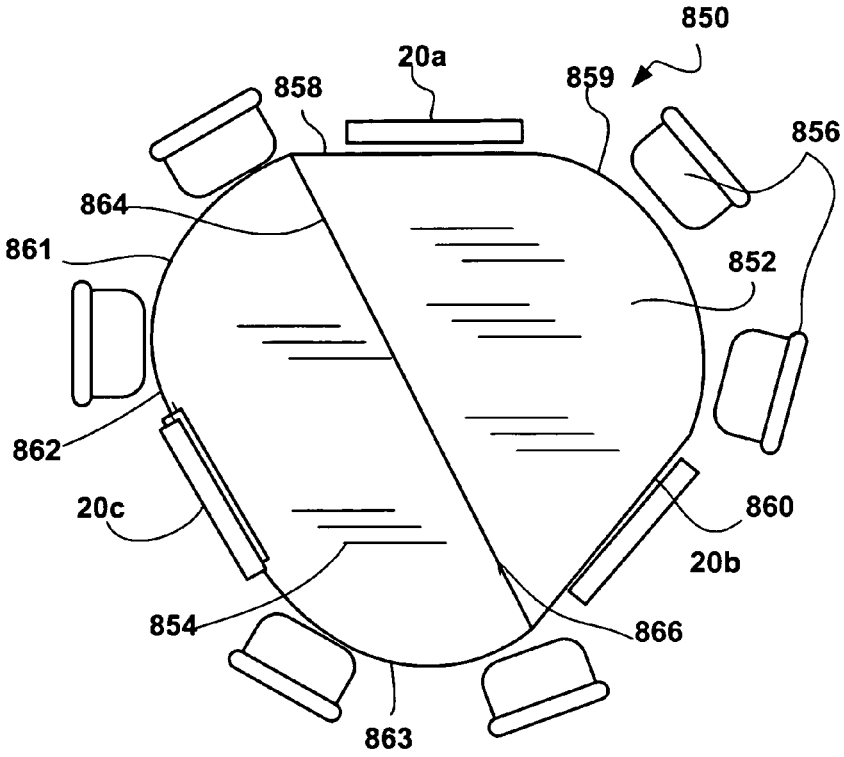
FIG. 36 is a top plan view of another split table configuration.
Figure 37:
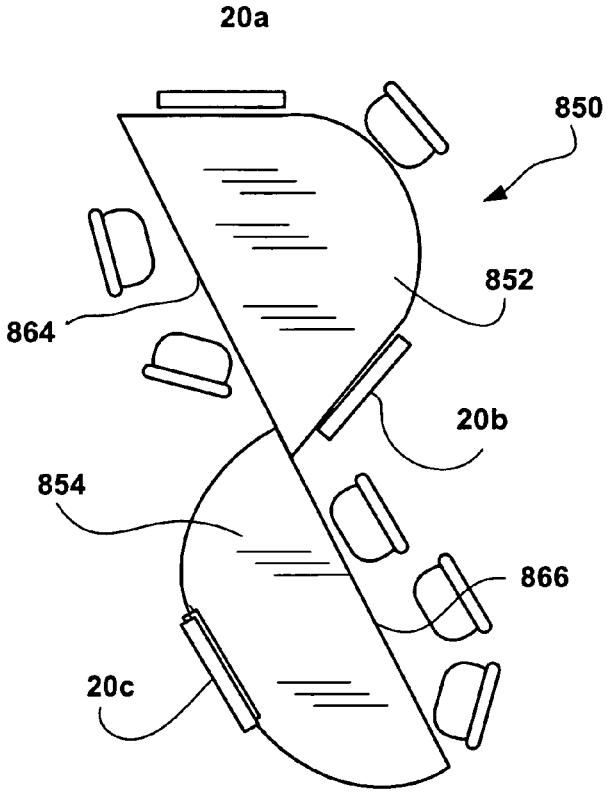
FIG. 37 is similar to FIG. 36, albeit where the table sections have been slid into a split configuration.

Referring to FIG. 36, top members 852 and 854 can be positioned as illustrated with their long straight edges 864 and 866 adjacent and aligned. To facilitate two breakout sessions, top members 852 and 854 can be slid along a rail member (not illustrated) there under in opposite directions until the arrangement of FIG. 37 is achieved. In this case, displays 20*a* and 20*b* are used to facilitate one of the breakout sessions while display 20*c* is used to facilitate the second breakout session.

While the split table type embodiments described above are described in the context of configurations that include a supporting rail below table top members that guides the table tops along restricted trajectories, in at least some embodiments, it is contemplated that other types of support structure may be provided for split table tops to facilitate movement of table top members and reconfiguration thereof. For example, referring now to FIGS. 38 through 40, an exemplary conference configuration 870 is illustrated that includes four table assemblies, each assembly including a top member 872, 874, 876 and 878 and support structure there below, four flat panel display screens 20*a*, 20*b*, 20*c*, and 20*d* and a plurality of chairs, two of which are collectively identified by numeral 880.

Top members 872, 874, 876 and 878 and associated supporting structure are substantially identical and therefore, in the interests of finding an explanation, only top member 872 and its supporting structure will described here in detail. Top member 872 has a generally triangular shape including three straight edge sections 882, 884 and 886 and three rounded edge sections 888, 890 and 892. Straight edge sections 886 and 884 form a generally right angle, straight edge sections 882 and 884 form an approximately 45° angle and straight edge sections 882 and 886 also form an approximately 45° angle. Curved edge section 890 is formed between straight edge sections 884 and 886, curved edge section 888 is formed between straight edge sections 882 and 884 and curved edge section 892 is formed between straight edge sections 882 and 886.

Figure 39:
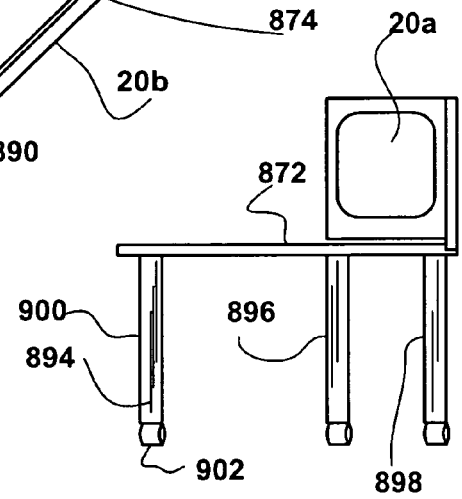
FIG. 39 is a side elevational view of one of the table assemblies and a display screen of FIG. 38.

Referring to FIG. 39, top member 872 is supported by three leg assemblies 894, 896 and 898 where each of the leg assemblies is substantially identical. Leg assembly 894 includes a rigid elongated leg member 900 having top and bottom ends where the top end is rigidly mounted to an undersurface of member 872 and the bottom end is mounted to a wheel or caster 902 to facilitate movement.

A display 20*a*, 20*b*, 20*c* and 20*d* is mounted to the straight edge section (e.g., 882) of each of top members 872, 874, 876 and 878, respectively, that is opposite the right angle formed by the other two straight edge sections (e.g., 884 and 886) of the top member. In this embodiment it will be assumed that the displays (e.g., 20*a*) are mounted to the edges of the table top members (e.g., 872) via brackets like the bracket illustrated in FIG. 4 and described above.

Figure 38:
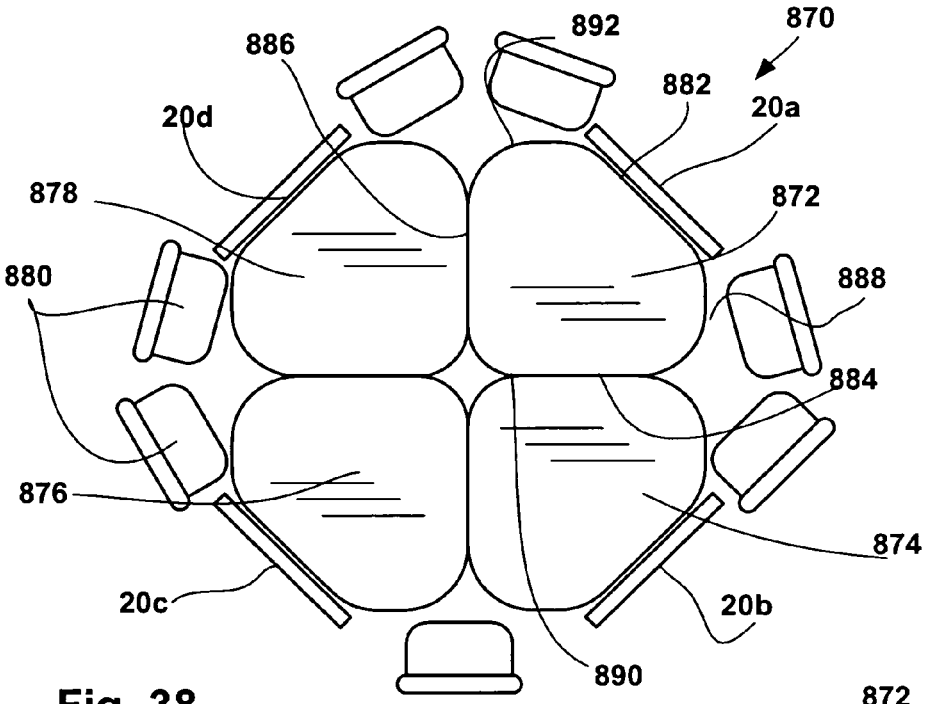
FIG. 38 is a top plan view of another inventive conference configuration.

In operation, table top members 872, 874, 876 and 878 may be brought together as illustrated best in FIG. 38 with their right angle corners coming together to generally form an octagon-type shape where all of the displays 20*a*, 20*b*, 20*c* and 20*d* face a center of the table configuration. Here, chairs 880 may be positioned between the displays to accommodate conference attendees. Once again, as in the case of the embodiments described above, attendees about the table configuration can share information and have generally unobstructed views of information presented via at least one and in many cases two or more of the edge mounted displays.

Figure 40:
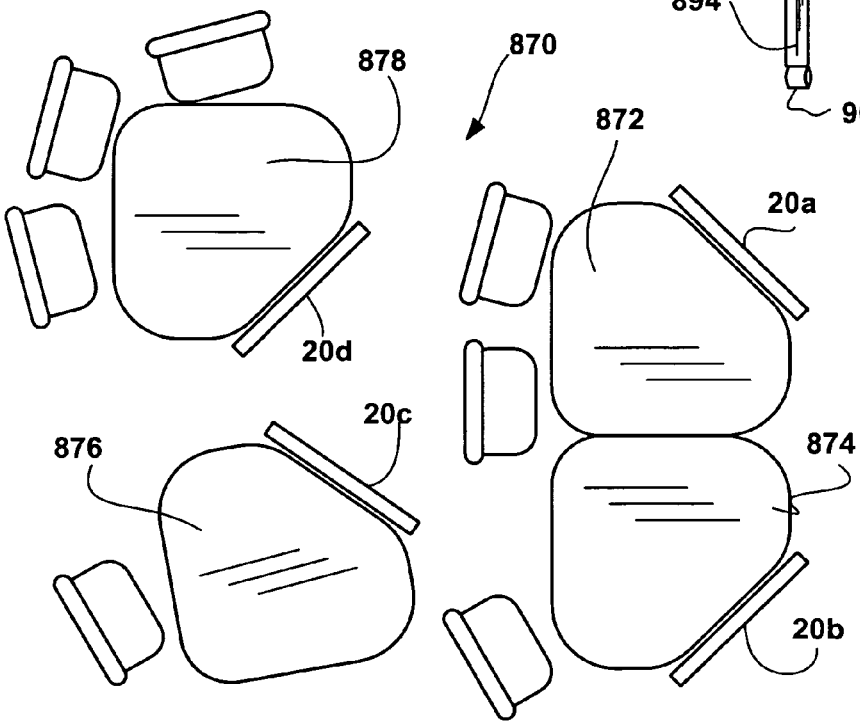
FIG. 40 is similar to FIG. 38, albeit where the table assemblies have been separated to facilitate break-out sessions.

To facilitate breakout sessions, table top members 272, 274, 276 and 278 may be moved about the conference space and repositioned. One exemplary repositioning is illustrated in FIG. 40 where top members 872 and 874 remain together and displays 20*a* and 20*b* can be used to facilitate one breakout session, top member 876 and associated display 20*c* can be used to facilitate a second breakout session and top member 878 and display 20*d* are moved to a different location within the conference space to facilitate a third breakout session.

Figure 41:
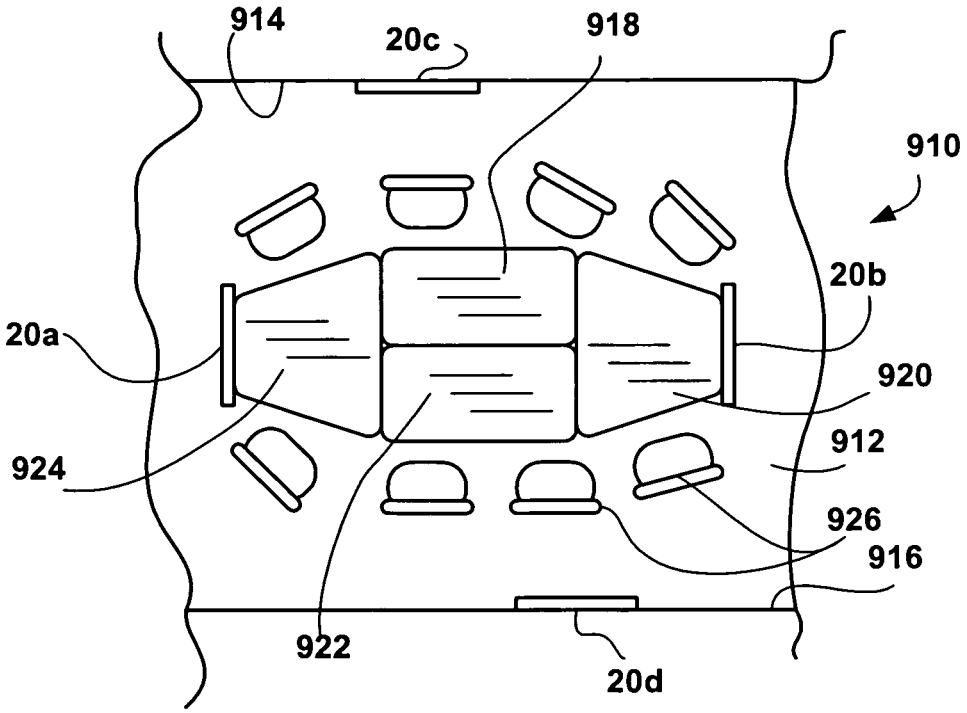
FIG. 41 is a top plan view of another inventive conference configuration.
Figure 42:
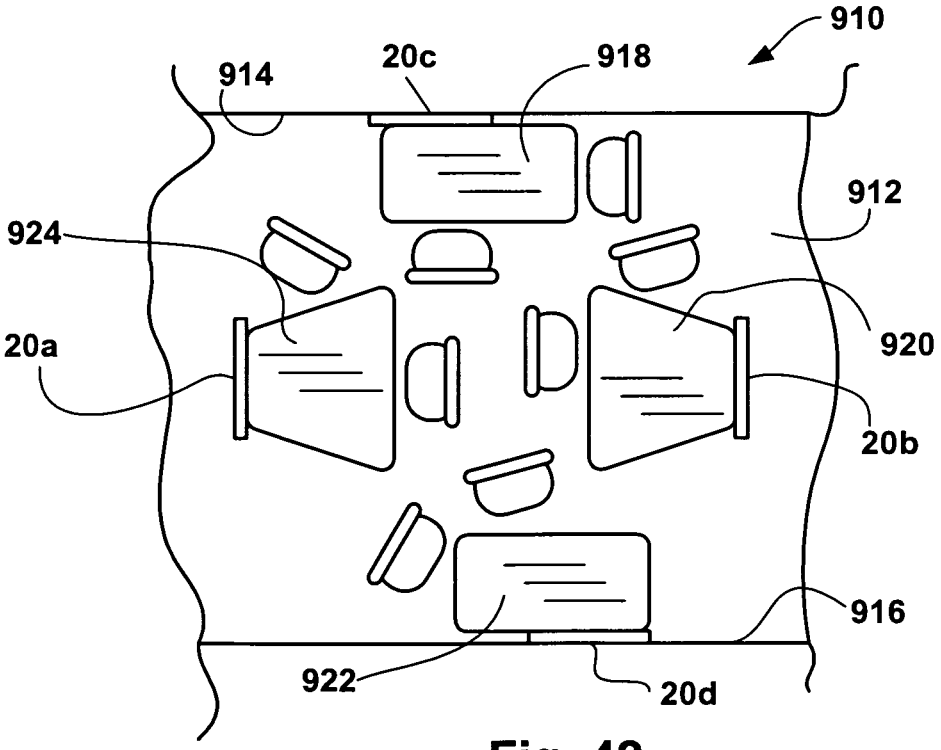
FIG. 42 is a top plan view similar to FIG. 41, albeit where the conference configuration table assemblies have been separated to facilitate break-out sessions.

Referring now to FIGS. 41 and 42, one additional exemplary conference configuration 910 is illustrated that includes a conference space 912 defined at least in part by oppositely facing space defining walls 914 and 916, a table configuration including, among other components first through fourth table top members 918, 920, 922 and 924, respectively, first through fourth displays 20*a*, 20*b*, 20*c* and 20*d*, respectively, and a plurality of conferencing chairs, two of which are collectively identified by numeral 926. In configuration 910, displays 20*c* and 20*d* are mounted on walls 914 and 916, respectively, so as to face in opposite directions.

Top members 918 and 922 have similar rectangular shapes, each having two long edges and two short edges. Each of top members 920 and 924 is rhombus shaped having one short edge and one long edge that is parallel to the short edge and two side edges. Here, the short edges of each of rectangular members 918 and 922 is approximately half the length of the long edge of each of rhombus shaped top members 920 and 924. Thus, when the long edges of rectangular members 918 and 922 are brought together, the combined short edges thereof have a length approximately equal to the long edge of each of rhombus shaped members 920 and 924.

Display 20*a* is mounted to the short edge of top member 924. Similarly, display 20*b* is mounted to the short edge of top member 920. Here, it is assumed that displays 20*a* and 20*b* are mounted to the edges of members 924 and 920 via brackets like the bracket illustrated and described above with respect to FIG. 4.

Although not illustrated, in this embodiment is assumed that rectangular top members 918 and 922 are mounted on top of leg assemblies that include casters or wheels therebelow (see again FIG. 39) so that members 918 and 922 can be moved within the conference space 912. In at least some embodiments, rhombus shaped members 920 and 924 may not be mounted for movement and instead may have pedestal type supports therebelow that do not include wheels or casters. In other embodiments, wheels or casters may be provided at the bottoms of the support structures for members 920 and 924.

Referring still to FIGS. 41 and 42, rectangular top members 918 and 922 can be positioned between rhombus shaped members 920 and 924 to form a relatively large conference table assembly with displays 20*a* and 20*b* at opposite ends thereof and facing each other. Here, chairs 926 can be placed around top members 918, 920, 922 and 924 to facilitate a relatively large conference. In this case, displays 20*c* and 20*d* are off axis to the conference table assembly and can be used for off axis purposes.

To facilitate small breakout sessions, rectangular top members 918 and 922 can be pulled apart and moved toward walls 914 and 916, respectively, until edges thereof are proximate off axis displays 20*c* and 20*d* as best illustrated in FIG. 41. In this case, each of the four table top members 918, 920, 922 and 924 can be used separately to facilitate a breakout session and each can be used with a different one of the display screens 20*a*, 20*b*, 20*c* and 20*d*.

Figure 43:
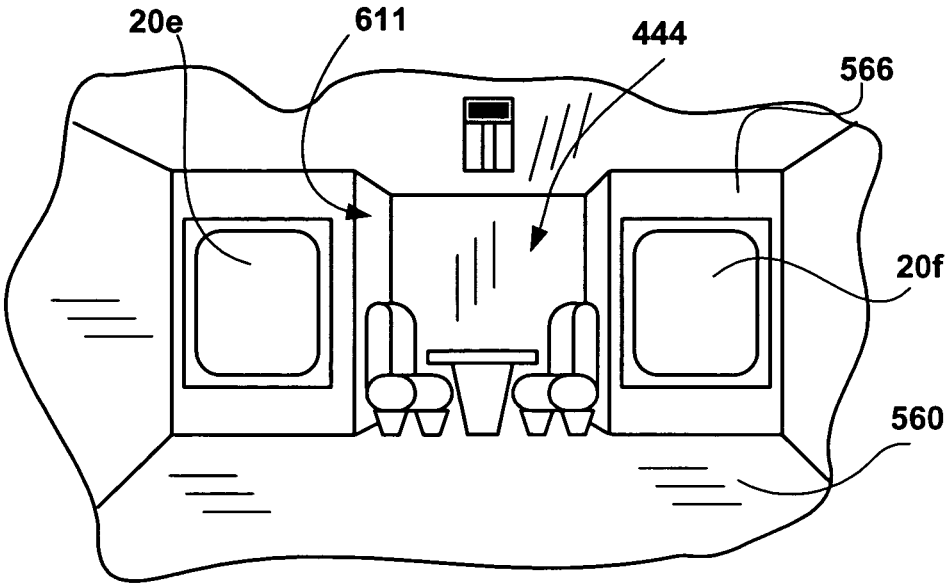
FIG. 43 is a front perspective view taken along the line 43-43 in FIG. 20.
Figure 44:
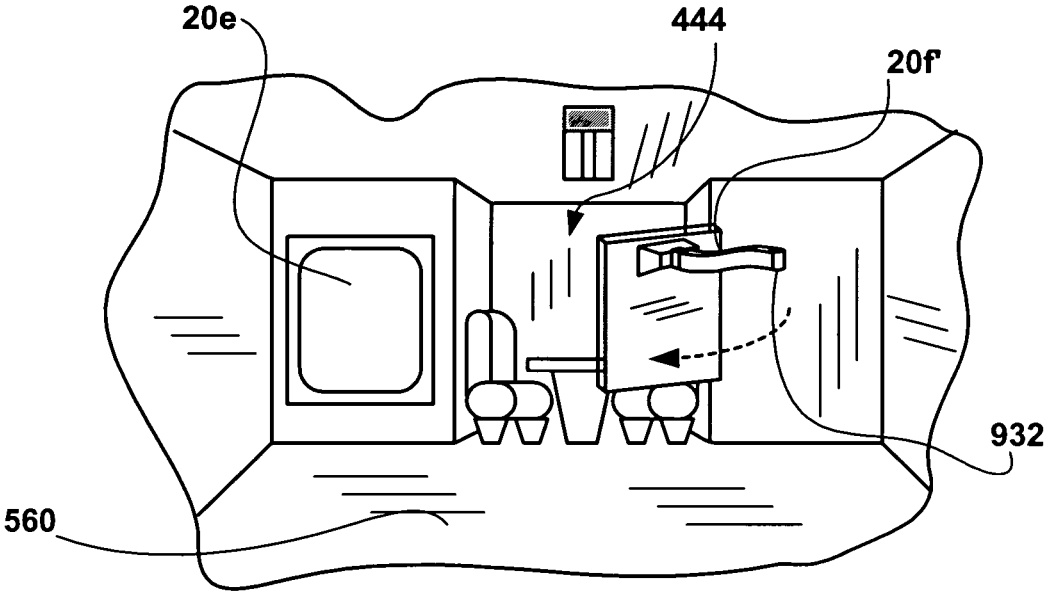
FIG. 44 is similar to FIG. 43, albeit wherein one of two wall mounted flat panel displays has been moved into a second position usable within an alcove.

According to one additional aspect of at least some embodiments of the present invention, it has been recognized that a single display can be mounted to supporting structure that allows the display to be moved between at least first and second different positions or orientations where the display is usable to present information in either one of first or second different spaces that are at least in part defined by a wall structure that forms an opening between the first and second spaces. For example, referring once again to FIG. 20 and also to FIGS. 43 and 44, in one exemplary embodiment where an alcove space 444 is formed within an opening 611 formed by a wall 566 where the wall 566 at least in part forms a larger conference space 560, first and second displays 20*e* and 20*f* may be mounted on opposite sides of the alcove space 444 via arm supports 930 and 932. Here, it is contemplated that arm supports 930 and 932 can support the associated displays 20*e* and 20*f*, respectively, in at least two different positions. In a first position illustrated in FIGS. 20 and 43, displays 20*e* and 20*f* are adjacent and generally parallel to wall 566 and are usable generally within larger conference space 560. In the second position, displays 20*e* and 20*f* are rotated via arms 930 and 932 and moved into the positions generally indicated in phantom and labeled 20*e*' and 20*f* in FIG. 20 (see also FIG. 44) where the displays face into alcove space 444. Here, the arms 930 and 932 should be long enough to allow the entire display screens to clear the alcove corners so that the entire screen surfaces are observable from within alcove space 444 upon proper positioning. In this position, the displays 20*e* and 20*f* are generally usable by breakout attendees in space 444 and are not usable by persons in the larger conferencing space 560. In the alternative, display 20*e* may remain against wall 566 while display 20*f* is moved into position to be used by attendees in alcove 444 as illustrated in FIG. 44.

Although not illustrated, other support structures for supporting displays for movement between two positions adjacent an alcove space 444 is contemplated. For instance, each of displays 20*e* and 20*f* may be hingedly mounted along an edge adjacent alcove space 444 for movement between the two positions illustrated in FIG. 20. As another instance, a track or rail member (see FIG. 14) may be mounted to ceiling structure where the rail member extends along wall 566 and the displays 20*e* and 20*f* are mounted to the rail structure to glide therealong and to rotate through at least 180°.

According to still one additional embodiment, a flat panel display screen may be mounted to rails for movement through an opening in a wall that defines first and second different spaces. For example, in at least some embodiments, is contemplated that a display screen may be usable both outside a conference room or space to greet conference attendees as they arrive to attend a conference and within the conferencing space to share information among conference attendees.

Figure 45:
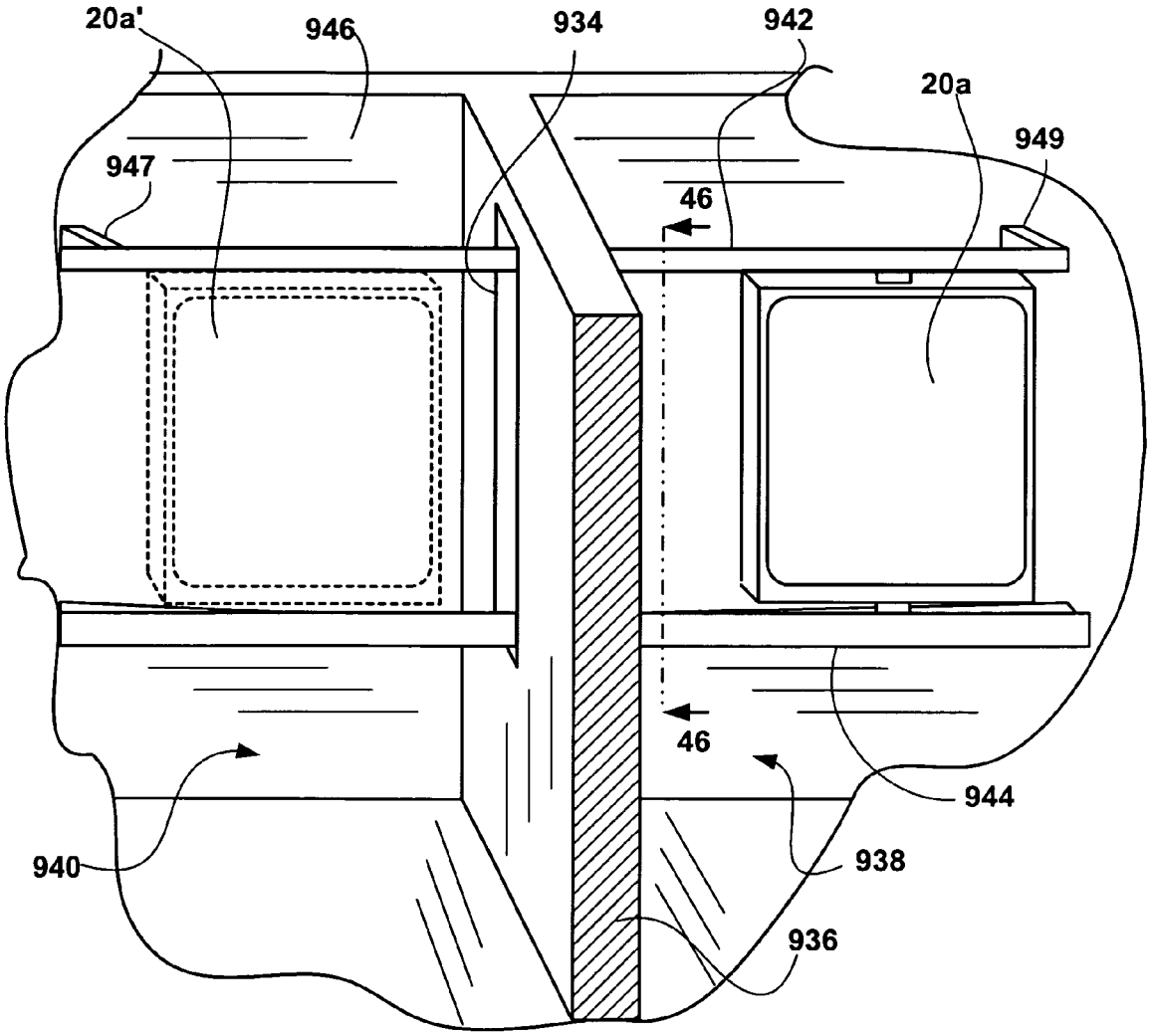
FIG. 45 is a perspective view showing a flat panel display mounted to a rail assembly where the flat panel display is usable in either first or second spaces separated by a wall.
Figure 46:
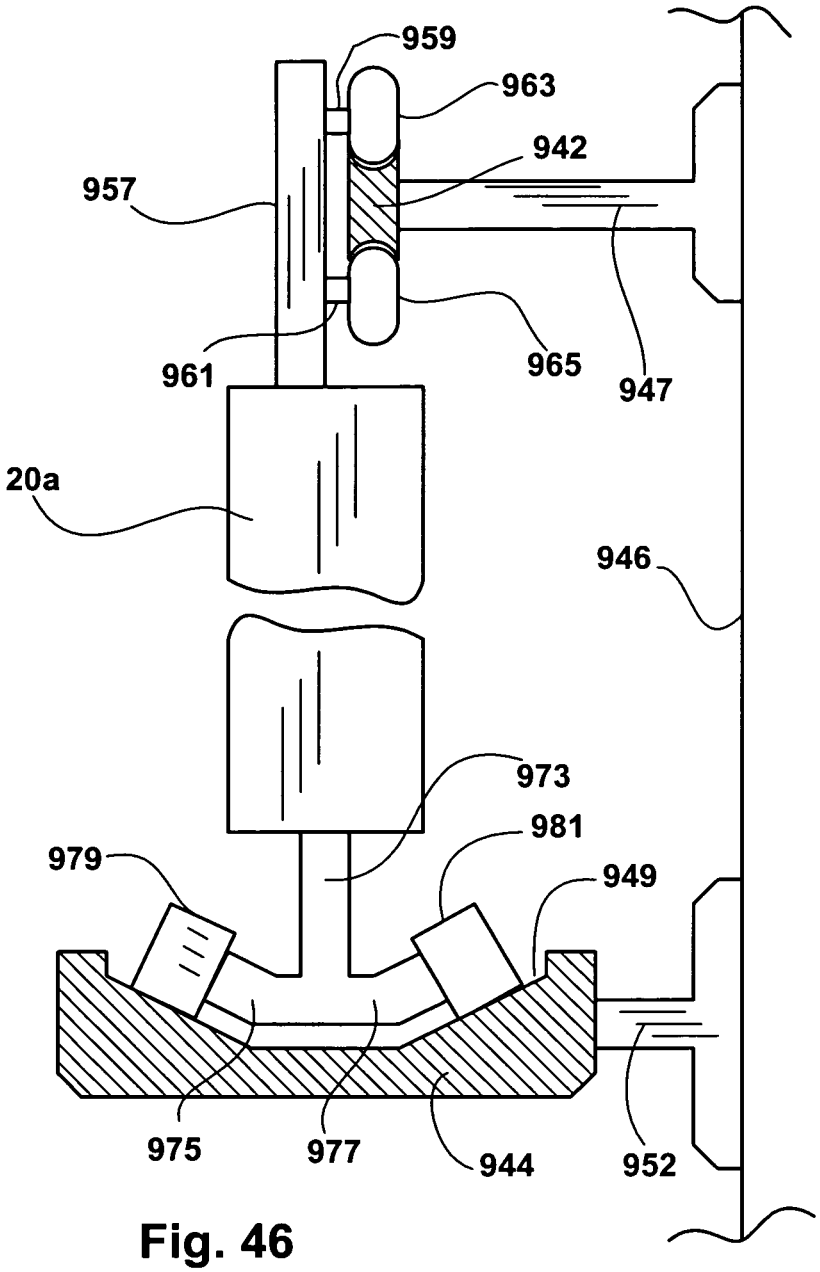
FIG. 46 is a cross-sectional view taken along the line 46-46 of FIG. 45.

One exemplary system consistent with the comments above is illustrated in FIG. 45 which includes a display 20*a* mounted to first and second rails 942 and 944 for movement between a first space 938 and a second space 940 where an opening 934 is formed within a wall 936 that divides the first and second spaces 938 and 940, respectively. In this example, it is assumed that first space 938 is a greeting space outside a conference space and that space 940 is the conference space within a conference room. Rails 942 and 944 are mounted to wall 946 that is perpendicular to dividing wall 936. Referring also to FIG. 46, top rail 942 is an elongated rigid member having top and bottom channel forming edges 943 and 945. Brackets 947 and 949 mount opposite ends of rail 942 to wall 946. Bottom rail 944 forms an upwardly facing channel 949 having two surfaces that slope downwardly toward each other at an approximately 120° angle. Rail 944 is mounted at opposite ends to wall 946 via brackets 952 (only one shown in FIG. 46).

Referring still to FIGS. 45 and 46, a top glide assembly 955 includes a rigid extension member 957 that extends upward from a central location of the top edge of display housing 32, at least two axels 959 and 961 that extend laterally in the same direction from member 957 and roller wheels 963 and 965 mounted to the axels for rotation about horizontal axis (not labeled). Wheels 963 and 965 are spaced apart such that rail 942 is receivable therebetween.

Here, while only two axels 959 and 961 and associated wheels are illustrated in FIG. 46, embodiments are contemplated where four or more axels and associated wheels are provided to provide additional stability or, where two ore more top glide assemblies 955 are provided and spaced apart along the top surface of display housing 32.

A bottom glide assembly 971 includes a rigid extension member 973 that extends downward from a lower surface of display housing 32, two axels 975 and 977 that extend generally in opposite directions from member 973 where an approximately 120° angle is forme by axels 975 and 977 and two roller wheels 979 and 981 mounted to axels 975 and 977 for rotation about axis that form an approximately 120° angle.

Rails 942 and 944 are mounted to wall 946 such that display 20*a* and glide assemblies 955 and 971 are receivable generally therebetween. More specifically, when wheels 979 and 981 are received within channel 949, the space between upper wheels 963 and 965 is aligned with rail 942. Other display mounting configurations are contemplated for supporting display 20*a* on rails for movement between first and second spaces.

Referring again to FIG. 45, in a first position, display 20*a* is located within greeting space 938 and can be used to greet conference attendees as the attendees arrive to attend a conference within space 940 and to provide information about the conference that is to occur. After attendees have arrived and prior to the conference within space 940 beginning, display 20*a* can be moved along rails 942 and 944 through opening 934 and into conference space 940 as illustrated in phantom in FIG. 45 and as labeled 20*a*'.

Figure 47:
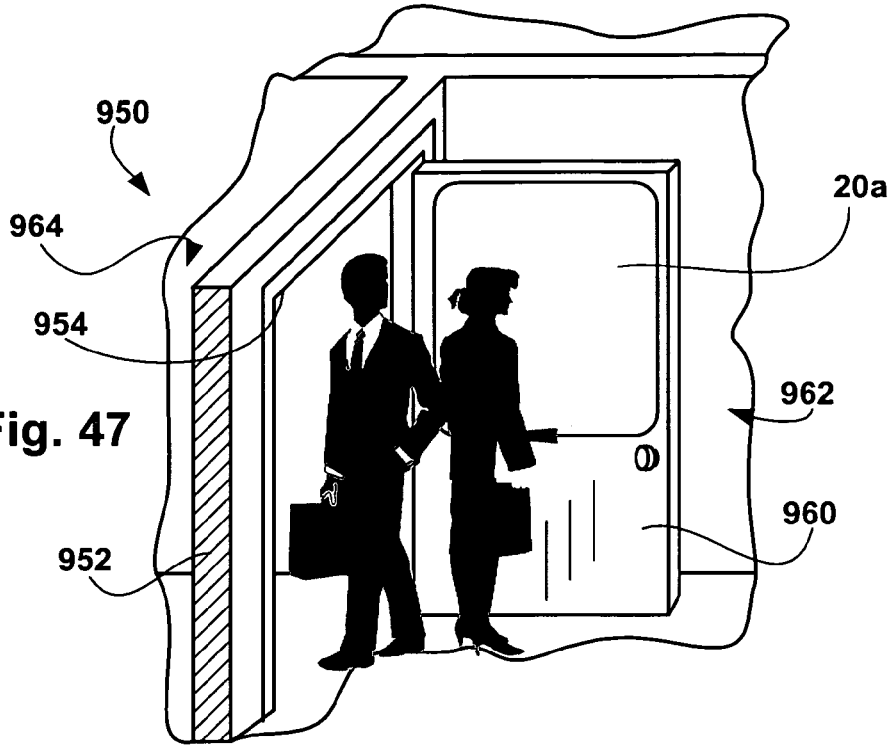
FIG. 47 is a perspective view showing a flat panel display mounted to a door where the door separates first and second spaces.
Figure 48:
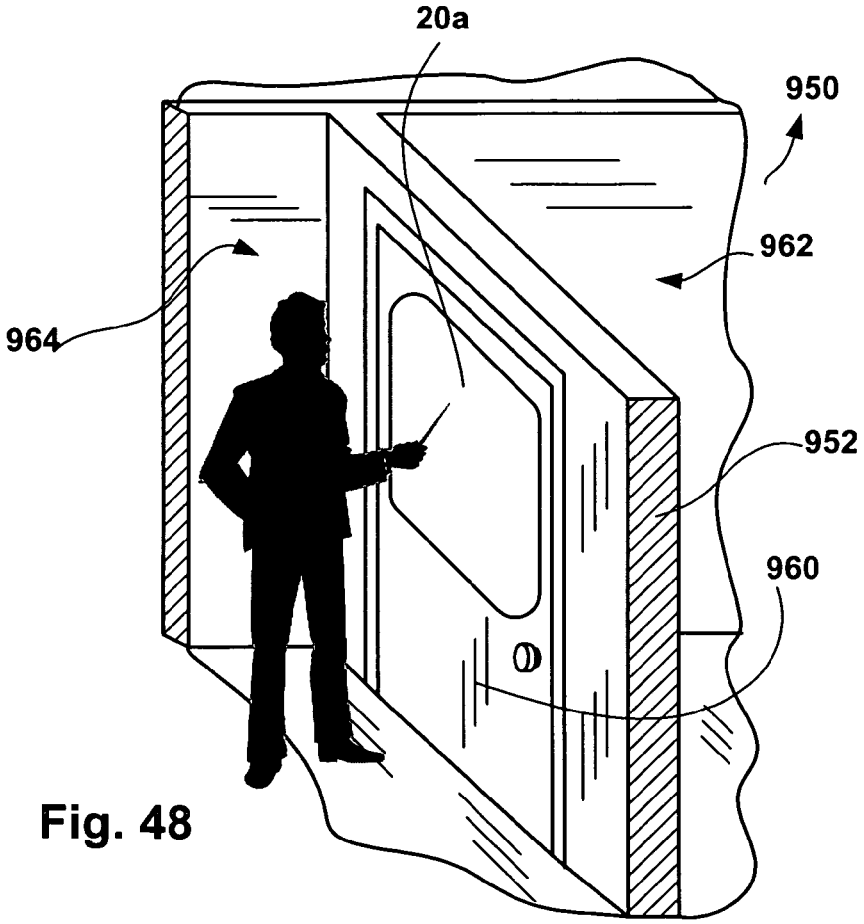
FIG. 48 shows the configuration of FIG. 47, albeit where the door is closed and the display is usable within one of the two spaces.

Referring now to FIGS. 47 and 48, another embodiment wherein a screen is mounted to support structure for moving the screen between two different spaces for use in the two separate spaces is illustrated. Here, instead of mounting display 20*a* to rails for movement between two spaces as described above with respect to FIGS. 45 and 46, a display 20*a* is mounted to an inside surface of a door 960. Door 960 is hingedly mounted for rotation between an open position illustrated in FIG. 47 to a closed position illustrated in FIG. 48 within an opening 954 formed by a dividing wall 952 which divides a greeting space 960 from a conference space 964. Here, with door 960 in the open position illustrated in FIG. 47, as attendees arrive for a meeting, again the attendees can be greeted via display 20*a* and can be provided information regarding the conference about to take place. Once all of the attendees have arrived for a conference, door 960 can be closed as illustrated in FIG. 48 and information can then be presented via display 20*a* within conference space 964.

Referring now to FIGS. 49 through 52, yet one additional embodiment 970 wherein support structure for a display allows the display to be used in two different spaces is illustrated. Here, a wall 972 divides a first space 974 from a second space 976 and an opening 978 is formed between the first and second spaces 974 and 976, respectively. Opening 970 is dimensioned to receive display 20*a* so that, when display 20*a* is aligned along wall 972, opening 978 is substantially closed.

Figure 52:
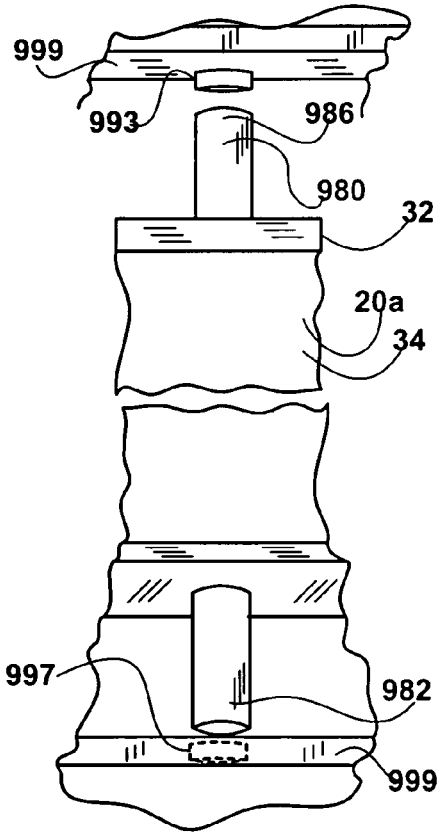
FIG. 52 is a partial view showing a mounting structure for mounting the display of FIG. 49 within a frame received in the wall opening.

Referring specifically to FIG. 52, in this embodiment, posts 980 and 982 extend upward and downward from the upper and lower ends of the housing that comprises part of display 20*a* and are received within pivot holes 993 and 997 or recesses formed by a frame member 999 that is mounted in opening 978. When so mounted, display 20*a* is rotatable about a substantially vertical support axis 986 that passes through posts 980 and 982.

Figure 49:
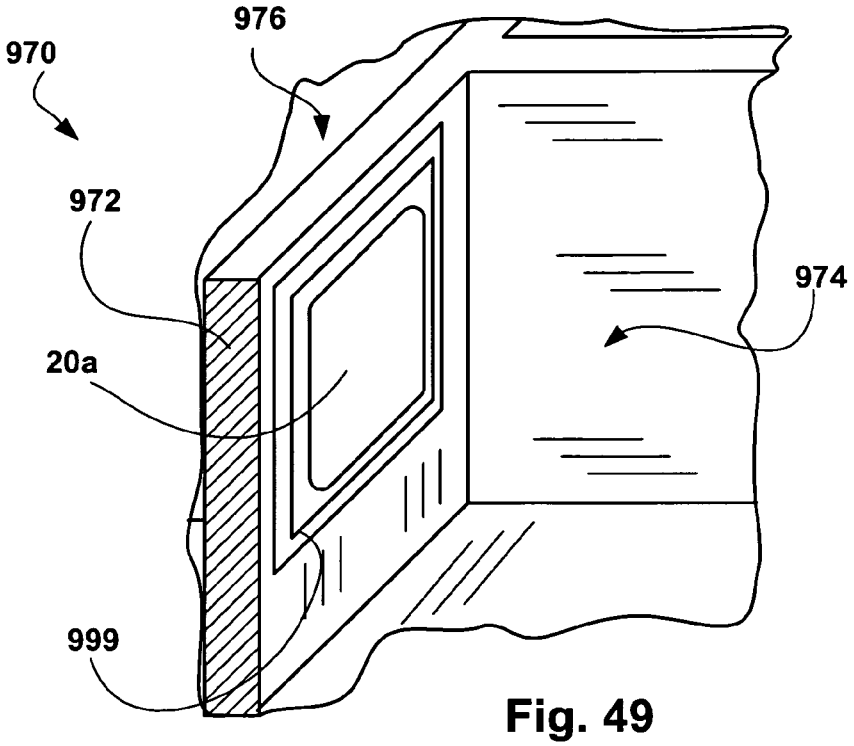
FIG. 49 is a perspective view showing a flat panel display mounted within an opening in a wall.
Figure 50:
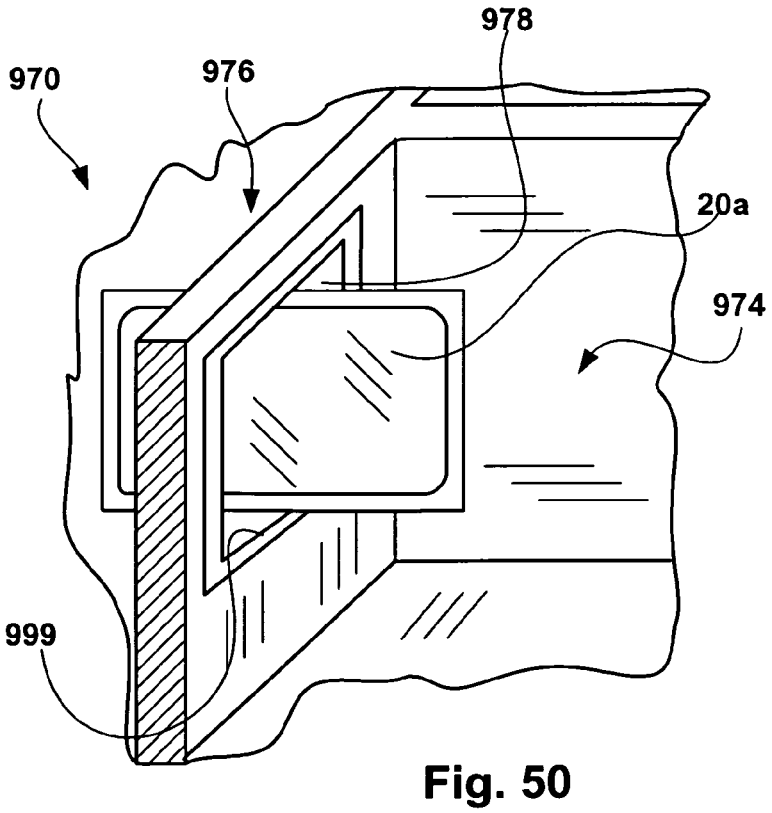
FIG. 50 is similar to FIG. 49, albeit where the display has been rotated within the opening in the wall.
Figure 51:
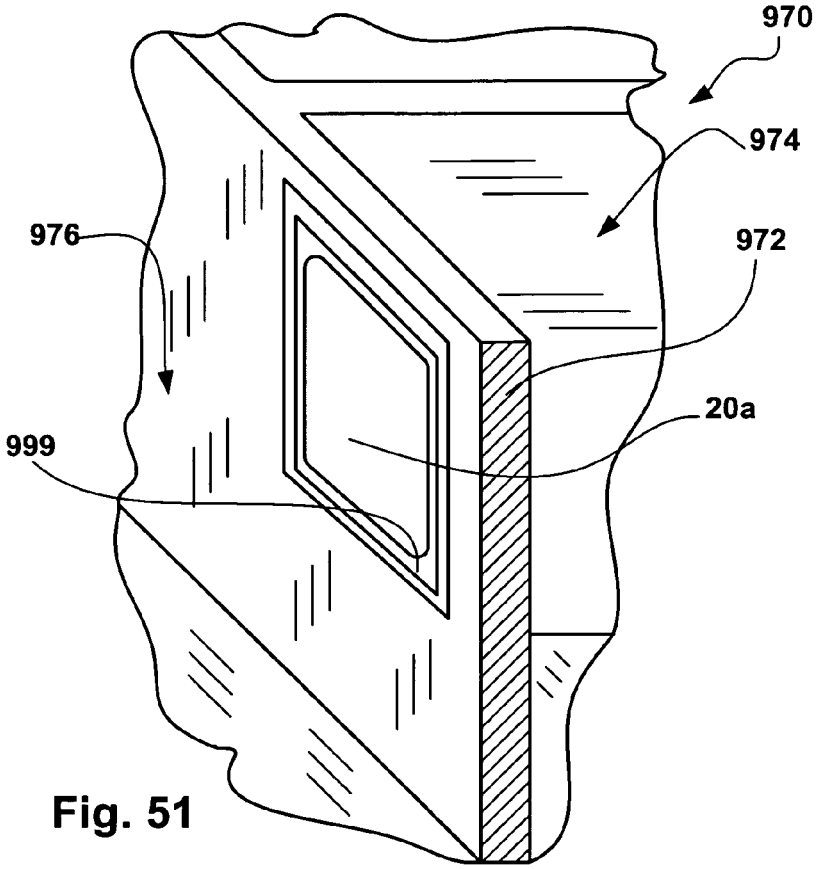
FIG. 51 is similar to FIG. 49, albeit where the display has been rotated through 180° from an original position in FIG. 49 so that the display is again flush with the wall in which the display is mounted.

Referring still to FIGS. 49 through 52, in one orientation, display 20*a* is positioned substantially parallel to wall 972 to close opening 978 and with the display screen facing into first space 974 for presenting information therein. When display 20*a* is positioned as illustrated in FIG. 48, display 20*a* can be rotated about support axis 986 (see again FIG. 51) and as illustrated in FIG. 49 through approximately 180 degrees so that display 20*a* faces into second space 976 for use within that space. Here, again, the configuration illustrated in FIGS. 48 through 51 may advantageously be used where the first and second spaces are a greeting space outside a conference room and a conference space inside the room.

While the invention may be susceptible to various modifications and alternative forms, specific embodiments have been shown by way of example in the drawings and have been described in detail herein. However, it should be understood that the invention is not intended to be limited to the particular forms disclosed. For example, while some display supporting rails are shown supported by floorposts and other supported by posts extending down from a ceiling structure, it should be appreciated that either support structure and indeed other structures such as the tops of book cases, etc., may be used to support the rail members. In addition, some aspects described above are believed inventive separate from other aspects. For instance, edge positioned displays adjacent opposite table edges is believed inventive separate from the split table concepts and vice versa.

Moreover, any of the tops described above could be split for sliding movement along various dividing lines. For instance, in FIG. 6, leaf shaped top 88 could be split along any of the three phantom lines shown to provide a split table configuration with additional advantages.

Thus, the invention is to cover all modifications, equivalents, and alternatives falling within the spirit and scope of the invention as defined by the following appended claims.

To apprise the public of the scope of this invention, the following claims are made:

What is claimed is:

1. A conferencing assembly, the assembly comprising:

a support;

at least one table top member forming a substantially flat top surface, the at least one top member supported by the support with the flat surface substantially horizontal, the at least one top member forming first and second corners, a first edge extending between the first and second corners and a second edge extending between the first and second corners, the first edge including at least one substantially straight section proximate the first corner and at least one curved section that bows convexly outward generally away from the second edge, the second edge including at least one curved section that bows convexly outward generally away from the first edge and a substantially straight section proximate the second corner wherein the straight edge sections of the first and second edges are substantially parallel;

a first display screen wherein the screen is positioned along the at least one substantially straight section of the first edge with the screen generally facing in the direction of the second edge and with the screen facing across the top surface; and a second display screen, the second display screen positioned along the straight section of the second edge with the second screen generally facing in the direction of the first edge and with the screen facing across the top surface.

2. The assembly of claim 1 wherein the substantially straight section of the first edge is a first straight section and wherein the first edge further includes a second substantially straight section adjacent the second corner, the curved section of the first edge between the first and second straight sections.

3. The assembly of claim 2 wherein the second edge includes first and second substantially straight sections proximate the first and second corners, respectively, and, wherein, the curved section of the second edge is between the first and second straight sections of the second edge.

4. The assembly of claim 3 wherein the first straight section of the first edge is longer than the second straight section of the first edge and wherein the second straight section of the second edge is longer than the first straight section of the second edge.

5. The assembly of claim 3 wherein the first and second straight sections of the first edge form a substantially ninety degree angle and wherein the first and second straight sections of the second edge form a substantially ninety degree angle.

6. The assembly of claim 3 wherein the first and second straight sections of the first edge form an angle between 60 degrees and 120 degrees and wherein the first and second straight sections of the second edge form an angle between 60 degrees and 120 degrees.

7. The assembly of claim 3 wherein the first and second edges have substantially similar length dimensions.

8. The assembly of claim 1 wherein the at least one top member includes at least first and second top members that form the first and second edges.

9. The assembly of claim 8 wherein the first and second top members form the first and second edges, respectively.

10. The assembly of claim 8 wherein the first and second edges are external edges and wherein the first top member forms an internal edge opposite the external edge of the first top member and the second top member forms an internal edge opposite the external edge of the second top member.

11. The assembly of claim 10 wherein the internal edges of the first and second top members are substantially straight and wherein the internal edge of the first top member is parallel to the internal edge of the second top member.

12. The assembly of claim 11 wherein the support facilitates movement of at least one of the first and second top members with respect to the other of the first and second top member.

13. The assembly of claim 12 wherein the support includes at least one rail and wherein the at least one of the first and second top members that is supported to move with respect to the other of the first and second top members is mounted to the rail for sliding movement there along.

14. The assembly of claim 13 wherein each of the first and second top members is mounted to the at least one rail for sliding movement there along.

15. The assembly of claim 14 wherein each of the first and second top members is mounted to the rail for movement along a trajectory that is substantially parallel to the internal edges of the first and second top members.

16. The assembly of claim 15 wherein the straight section of the first edge is closer to the second corner when the first and second top members are in the combined orientation than when the first and second top members are in the spaced orientation.

17. The assembly of claim 13 wherein the first and second top members are positionable along the rail in at least two juxtapositions including a combined orientation wherein the internal edges of the first and second top members are adjacent along substantially their entire length dimensions and a spaced orientation wherein at least a section of the internal edge of the first top member is spaced from at least a section of the internal edge of the second top member.

18. The assembly of claim 17 wherein each of the first and second top members slides along the rail along a trajectory that is parallel to the internal edge of the top member.

19. The assembly of claim 17 wherein the straight section of the first edge is closer to the second corner when the first and second top members are in the spaced orientation than when the first and second top members are in the combined orientation.

20. The assembly of claim 1 wherein the display screen includes a lower edge and wherein the lower edge is proximate the straight section of the first edge.

21. The assembly of claim 1 wherein the display screen is at least eighteen inches high by twenty-four inches wide.

22. The assembly of claim 1 wherein the display screen is mounted to the straight section of the first edge.

23. The assembly of claim 1 wherein the support is a first support and wherein the assembly further includes a second support that independently supports the display screen adjacent the first edge.

24. The assembly of claim 23 wherein the second support includes wheels for transporting the display screen.

25. The assembly of claim 23 wherein the second support includes a rail and an arm assembly, the arm assembly mounting the screen to the rail for movement there along.

26. The assembly of claim 1 wherein the first and second screens face in opposite directions.

27. The assembly of claim 26 wherein the first and second display screens oppose each other.

28. The assembly of claim 1 wherein the at least one top member includes at least first and second top members that form the first and second edges.

29. The assembly of claim 28 wherein the first and second edges are external edges and wherein the first top member forms an internal edge opposite the external edge of the first top member that extends between the first and second corners and the second top member forms an internal edge opposite the external edge of the second top member that extends between the first and second corners.

30. The assembly of claim 29 wherein the internal edges of the first and second top members are substantially straight and wherein the internal edge of the first top member is parallel to the internal edge of the second top member.

31. The assembly of claim 30 wherein the support facilitates movement of at least the first top member with respect to the second top member.

32. The assembly of claim 31 wherein the support includes at least one rail and wherein the first top member is mounted to the rail for sliding movement there along.

33. The assembly of claim 32 wherein each of the first and second top members is mounted to the rail for movement along a trajectory that is substantially parallel to the internal edges of the first and second top members.

34. The assembly of claim 31 wherein the display screen positioned proximate the straight section of the first edge is supported so at to be moveable along with the first top member.

* * * * *